US007524804B2

(12) United States Patent
Kaneda et al.

(10) Patent No.: US 7,524,804 B2
(45) Date of Patent: Apr. 28, 2009

(54) BLEACH COMPOSITION AND BLEACHING DETERGENT COMPOSITION

(75) Inventors: Hideyuki Kaneda, Tokyo (JP); Yoshitaka Miyamae, Tokyo (JP); Satoru Nagata, Tokyo (JP)

(73) Assignee: Ciba Specialty Chemicals Corp., Tarrytown, NY (US)

( * ) Notice: Subject to any disclaimer, the term of this patent is extended or adjusted under 35 U.S.C. 154(b) by 428 days.

(21) Appl. No.: 10/555,673

(22) PCT Filed: May 7, 2003

(86) PCT No.: PCT/JP03/05700

§ 371 (c)(1),
(2), (4) Date: Nov. 3, 2005

(87) PCT Pub. No.: WO2004/099357

PCT Pub. Date: Nov. 18, 2004

(65) Prior Publication Data

US 2006/0293204 A1 Dec. 28, 2006

(51) Int. Cl.

| | |
|---|---|
| ***C11D 1/00*** | (2006.01) |
| ***C11D 3/26*** | (2006.01) |
| ***C11D 3/39*** | (2006.01) |
| ***C11D 3/395*** | (2006.01) |

(52) U.S. Cl. ..... 510/311; 510/312; 510/360; 510/372; 510/376; 510/499; 502/200; 502/324

(58) Field of Classification Search ..... 510/311, 510/312, 360, 372, 376, 499; 502/200, 324
See application file for complete search history.

(56) References Cited

U.S. PATENT DOCUMENTS

| | | | | |
|---|---|---|---|---|
| 6,051,545 | A * | 4/2000 | Boskamp | 510/446 |
| 6,756,365 | B2 | 6/2004 | Levy | 514/154 |
| 2002/0155976 | A1 * | 10/2002 | Boskamp et al. | 510/446 |

FOREIGN PATENT DOCUMENTS

| | | | |
|---|---|---|---|
| CA | 2290014 | * | 5/2001 |
| EP | 0544440 | | 6/1993 |
| JP | 6-57297 | | 3/1994 |
| JP | 9-25499 | | 1/1997 |
| JP | 9-137196 | | 9/1997 |
| JP | 9-511774 | | 9/1997 |
| JP | 2000-192098 | | 7/2000 |
| JP | 2002-502456 | | 1/2002 |
| JP | 2002-294297 | | 10/2002 |
| JP | 2003-064574 | | 3/2003 |
| JP | 2003-89800 | | 3/2003 |
| JP | 2003-171690 | | 6/2003 |
| JP | 2003-171697 | | 6/2003 |
| WO | 98/55575 | | 12/1998 |
| WO | 99/13042 | | 3/1999 |
| WO | 99/60087 | | 11/1999 |
| WO | 01/02526 | | 1/2001 |
| WO | WO01/09276 | * | 2/2001 |

OTHER PUBLICATIONS

English Language abstract page of JP 2003-064574 from the esp@cenet web site printed on Apr. 19, 2006.
English Language abstract page of JP 2002-502456 from the esp@cenet web site printed on Apr. 19, 2006.
English Language abstract page of JP 2000-192098 from the esp@cenet web site printed on Apr. 19, 2006.
Ronald Hage et al, Nature, vol. 369 (Jun. 23, 1994) pp. 637-639.
W. Nam et al., J. American Chem. Soc. vol. 115 No. 5(1993) pp. 1772-1778.
English Language abstract page of JP 2002-294297 from the esp@cenet web site printed on Apr. 19, 2006.
English Language abstract page of JP 2003-89800 from the esp@cenet web site printed on Apr. 19, 2006.
English Language abstract page of JP 2003-171690 from the esp@cenet web site printed on Apr. 19, 2006.
English Language abstract page of JP 2003-171697 from the esp@cenet web site printed on Apr. 19, 2006.
English Language abstract page of JP 9-25499 from the esp@cenet web site printed on Apr. 19, 2006.
English Language abstract page of JP 9-137196 from the esp@cenet web site printed on Apr. 19, 2006.
English Language abstract page of JP 9-511774 from the esp@cenet web site printed on Apr. 19, 2006.
English Language abstract page of WO 99/60087 from the esp@cenet web site printed on Apr. 19, 2006.
English Language abstract page of JP 6-57297 from the esp@cenet web site printed on Apr. 19, 2006.

* cited by examiner

*Primary Examiner*—Gregory R Del Cotto
(74) *Attorney, Agent, or Firm*—Mervin G. Wood

(57) ABSTRACT

A bleach composition containing (a) a peroxide generating hydrogen peroxide by being dissolved in water, (b) a water-insoluble or poorly water-soluble textile powder selected from powder cellulose, silk powder, wool powder, nylon powder, and polyurethane powder, and (c) (c-1) a bleaching activating catalyst and/or (c-2) a bleaching activator. A bleaching detergent composition containing (a) a peroxide generating hydrogen peroxide by being dissolved in water, (b) a water-insoluble or poorly water-soluble textile powder selected from powder cellulose, silk powder, wool powder, nylon powder, and polyurethane powder, and (c) (c-1) a bleaching activating catalyst or (c-1) a bleaching activating catalyst and (c-2) a bleaching activator, and (d) a surfactant.

14 Claims, No Drawings

BLEACH COMPOSITION AND BLEACHING DETERGENT COMPOSITION

TECHNICAL FIELD

The present invention relates to a bleach composition and a bleaching detergent composition, and more specifically, relates to an oxygen-base bleach composition and a bleaching detergent composition which suppress more efficiently the damage and discoloration (color fading) of clothes and the like even under the severe condition of high concentration at erroneous use and have high bleaching power without causing coloration.

BACKGROUND ART

Since an oxygen-base bleach has characteristic that it can be used for color-patterned materials, it has been the main stream of a bleach for clothes. On the other hand, the oxygen-base bleach is inferior in bleaching power in comparison with a chlorine-base bleach and thus, its improvement is required.

Many studies have been carried out for a bleaching activator utilizing an organic peracid, a bleaching activating catalyst containing a metal atom and the like for improving the bleaching power of the oxygen-base bleach.

It is well known that the bleaching activator is converted to an organic peracid by reacting with hydrogen peroxide and exhibits high bleaching power for stains and soils.

On the other hand, the method of utilizing a bleaching activating catalyst is reported in Nature, Vol. 369 (1994) pp 637-639, J. Am. Chem. Soc., Vol. 115 (1993) pp 1772-1773, which proposes the mechanism that a complex activates catalytically hydrogen peroxide in bleaching solution to impart high bleaching effect for stains and soils. Therefore, high bleaching power can be efficiently obtained by a small amount of a complex.

However, while these techniques afford high bleaching power, when the cleaning of clothes is repeatedly carried out or a composition is directly brought in contact with clothes in high concentration, problems are known that clothes are thinned and holed and that colored clothes are discolored.

It is considered that the damage and discoloration of clothes is caused by oxygen active species, which are generated by abnormal decomposition of hydrogen peroxide.

The damage and discoloration of clothes become remarkable when high concentrations of a bleach, a bleaching activator and a bleaching activating catalyst are brought in contact with clothes if a powder bleach remains on clothes without being adequately dissolved on dip-bleaching using a tub, a cleaning vessel and the like.

For the suppression of the damage and discoloration of clothes by a bleaching activator and a bleaching activating catalyst, there are proposed a suppression technique by intimately mixing a bleaching activator with mineral materials such as acid clay and bentonite in Japanese Unexamined Patent Publication No. Hei 6-057297, a suppression technique by a combination of a catalyst with radical trapping agents such as dibutylhydroxytoluene and mono-t-butylhydroquinone in Unexamined Patent Publication No. Hei 9-511774, a suppression technique by a combination of a catalyst with crystalline layered silicates in Japanese Unexamined Patent Publication No. Hei 9-137196, and a suppression technique by a combination of a catalyst with clay mineral in Japanese Unexamined Patent Publication No. Hei 9-025499.

However, these techniques have been inadequate for suppressing the damage of clothes without coloration while exhibiting high bleaching power. Namely, a suppression technique using a radical trapping agent is a technique of deactivating oxygen active species generated and suppressing the damage and discoloration. At the same time, however, the radical trapping agent reacted with oxygen active species disadvantageously colors and stains clothes. On the other hand, by a method of physically decreasing contact chance by granulating a bleaching activator or a bleaching activating catalyst with water-insoluble substances such as mineral materials, crystalline layered silicates and clay minerals and keeping distance from clothes, they are hardly soluble, solubility is not adequately secured and adequate bleaching effect is not occasionally exhibited. Further, while they were in adequately soluble and brought in contact with clothes for a long time, the bleaching activator and the bleaching activating catalyst were gradually dissolved and became highly concentrated near clothes, the damage and discoloration occurred occasionally and suppression effect was inadequate.

On the other hand, a detergent composition containing water-insoluble solid particles is proposed in Japanese Unexamined Patent Publication No. 2003-64574 for prevention of the deterioration of texture and a detergent containing cellulose as a disintegrating agent is proposed in International patent application published in Japan No. 2002-502456 and Japanese Unexamined Patent Publication No. 2000-192098.

However, a bleaching agent and a bleaching detergent having high bleaching power and further, suppressing the damage and coloration of clothes and the discoloration of dyes has been desired.

DISCLOSURE OF THE INVENTION

It is an object of the present invention to provide an oxygen-base bleach composition and a bleaching detergent composition which suppresses the damage and discoloration of clothes and the like under the severe condition of high concentration at erroneous use and has high bleaching power without causing coloration.

The present inventors have found that the damage and discoloration of clothes can be suppressed and high bleaching power can be obtained without coloration even under the severe condition at erroneous use by adding a specific water-insoluble or poorly water-soluble textile powder in the bleach composition and bleaching detergent composition.

Namely, the present inventors have confirmed that a specific water-insoluble or poorly water-soluble textile powder keeps a physical distance between the bleaching activator and bleaching activating catalyst and clothes and can efficiently suppress the damage and discoloration of clothes by further having different effect of deactivating oxygen active species which are cause for the damage and discoloration of clothes, and have completed the present invention.

Accordingly, the present invention provides the following bleach composition and bleaching detergent composition:

1. A bleach composition containing (a) a peroxide generating hydrogen peroxide by being dissolved in water, (b) a water-insoluble or poorly water-soluble textile powder selected from powder cellulose, silk powder, wool powder, nylon powder and polyurethane powder, and (c) (c-1) a bleaching activating catalyst and/or (c-2) a bleaching activator.
2. A bleaching detergent composition containing (a) a peroxide generating hydrogen peroxide by being dissolved in water, (b) a water-insoluble or poorly water-soluble textile powder selected from powder cellulose, silk powder, wool powder, nylon powder and polyurethane powder, and (c)

(c-1) a bleaching activating catalyst or (c-1) a bleaching activating catalyst and (c-2) a bleaching activator, and (d) a surfactant.

3. The bleaching detergent composition described in 2, wherein the content of the component (d) is 10 to 50% by mass.
4. The composition described in any one of 1 to 3, wherein the component (a) is sodium percarbonate.
5. The composition described in 4, wherein the component (a) is coated sodium percarbonate.
6. The composition described in any one of 1 to 5, wherein the component (b) is powder cellulose.
7. The composition described in any one of 1 to 6, containing the component (c-1) and wherein the bleaching activating catalyst of the component (c-1) contains manganese.
8. The composition described in 7, wherein the bleaching activating catalyst of the component (c-1) is a (tris(salicylideneiminoethyl)amine)-manganese complex.
9. The composition described in any one of 1 to 8, containing 0.001 to 1% by mass of the component (c-1) in the composition.
10. The composition described in any one of 1 to 9, containing the component (c-2) and wherein the bleaching activating catalyst of the component (c-2) is 4-decanoyloxybenzoic acid or sodium 4-nonanoyloxybenzenesulfonate.
11. The composition described in any one of 1 to 9, containing the components (c-1) and (c-2) and wherein, the bleaching activating catalyst of the component (c-1) is a (tris(salicylideneiminoethyl)amine)-manganese complex and the bleaching activating catalyst of the component (c-2) is 4-decanoyloxybenzoic acid or sodium 4-nonanoyloxybenzenesulfonate.
12. The composition described in any one of 1 to 11, containing a granulated substance or a molded substance containing the components (b) and (c).
13. The composition described in 12, containing a binder compound in the granulated substance or the molded substance.
14. The composition described in 13, wherein the binder compound is polyethylene glycol with an average molecular weight of 2600 to 9300.
15. The composition described in any one of 12 to 14, further comprising a surfactant in the granulated substance or the molded substance.
16. The composition described in any one of 12 to 15, wherein the content of the component (b) is 3 to 50% by mass in the granulated substance or the molded substance.
17. The bleach composition described in any one of 12 to 16, wherein the content of the component (b) is 0.05 to 3% by mass in the composition.
18. The bleaching detergent composition described in any one of 12 to 16, wherein the content of the component (b) is 0.005 to 1% by mass in the composition.

The present invention is more specifically illustrated below. The bleach composition of the present invention contains (a) a peroxide generating hydrogen peroxide by being dissolved in water, (b) a water-insoluble or poorly water-soluble textile powder selected from powder cellulose, silk powder, wool powder, nylon powder and polyurethane powder, and (c) (c-1) a bleaching activating catalyst and/or (c-2) a bleaching activator, and the bleaching detergent composition of the present invention contains (a) a peroxide generating hydrogen peroxide by being dissolved in water, (b) a water-insoluble or poorly water-soluble textile powder selected from powder cellulose, silk powder, wool powder, nylon powder and polyurethane powder, and (c) (c-1) a bleaching activating catalyst or (c-1) a bleaching activating catalyst and (c-2) a bleaching activator, and (d) a surfactant. Further, these compositions are prepared as the solid bleach composition and bleaching detergent composition such as powders, granules, tablets, briquet, sheets or bars or the like.

Here, the bleach composition referred to as that used for dipping in a tub, a cleaning vessel and the like for 15 minutes to 2 hours for cleaning stains and soils of foods and drinks mainly adhered to clothes, yellowish stain of cloths which is generated after wearing for a long time, and the like, and adding together with a detergent during washing. The bleaching detergent composition is referred to as that used for washing for 5 to 15 minutes in a washing machine for cleaning sebum stains and black stains which are mainly adhered to cloths worn daily, the moderate stains of foods and drinks adhered to clothes and preventing yellowish stain of cloths.

The difference between the bleach composition and the bleaching detergent composition is such that a bleach composition emphasizes bleaching power and a bleaching detergent composition is inferior in bleaching power than the bleach composition but emphasizes cleaning power. Accordingly, the difference on composition is such that the bleach composition has a higher content of bleaching components (peroxide, a bleaching activating catalyst and/or a bleaching activator) and the bleaching detergent composition has a higher content of a surfactant.

The component (a) of the present invention is a peroxide which is dissolved in water to generate hydrogen peroxide.

Specific examples of the component (a) include sodium percarbonate, sodium perborate, sodium perborate trihydrate and the like, and sodium percarbonate is preferably used from the viewpoints of solubility when used and storage stability. Sodium percarbonate is more preferably coated sodium percarbonate for improving the storage stability. In particular, it is preferable to coat it with silicic acid and/or a salt of silicic acid and boric acid and/or a salt of boric acid. Specifically, as described in Japanese Patent No. 2918991, those coated by spraying an aqueous solution of silicic acid and/or an alkali metal salt of silicic acid and an aqueous solution of boric acid and/or an alkali metal salt of boric acid and those coated with a water-insoluble organic compound such as paraffin or wax are used, and it is preferably used by powder-blended with various inorganic substances such as sodium carbonate and sodium bicarbonate to make them non-dangerous substance. Further, in case of a composition in which moisture content is high in the composition due to the incorporation of a surfactant and the like, in particular, in case of the bleaching detergent composition, it is more preferable to use a coated peroxide which is obtained by coating sodium percarbonate with silicic acid and sodium borate. These peroxides can be suitably used in combination of one or two or more. The production method of the coated sodium percarbonate can also include methods described in Japanese Unexamined Patent Publication No. Hei 4-31498, Japanese Unexamined Patent Publication No. Hei 6-40709 and Japanese Unexamined Patent Publication No. Hei 7-118003 in addition to Japanese Unexamined Patent Publication No. Sho 59-196399, U.S. Pat. No. 4,526,698 (in both cases, sodium percarbonate is coated with a salt of boric acid). The mean particle size of the inorganic peroxide is preferably 200 to 1000 μm and more preferably 300 to 800 μm, and it is preferable that particles with a particle size of less than 125 μm and particles exceeding 1000 μm are 10% by mass or less in the component (a) in order to satisfy both of solubility and stability. Here, the mean particle size can be confirmed by a method of determining particle size distribution using a sieve to be described later and calculating the mean particle size from the particle size distribution, and the like. Further, it is preferable that moisture content is 2% by mass or less in the bleach composition considering the stability of a peroxide.

The content of the component (a) in the present invention is not particularly limited, but the bleach composition is preferably 20 to 90% by mass, more preferably 25 to 90% by mass and even preferably 30 to 90% by mass in the composition. Even if the content exceeds the above-mentioned range, bleaching effect for stains and soils of foods and drinks adhered to clothes and yellowish stain of cloths, which is generated after wearing for a long time, may not be enhanced, and when it is below the above-mentioned range, adequate bleaching effect may not be obtained for tough stains and soils. The bleaching detergent composition is preferably 1% by mass or more and less than 20% by mass in the composition and more preferably 2% by mass or more and less than 20% by mass. When the content is in the above-mentioned range or more, bleaching effect for the moderate stains and soils and an effect for preventing yellowish stain of cloths may not be enhanced any more, and simultaneously, the adequate content of a surfactant cannot be secured and adequate cleaning effect may not be obtained. Further, when it is below the above-mentioned range, bleaching effect of the bleaching detergent composition may not be adequate.

The component (b) of the present invention is a water-insoluble or poorly water-soluble textile powder selected from powder cellulose, silk powder, wool powder, nylon powder and polyurethane powder. The component (b) works mainly as an agent for suppressing the damage and discoloration of clothes. Further, the water-insoluble or poorly water-soluble textile powder mentioned here is textile powder in which solubility for 100 g of deionized water at 25° C. is less than 0.1 g. The above-mentioned textiles are used as they are, and granulated or pulverized by freezing or dispersing in a solvent using a pulverizing machine and the like.

Here, the powder cellulose uses purified leaf textiles, stem textiles and bast textiles such as timbers including an acicular tree and a broad leaf tree, hemps, Edgeworthia, paper mulberry, Diplomorpha, straw, bagasse and bamboo, seed fibrous textiles such as cotton, cotton plant and kapok, and the like, if necessary, partially hydrolyzed; processed textiles such as cotton, hemps and rayon; and has a non-crystalline portion. Accordingly, the component (b) of the present invention does not include microcrystalline cellulose such as Avicel and Celvia from Asahi Kasei Corporation, which removed the non-crystalline only by hydrolysis without carrying out pulverization to obtain powder. The effect of suppressing the damage and discoloration of clothes is inadequate as shown in Comparative Examples described later. The mechanism is not clear but it is estimated that the non-crystalline portion has stronger interaction with a peroxide in comparison with crystalline portion. Further, independently with the water solubility, the component (b) of the present invention does not include cellulose derivatives such as carboxymethylcellulose sodium (CMC) and hydroxyethylcellulose (HEC) which enhanced water-solubility by chemically modifying functional groups in cellulose molecules with various functional groups such as a carboxymethyl group and a hydroxyethyl group; and crosslinking type carboxymethylcellulose sodium (Ac-Di-Sol) which is its crosslinking type, and the effect of the present invention is not obtained. Namely, the powder cellulose used in the present invention does not include microcrystalline cellulose and cellulose derivatives which are described in the instruction manual of the seventh edition food additives official compendium, page D-1083 (1999, Hirokawa Shoten).

Among the above-mentioned celluloses, powder cellulose, silk powder and wool powder of natural textile are preferable, powder cellulose and silk powder are more preferable and among them, powder cellulose is particularly preferable.

The specific examples of the suitable water-insoluble or poorly water-soluble textile powder in the present invention include those which are commercially available as KC FLOC W-400G (manufactured by Nippon Paper Group Inc.), Arbocel BE-600/10, Arbocel HB120, Arbocel BE-600/30, Arbocel FD 600/30, Arbocel TF30HG, Arbocel BWW-40, Arbocel BC-200, Arbocel BE-600/20 (manufactured by Reftenmaier), Idemitsu Silk Powder (manufactured by Idemitsu Petrochemical Co., Ltd.), Silk Powder (manufactured by Daito Kasei Kogyo Co., Ltd.), 2002 EXDNATCOS Type-S (manufactured by Elf Atochem Ltd.) and the like.

In the present invention, the size and length of the above-mentioned water-insoluble or poorly water-soluble textile powder are not particularly limited, but the mean particle size or mean textile length is preferably 150 μm or less, more preferably 100 μm or less, preferably 5 μm or more considering the powdering during production and in particular, preferably 10 μm or more. Here, in the present invention, the measurement method of the above-mentioned mean particle size and mean textile length is not particularly limited, and for example, they can be confirmed by measuring utilizing a laser beam scattering type particle size distribution measurement device, calculating from the particle size distribution by sieving according to the test of particle size described in Japanese Pharmacopoeia, measuring by an electron microscope method and the like. Further, the textile powder having the above-mentioned size may be selected from commercially available products which are those included in the above-mentioned range, and may be pulverized, sieved so as to be the above-mentioned size, and the like. In the present invention, they are calculated based on the particle size distribution by sieving according to the test of particle size described in Japanese Pharmacopoeia.

The component (b) of the present invention may employ one kind of the above-mentioned water-insoluble or poorly water-soluble textile powder and a plural number of the water-insoluble or poorly water-soluble textile powders may be mixed at an arbitrary proportion and used.

In the present invention, when granulated substances or molded substances are prepared using the component (b) and not using the component (c) together described later, the content of the component (b) in a composition is preferably 5 to 40% by mass in the bleach composition and more preferably 10 to 20% by mass. Further, it is preferably 1 to 10% by mass in the bleaching detergent composition and more preferably 3 to 10% by mass. Even if the content exceeds the above-mentioned range, the effect of suppressing the damage and discoloration of clothes may not be enhanced, and at the same time, when it exceeds the above-mentioned range, the adequate content of a surfactant is not secured in the bleaching detergent composition and adequate cleaning effect may not be obtained. Further, when the content is below the above-mentioned range, the effect of suppressing the damage and discoloration of clothes may not be adequate.

In the present invention, when granulated substances and molded substances are prepared by the component (b) together with the component (c) described later, the content of the component (b) in the composition is preferably 0.05 to 3% by mass in the bleach composition and more preferably 0.1 to 1% by mass. In the case of bleaching detergent composition, the content of the component in the composition is preferably 0.005 to 1% by mass and more preferably 0.01 to 0.5% by mass.

Thus, since the damage and discoloration of clothes by the component (c) can be efficiently suppressed by comparatively small amount of the component (b) by preparing granulated substances and molded substances in which the component (b) and the component (c) exist closely, it is preferable.

The component (c) of the present invention is (c-1) a bleaching activating catalyst and/or (c-2) a bleaching activator in case of the bleach composition and in case of the bleaching detergent composition, (c-1) a bleaching activating catalyst is essential and the composition preferably contains a bleaching activator.

The (c-1) a bleaching activating catalyst contained in the bleach composition and the bleaching detergent composition acts catalytically in a bleaching solution and since bleaching effect is continuously expressed so far as a peroxide exists, the bleaching effect is obtained when it is used in a small amount. However, the damage and discoloration of clothes may occur. The (c-1) a bleaching activating catalyst is such that transition metal atoms such as copper, iron, manganese, nickel, cobalt, chromium, vanadium, ruthenium, rhodium, palladium, rhenium, tungsten and molybdenum form a complex with a ligand through a nitrogen atom, an oxygen atom and the like. As the transition metal included, cobalt, manganese and the like are preferable and manganese is preferable in particular.

In this case, any counterion exists, in equilibrium with stoichiometrically generated charge by the combination of the transition metal atoms with the ligand, and in such case, preferable counter ion is chloride ion and ammonium ion.

The preferable ligand in the present invention includes ligands disclosed in Japanese Unexamined Patent Publication No. 2000-144188, Japanese Unexamined Patent Publication No. 2000-54256, Japanese Unexamined Patent Publication No. 2000-34497, International patent application published in Japan Nos. 2000-508011 and 2000-500518, Japanese Unexamined Patent Publication No. Hei 11-57488, Japanese Unexamined Patent Publication No. Hei 11-106790, Japanese Unexamined Patent Publication No. Hei 11-171893, Japanese Unexamined Patent Publication No. Hei 11-342341, International patent application published in Japan Nos. Hei 11-507689, Hei 11-515049, Hei 11-507689, Hei 11-515049 and Hei 11-507923, Japanese Unexamined Patent Publication No. Hei 9-194886, Japanese Unexamined Patent Publication No. Hei 8-231987, Japanese Unexamined Patent Publication No. Hei 8-067687, International patent application published in Japan No. Hei 8-503247, Japanese Patent Publication No. Hei 7-065074, Japanese Patent Publication No. Hei 7-068558, Japanese Unexamined Patent Publication No. Hei 5-17485, International Patent Laid Open No. 94/11479 pamphlet, International Patent Laid Open No. 93/15175 pamphlet, International patent application published in Japan Nos. 2002-530481, 2002-538268 and 2000-515194, and Japanese Unexamined Patent Publication No. 2002-294290. More specific ligand includes carboxylate containing amine, 1,4,7-trimethyl-1,4,7-triazacyclononane and its similar compound, porphin and porphyrin, phthalocyanine and a water-soluble or water-dispersing derivative having their skeleton, a 2,2'-dipyridyl derivative, a 1,10-phenanthroline derivative, amine, tris(salicylideneiminoethyl)amine, N,N'-ethylenebis(4-hydroxysalicylideneiminate), 13,14-dichloro-6,6-diethyl-3,4,8,9-tetrahydro-3,3,9,9-tetramethyl-1H-1,4,8,11-benzotetraazacyclotridecine, 5,12-dimethyl-1,5,8,12-tetraaza-bicyclo[6,6,2]hexadecane, 5,12-diethyl-1,5,8,12-tetraaza-bicyclo[6,6,2]hexadecane and the like. The specific bleaching activating catalyst includes carboxylate containing cobalt amine, tris-pi-oxo-bis[(1,4,7-trimethyl-1,4,7-triazacyclononane)manganese (IV)]pentafluorophosphate, a manganese complex of a porphin or porphyrin derivative, a manganese complex of phthalocyanine or a phthalocyanine derivative, a manganese complex of a 2,2'-dipyridyl derivative, a manganese complex of a 1,10-phenanthroline derivative, cobalt amine, a manganese complex of (tris(salicylideneiminoethyl)amine), a manganese complex of (N,N'-ethylenebis(4-hydroxysalicylideneiminate)), 5,12-dimethyl-1,5,8,12-tetraaza-bicyclo[6,6,2]hexadecane:manganese (II) chloride, [13,14-dichloro-6,6-diethyl-3,4,8,9-tetrahydro-3,3,9,9-tetramethyl-1H-1,4,8,11-benzotetraazacyclotridecine]-iron complex, and the like. In the present invention, the more preferable bleaching activating catalyst includes tris-μ-oxo-bis[(1,4,7-trimethyl-1,4,7-triazacyclononane)manganese (IV)]pentafluorophosphate, a manganese complex of (tris(salicylideneiminoethyl)amine) and a manganese complex of (N,N'-ethylenebis(4-hydroxysalicylideneiminate)), and a manganese complex of (tris(salicylideneiminoethyl)amine) is preferable from the viewpoints of the damage and discoloration of clothes.

The molar ratio of the preferable transition metal atom to the ligand of the bleaching activating catalyst (c-1) in the present invention is 1:1 to 1:4. When the proportion of the ligand is smaller than this ratio, hydrogen peroxide is decomposed by the transition metal atom which does not form a complex and the bleaching effect may be lowered. On the other hand, even if the proportion of the ligand is larger than this ratio, the bleaching effect is not enhanced any more and it may not be economical.

In the present invention, when granulated substances and molded substances are not prepared by the component (b) together with the component (c-1), the preferable content of the component (c-1) in the bleach composition and the bleaching detergent composition is 0.001 to 1% by mass, more preferably 0.01 to 0.5% by mass in the bleach composition and more preferably 0.005 to 0.3% by mass in the bleaching detergent composition. Even if the content exceeds the above-mentioned range, the bleaching effect may not be enhanced any more, and at the same time, the suppression of the damage and discoloration of clothes may be difficult. Further, when the content is below the above-mentioned range, the adequate bleaching effect may not be obtained.

In the present invention, when granulated substances and molded substances are prepared by the component (b) together with the component (c-1), the preferable content of the component (c-1) in the bleach composition and the bleaching detergent composition is 0.001 to 1% by mass, more preferably 0.1 to 1% by mass in the bleach composition and more preferably 0.01 to 0.5% by mass in the bleaching detergent composition.

Thus, the component (c-1) can be incorporated in a slightly larger amount and bleaching power can be enhanced in case of granulated substances and molded substances in which the component (b) and the component (c-1) exist closely and the damage and discoloration; of clothes by the component (c-1) can be efficiently suppressed by comparatively small amount of the component (b); therefore it is more preferable.

The bleaching activator (c-2) used for the bleach composition of the present invention is an organic peracid precursor and a compound generating an organic peracid by peroxides such as hydrogen peroxide. Since it expresses stoichiometrically the bleaching effect, it is different from catalytic action such as the bleaching activating catalyst (c-1) and is required to be incorporated at high concentration. In that case, the damage of clothes caused by, for example, the bleaching activating catalyst (c-1) is not occurred and only the discoloration of clothes is generated. The specific examples of the bleaching activator include tetraacetylethylenediamine, pentaacetylglucose, sodium octanoyloxybenzenesulfonate, sodium nonanoyloxybenzenesulfonate, sodium decanoyloxybenzenesulfonate, sodium undecanoyloxybenzenesulfonate, sodium dodecanoyloxybenzenesulfonate, octanoyloxybenzoic acid, nonanoyloxybenzoic acid, decanoyloxybenzoic acid, undecanoyloxybenzoic acid, dodecanoyloxybenzoic acid, octanoyloxybenzene, nonanoyloxybenzene, decanoyloxybenzene, undecanoyloxybenzene, dodecanoyloxybenzene and the like.

Further, a compound represented by the following general formulae (1) and (2) is mentioned:

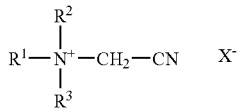

(1)

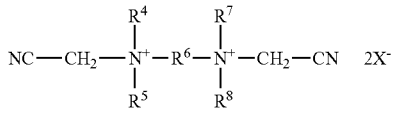

(2)

(wherein $R^1$ is an alkyl group having 1 to 6 carbon atoms, preferably 1 to 4 carbon atoms and particularly preferably 1 to 3 carbon atoms, which may be interrupted by an ester group, an amide group or an ether group, $R^6$ is an alkylene group having 1 to 8 carbon atoms and preferably 2 to 6 carbon atoms, which may be interrupted by an ester group, an amino group or an ether group and may be substituted with a hydroxy group, each of $R^2$, $R^3$, $R^4$, $R^5$, $R^7$ and $R^8$ is independently an alkyl group or a hydroxyalkyl group having 1 to 3 carbon atoms, preferably a methyl group, an ethyl group or a hydroxyethyl group, and $X^-$ is an anion, preferably halogen ion, sulfuric acid ion, fatty acid ion or alkylsulfuric acid ion having 1 to 3 carbon atoms.

Further, the organic peracid prepared by the bleaching activator exhibits sterilization power in a cleaning system and also has an effect of reducing the number of viable microorganism which resides in clothes (Yositaka Miyamae, Satosi Matsunaga, Seiichi Tobe, Kenji Takahashi, Haruo Yoshimura, Teruhisa Satsuki, The 28$^{th}$ Symposium Summary Related to Cleaning, pp 157-165 (1996)). In particular, the bleaching activator producing C8 to C12 organic peracid is preferable from the viewpoint of sterilization power. The specific examples of the bleaching activator include decanoyloxybenzoic acid, sodium dodecanoyloxybenzenesulfonate, sodium nonanoyloxybenzenesulfonate and the like, and among these, 4-decanoyloxybenzoic acid and sodium 4-nonanoyloxybenzenesulfonate are preferable from the viewpoint of bleaching effect. 4-Decanoyloxybenzoic acid and sodium 4-dodecanoyloxybenzenesulfonate are preferable from the viewpoint of the effect for suppressing discoloration.

In the present invention, the bleaching activator (c-2) is preferably incorporated as granulated substances and molded substances from the viewpoint of storage stability. When granulated substances or molded substances do not contain the component (b) and the component (c-1), the content of the bleaching activator (c-2) in granulated substances or molded substances is preferably 30 to 95% by mass and more preferably 50 to 90% by mass. When the content is out of this range, the effect of granulation may not be obtained.

It is preferable to prepare granulated substances or molded substances using a binder compound selected from polyethylene glycol, saturated fatty acid having 12 to 20 carbon atoms and polyacrylic acid with a weight average molecular weight of 1000 to 1000000 and salts thereof. Polyethylene glycol is preferably polyethylene glycol 1000 to 20000 (average molecular weight is 500 to 25000), more preferably its average molecular weight is 2600 to 9300 and preferably its average molecular weight is 7300 to 9300 in particular. Further, the saturated fatty acid having 12 to 20 carbon atoms is preferably a saturated fatty acid having 14 to 20 carbon atoms and more preferably a saturated fatty acid having 14 to 18 carbon atoms. Further, the average molecular weight of polyethylene glycol in the present invention indicates the average molecular weight described in the cosmetics manufacturing material standard (the second edition notes in explanation). Further, the weight average molecular weight of polyacrylic acid and its salt is a measurement value by gel permeation chromatography using polyethylene glycol as a standard substance. The binder substance is used in the granulated substances in an amount of 0.5 to 30% by mass, preferably 1 to 20% by mass and more preferably 5 to 20% by mass.

Further, it is preferable for improving the solubility of the bleaching activator in a cleaning bath that the granulated substances are used in combination with surfactants such as polyoxyalkylene alkyl ether, olefinsulfonate, alkylbenzenesulfonate, a salt of alkylsulfuric acid ester, or a salt of polyoxyethylene alkyl ether sulfuric acid ester or its mixture, and the like. The content in the granulated substances is preferably 0 to 50% by mass, more preferably 3 to 40% by mass and particularly preferably 5 to 30% by mass. As polyoxyalkylene alkyl ether, the carbon number of an alkyl group is preferably 10 to 15, and it is preferably the adduct of ethylene oxide (hereinafter, abbreviated as EO) and/or propylene oxide (hereinafter, abbreviated as PO). The average addition molar number is preferably 4 to 30 in total and more preferably 5 to 15 for either of EO, PO or a mixture of EO and PO, and the molar ratio of EO/PO is preferably 5/0 to 1/5 and more preferably 5/0 to 1/2. The salt of olefinsulfonic acid is preferably a sodium or potassium salt of α-olefinsulfonic acid in which the carbon number of alkyl group is 14 to 18. Further, the salt of alkylbenzenesulfonic acid is preferably a sodium or potassium salt of linear alkylbenzenesulfonic acid in which the carbon number of an alkyl group is 10 to 14. Further, the salt of alkylsulfuric acid ester is preferably an alkali metal salt, in which the carbon number of alkyl group is 10 to 18, such as sodium, and sodium laurylsulfuric acid ester or sodium myristylsulfuric acid ester is particularly preferred. Further, the salt of polyoxyethylene alkyl ether sulfuric acid ester is preferably a salt of polyoxyethylene alkyl ether sulfuric acid ester having an alkyl group having 10 to 18 carbons and sodium salt is preferable. Here, the average polymerization degree of an oxyethylene group (hereinafter, average polymerization degree is indicated by POE) is 1 to 10 and preferably 1 to 5. In particular, sodium polyoxyethylene lauryl ether sulfuric acid ester (POE=2 to 5) and sodium polyoxyethylene myristyl ether sulfuric acid ester (POE=2 to 5) are preferable.

In the present invention, the granulated substances of the above-mentioned bleaching activator can be produced by any method. Further, preferable result can be obtained by preliminarily melting the binder substance to be added. The binder substance is melted at 40 to 100° C., preferably 50 to 100° C. and more preferably 50 to 90° C. to be added. After these are mixed by stirring until being homogenized, they are formulated by a usual granulator. As a preferable granulation method, extrusion granulation can be mentioned. Granulated substances with an average particle size of 500 to 5000 μm and preferably 500 to 3000 μm are preferable. Further, other granulation method includes also a method by which a tablet shape is formed by a briquet machine as a preferable granulation method.

Here, it is known that the above-mentioned bleaching activator is hydrolyzed by the presence of an alkali component and moisture in the bleach or the bleaching detergent and bleaching and sterilization effects are lost. Therefore, in the present invention, it is more preferable for preventing such decomposition that the above-mentioned bleaching activator is mixed with a film forming polymer, zeolite and the like in addition to the above-mentioned binder and surfactant and incorporated as granulated substances.

The bleaching activator of the present invention can be also used as granulated substances or molded substances together with the bleaching activating catalyst in the bleach composition and the bleaching detergent composition.

When granulated substances and molded substances are not prepared by the component (b) together with the component (c-2), the content of the component (c-2) in the bleach composition is preferably 0.1 to 5% by mass and more preferably 0.1 to 3% by mass. The content of the component (c-2) in the bleaching detergent composition is preferably 0.05 to 3% by mass and more preferably 0.1 to 1% by mass. Even if the content exceeds the above-mentioned range, the bleaching effect may not be enhanced any more, and at the same time, the suppression of the discoloration of clothes may be difficult. Further, when the content is below the above-mentioned range, the adequate bleaching effect may not be obtained.

In the present invention, when granulated substances and molded substances are prepared by the above component (b) together with the component (c-2), the preferable content of the component (c-2) in the bleach composition is 0.1 to 10% by mass and more preferably 0.2 to 5% by mass. The content of the component (c-2) in the bleaching detergent composition is preferably 0.05 to 5% by mass and more preferably 0.1 to 2% by mass.

Thus, the component (c-2) can be incorporated slightly larger in amount and bleaching power can be enhanced in case of granulated substances and molded substances in which the component (b) and the component (c-2) exist closely, and the discoloration of clothes by the component (c-2) can be efficiently suppressed by comparatively small amount of the component (b); therefore it is more preferable.

Further, as previously described, it is effective for improving the suppression of the damage and the discoloration of clothes by the component (c) and the suppression of decomposition of peroxides when stored that the component (b) and the component (c) exits as close as possible. As the method, there are mentioned a method of forming granulated substances or molded substances containing the component (b) and the component (c), or a method of preliminarily preparing granulated substances or molded substances containing the component (c) and then coating them with a component (b) or a component composed of the component (b) with suitable addition, and the like. Among these methods, it is preferable that granulated substances or molded substances containing the component (b) and the component (c) contain a binder compound, considering the convenience of preparation and production cost. In order to improve the solubility of the binder compound and the component (c) in addition to the convenience of preparation and production cost, it is preferable in particular to use granulated substances or molded substances containing both of the binder compound and a surfactant.

Further, in order to improve the solubility of the component (c) and exhibit efficiently high bleaching power, the component (c) may be dissolved and dispersed in a solvent and the like and then immersed in or sprayed to the component (b) for granulation.

As examples of the binder compound used in granulated substances or molded substances, polyethylene glycol 1000 to 20000 (average molecular weight is 500 to 25000), saturated fatty acid having 12 to 20 carbon atoms and polyacrylic acid with a weight average molecular weight of 1000 to 1000000 and its salt can be used. More preferred is polyethylene glycol 4000 having a melting point of 50 to 65° C. (an average molecular weight of 2600 to 3800) to 6000 (an average molecular weight of 7300 to 9300) and in particular, polyethylene glycol 6000 (an average molecular weight of 7300 to 9300).

As examples of the surfactant used for granulated substances or molded substances, any of a nonionic surfactant, anionic surfactant, cationic surfactant and ampholytic surfactant can be selected. These can be used by suitably combining one or two or more. Particularly preferable surfactant is polyoxyethylene alkyl ether having a carbon chain length of 12 to 15 in which an average addition molar number of ethylene oxide is 5 to 25, an alkylsulfate or alkenylsulfate having 10 to 20 carbons, sodium α-olefinsulfonate having a carbon chain length of 14, an adduct of fatty acid methyl ester with ethylene oxide having a carbon chain length of 12 to 16 in which the average addition molar number of ethylene oxide is 5 to 30, fatty acid alkanol amide having a carbon chain length of 12 to 18, amine oxide and the like.

When granulated substances or molded substances are prepared, as the combination of the binder compound and the surfactant, a combination of sodium α-olefinsulfonate having 14 carbons and polyethylene glycol 6000 or a combination of sodium laurylsulfate and polyethylene glycol 6000 is preferable from the viewpoints of improving the solubility of the binder compound and the component (c) in addition to the convenience of preparation and production cost.

In order to improve productivity, it is preferable to add inorganic substances such as sodium sulfate and sodium tetraborate, and organic acid salts such as sodium citrate in granulated substances or molded substances.

The preparation method of granulated substances is not particularly limited, but examples of a granulation method include a method of extrusion-molding the component (b), the component (c) and if necessary, a surfactant and the like together with a binder compound in a noodle shape with a diameter of about 1 mm using a kneader and an extruder and then carrying out granulation/pulverization with a granulator; a method of dissolving and dispersing the component (b), the component (c) and if necessary, a surfactant and the like in a melted binder compound, cooling and solidifying the mixture in the mixer to prepare a bulky product and then preparing granulated substances by granulation/pulverization.

Further, there is also mentioned a method of mixing the component (b), the component (c) and a surfactant and the like using a stirring granulator, a vessel rotating type granulator or a fluidized bed granulator, and then adding a binder compound while fluidizing the mixture, to carry out granulation.

The particle size of granulated substances is not particularly limited, but considering solubility and stability, the average particle size is 200 to 1200 μm and preferably 300 to 1000 μm in particular. When it is below this range, storage stability of peroxides may be affected badly, and when it exceeds the range, solubility may be poor and adequate effect may not be obtained. Here, the average particle size can be confirmed by a method of determining particle size distribution using a sieve described later and calculating it from the particle size distribution.

The preparation method of molded substances includes a method of mixing and kneading the component (b), the component (c), a binder compound and if necessary, a surfactant and the like with a mixer, a kneader and the like, then extruding the mixture through a multi-hole dice or a screen using an extrusion molding machine, and cutting it to prepare pellet shaped molded substances.

Further, there can be also used a method of mixing the component (b), the component (c), a binder compound and if necessary, a surfactant and the like, then compression-molding the mixture with a tablet machine or a briquetting machine, if necessary, and further pulverizing it with a pulverizer to adjust the size. Additionally, when the bleach composition or the bleaching detergent composition is a tablet type, a mixture of the component (b), the component (c), a binder compound and if necessary, a surfactant and the like is preliminarily prepared, the mixture and residual components in the bleach composition or the bleaching detergent composition are supplied to a tablet machine (mortar) according to a method of preparing multi-layered tablets, and compression-molding the mixture to prepare the bleach composition or the bleaching detergent composition.

In the present invention, when granulated substances or molded substances are prepared using the component (b) and the component (c) together, the content of the component (b) in granulated substances or molded substances is preferably 3 to 50% by mass. Further, in case of the bleach composition and the bleaching detergent composition comprising granulated substances and molded substances containing the component (b), the component (c) and a binder compound, the respective contents of the component (b)/the component (c)/a binder compound in granulated substances or molded substances are preferably 3 to 50% by mass/3 to 90% by mass/5 to 94% by mass and more preferably 5 to 30% by mass/5 to 70% by mass/10 to 90% by mass. The component (b) is preferably used in the above-mentioned range from the viewpoints of the damage and discoloration of clothes, the component (c) is preferably used in the above-mentioned range from the viewpoints of bleaching effect and the damage and discoloration of clothes, and the binder compound is preferably used in the above-mentioned range from the viewpoints of the productivity, shape retention and solubility.

Further, granulated substances or molded substances contain preferably a surfactant for quickly dissolving the component (c) and the binder compound. The content of the surfactant contained in granulated substances or molded substances is preferably 1 to 20% by mass and more preferably 1 to 10% by mass. Even if it exceeds the above-mentioned range, the solubility may not be enhanced any more and when it is below the above-mentioned range, the solubility is inadequate and the bleaching effect may be affected badly. When granulated substances contain a surfactant, adjustment may be carried out by reducing the content of a surfactant from the content of the binder compound.

Further, when a radical trap agent such as 4-methoxyphenol is contained for enhancing the effect of preventing the damage and discoloration of clothes, it may be contained in granulated substances or molded substances at 1% by mass or more and less than 10% by mass and more preferably 1 to 5% by mass. Further, when granulated substances or molded substances are prepared by an extrusion granulation method, the content in granulated substances or molded substances is preferably 3 to 50% by mass and more preferably 5 to 40% by mass when organic or inorganic salts such as sodium citrate, sodium sulfate and sodium tetraborate are contained, or when alumino silicate such as Type A zeolite is contained as a pulverization aid in order to adjust viscosity and enhance productivity. When a radical trap agent or an organic or inorganic salt is contained, adjustment may be carried out by reducing the content of a radical trap agent and an organic or inorganic salt from the content of the binder compound in the same manner as that of a surfactant.

Additionally, when a pigment and a dye are contained for imparting aesthetics, adjustment may be carried out by reducing the content of the pigment and dye from the content of the binder compound.

In case of the bleach composition and the bleaching detergent composition comprising granulated substances or molded substances containing (b)/(c-1)/a binder compound, the content of respective components in granulated substances or molded substances is preferably 3 to 50% by mass/3 to 30% by mass/20 to 94% by mass. Further, 5 to 30% by mass/5 to 20% by mass/50 to 90% by mass is more preferable. When the content of component (b) exceeds the above-mentioned range, granulation and molding may be difficult, the strength of granulated substances or molded substances may be lowered and the effect of granulation or molding may be decreased, and when it is below the above-mentioned range, the damage and discoloration of clothes caused by the component (c-1) may not be adequately suppressed. Further, even if the content of component (c-1) exceeds the above-mentioned range, the bleaching effect may not be enhanced any more, and at the same time, the suppression of the damage and discoloration of clothes may be difficult and when it is below the above-mentioned range, the adequate bleaching effect may not be obtained. On the other hand, when the content of binder compound exceeds the above-mentioned range, it may take a long time for the component (c-1) to be dissolved and adequate bleaching effect may not be obtained as well as it may not be economical because many granulated substances are required to be incorporated in the composition. Further, when it is below the above-mentioned range, granulation or molding may be difficult to carry out.

In case of the bleach composition comprising granulated substances or molded substances containing (b)/(c-2)/a binder compound, the content of granulated substances or molded substances is preferably 3 to 20% by mass/50 to 90% by mass/7 to 30% by mass. Further, 5 to 15% by mass/55 to 85% by mass/10 to 30% by mass is more preferable. Even if the content of the component (b) exceeds the above-mentioned range, the effect of suppressing the discoloration of clothes may be saturated. Further, when it is below the above-mentioned range, the effect of suppressing the discoloration of clothes may be inadequate. Further, the component (c-2) is preferably incorporated at higher concentration in comparison with the component (c-1). When the content is below the above-mentioned range, the adequate bleaching effect may not be obtained and even if it exceeds the above-mentioned range, the bleaching effect may not be enhanced.

On the other hand, when the content of binder compound exceeds the above-mentioned range, it may take a long time for the component (c-2) to be dissolved and inadequate bleaching effect may be obtained as well as it may not be economical because many granulated substances are required to be incorporated in the composition. Further, when it is below the above-mentioned range, granulation or molding may be difficult to carry out.

In the bleach composition and the bleaching detergent composition of the present invention, it is preferable from the viewpoints of bleaching power and sterilization power to use the component (c-1) and the component (c-2) in combination as the component (c). In this case, in particular, the bleaching activating catalyst of the component (c-1) is preferably a manganese complex of (tris(salicylideneiminoethyl)amine)

and the bleaching activator of the component (c-2) is preferably 4-decanoyloxybenzoic acid and sodium 4-nonanoyloxybenzenesulfonate.

In case of the bleach composition and the bleaching detergent composition comprising granulated substances or molded substances containing (b)/(c-1)/(c-2)/a binder compound, the content of the component (b) in granulated substances or molded substances is preferably 3 to 50% by mass and more preferably 5 to 30% by mass. When the content of the component (b) exceeds the above-mentioned range, granulation and molding may be difficult, the strength of granulated substances or molded substances may be lowered and the effect of granulation or molding may be decreased. Further, when it is below the above-mentioned range, the damage and discoloration of clothes by the components (c-1) and (c-2) may not be adequately suppressed. Further, the total content of the components (c-1) and (c-2) in granulated substances or molded substances is preferably 3 to 90% by mass and more preferably 5 to 70% by mass and the content ratio of the component (c-1) to the component (c-2) is preferably 1/2 to 1/7. Even if the total content of the components (c-1) and (c-2) exceeds the above-mentioned range, the bleaching effect may not be enhanced, and at the same time, the suppression of the damage and discoloration of clothes by the component (c-1) and the component (c-2) may be inadequate. When it is below the above-mentioned range, the adequate bleaching effect may not be obtained. Further, the content ratio of the component (c-1) to the component (c-2) is preferable as described above from the viewpoints of bleaching power and sterilization power. The content of the binder compound is preferably 5 to 94% by mass and more preferably 10 to 90% by mass from the viewpoints of productivity, shape retention and solubility.

The component (d) of the present invention is a surfactant. The surfactant of the component (d) is essential for the bleaching detergent composition, and the bleach composition contains preferably the component (d). The surfactant includes an anionic surfactant, nonionic surfactant, cationic surfactant and amphoteric surfactant and these can be used by suitably combining one or two or more.

Examples of the anionic surfactant include the followings:

(1) A linear or branched alkylbenzenesulfonate having an alkyl group of 8 to 18 carbon atoms (LAS or ABS).
(2) An alkanesulfonate having 10 to 20 carbons.
(3) An α-olefinsulfonate having 10 to 20 carbon atoms (AOS).
(4) An alkylsulfate or alkenylsulfate having 10 to 20 carbon atoms (AS).
(5) An alkyl (or alkenyl) ether sulfate having a linear or branched alkyl (or alkenyl) group of 10 to 20 carbon atoms to which alkylene oxide having 2 to 4 carbon atoms or ethylene oxide and propylene oxide (molar ratio EO/PO=0.1/9.9 to 9.9/0.1) are added by 0.5 to 10 moles in average (AES).
(6) An alkyl (or alkenyl) phenyl ethersulfate having a linear or branched alkyl (or alkenyl) group having 10 to 20 carbons to which alkylene oxide having 2 to 4 carbons or ethylene oxide and propylene oxide (molar ratio EO/PO=0.1/9.9 to 9.9/0.1) are added by 3 to 30 moles in average.
(7) An alkyl(alkenyl)ether carboxylate having a linear or branched alkyl(alkenyl) group having 10 to 20 carbons to which alkylene oxide having 2 to 4 carbons or ethylene oxide and propylene oxide (molar ratio EO/PO=0.1/9.9 to 9.9/0.1) are added by 0.5 to 10 moles in average.
(8) An alkyl polyvalent alcohol ether sulfate such as alkyl glyceryl ether sulfonic acid having 10 to 20 carbons.
(9) A saturated or unsaturated α-sulfofatty acid salt having 8 to 20 carbons or its methyl, ethyl or propyl ester (α-SF or MES).
(10) A long chain monoalkyl, dialkyl or sesquialkyl phosphate.
(11) A polyoxyethylenemonoalkyl, dialkyl or sesquialkyl phosphate.
(12) A higher fatty acid salt (soap) having 10 to 20 carbons.

These anionic surfactants can be used as alkali metal salts such as sodium and potassium, amine salts, ammonium salts and the like. Further, these anionic surfactants may be used in a mixture.

The preferable anionic surfactant includes an alkali metal salt (for example, sodium or potassium salt and the like) of a linear alkylbenzenesulfonate (LAS); alkali metal salts (for example, sodium or potassium salt and the like) of AOS, α-SF, AS and AES; alkali metal salt (for example, sodium or potassium salt and the like) of higher fatty acid, etc.

The nonionic surfactant is not particularly limited so far as it has been conventionally used in a detergent, and various nonionic surfactants can be used.

Examples of the nonionic surfactant include the followings:

(1) a polyoxyalkylene alkyl (or alkenyl) ether obtained by adding 3 to 30 mol in average, preferably 4 to 20 mol and more preferably 5 to 17 mol of alkylene oxide having 2 to 4 carbons to an aliphatic alcohol having 6 to 22 carbons and preferably 8 to 18 carbons. Among these, a polyoxyethylene alkyl (or alkenyl) ether, and a polyoxyethylenepolyoxypropylene alkyl (or alkenyl) ether are preferable. The aliphatic alcohol used here includes a primary alcohol and a secondary alcohol. Its alkyl group may have a branched chain. As the aliphatic alcohol, a primary alcohol is preferable;
(2) a polyoxyethylenealkyl (or alkenyl)phenyl ether;
(3) a fatty acid alkyl ester alkoxylate, for example represented by the following general formula (3) in which alkylene oxide is added between the ester bond of a long chain fatty acid alkyl ester:

$$R^9CO(OA)_nOR^{10} \quad (3)$$

(wherein $R^9CO$ represents a fatty acid residue having 6 to 22 carbon atoms and preferably 8 to 18 carbon atoms, OA represents the addition unit of alkylene oxide having 2 to 4 carbon atoms and preferably 2 to 3 carbon atoms such as ethylene oxide and propylene oxide, n represents the average addition molar number of alkylene oxide and is generally a number of 3 to 30 and preferably 5 to 20, and $R^{10}$ is a lower alkyl group, which may have a substituent having 1 to 3 carbons;
(4) a fatty acid ester of polyoxyethylene sorbitan;
(5) a fatty acid ester of polyoxyethylene sorbit;
(6) a fatty acid ester of polyoxyethylene;
(7) a caster oil hardened with polyoxyethylene;
(8) a fatty acid ester of glycerin;
(9) a fatty acid alkanoyl amide;
(10) polyoxyethylenealkylamine;
(11) alkylglycoside; and
(12) alkylamine oxide.

Among the above-mentioned nonionic surfactants, there are preferably used polyoxyethylene alkyl (or alkenyl) ether, polyoxyethylenepolyoxypropylene alkyl (or alkenyl) ether, fatty acid methyl ester ethoxylate obtained by adding ethylene oxide to fatty acid methyl ester, fatty acid methyl ester ethoxypropoxylate obtained by adding ethylene oxide and propylene oxide to fatty acid methyl ester, and the like, wherein the melting point is 40° C. or lower and HLB is 9 to 16. Further, these nonionic surfactants can be suitably used by combining one or two or more.

Further, HLB of the nonionic surfactant in the present invention is a value determined by the Griffin method (refer to "New Edition Surfactant Handbook" co-edited by Yoshida, Shindo, Ohgaki and Yamanaka, 1991, page 234, published by KOGYO-TOSHO, K.K.).

Further, a melting point in the present invention is a value measured by a coagulation point measurement method described in JIS K8001 "General Rule for Reagent Test Method".

The cationic surfactant is not particularly limited so far as it has been conventionally used in detergents and various cationic surfactants can be used. Examples of the cationic surfactant include the followings;

(1) di-long chain alkyl di-short chain alkyl type quaternary ammonium salt;
(2) mono-long chain alkyl tri-short chain alkyl type quaternary ammonium salt; and
(3) tri-long chain alkyl mono-short chain alkyl type quaternary ammonium salt;

wherein the above-mentioned long chain alkyl represents an alkyl group having 12 to 26 carbon atoms and preferably 14 to 18 carbon atoms, and the short chain alkyl represents an alkyl group having 1 to 4 carbon atoms and preferably 1 to 2 carbon atoms, a benzyl group, a hydroxyalkyl group having 2 to 4 carbon atoms and preferably 2 to 3 carbon atoms or a polyoxyalkylene group.

The amphoteric surfactant is not particularly limited so far as it has been conventionally used in detergents and various amphoteric surfactants can be used.

Further, the present invention is not limited to the above-mentioned surfactants and one or 2 or more of these surfactants can suitably be used in combination.

The content of the surfactant of the component (d) contained in the bleaching detergent composition is preferably 10 to 50% by mass, more preferably 15 to 40% by mass and further preferably 15 to 35% by mass in the bleaching detergent composition from the viewpoint of imparting adequate cleaning performance. Further, the total amount of the anionic and nonionic surfactants is preferably 50% by mass or more based on-the total amount of surfactants, more preferably 80% by mass or more and further preferably 95% by mass or more.

In the case of the bleach composition, as the component (d), a surfactant which is used for the bleaching detergent composition can be further incorporated, not only in granulated substances or molded substances, but also in the bleach composition in order to improve the solubility of a hydrophobic component (perfume and the like) and to improve permeability to clothes. The amount is preferably 0.1 to 15% by mass and more preferably 0.2 to 10% by mass.

Various additives and the like can be incorporated if necessary in the bleach composition and the bleaching detergent composition of the present invention, in addition to the above-mentioned components (a), (b), (c) and (d). Specific examples are indicated below.

(I) Detergent Builder

Further, as other components to be contained in the bleach composition and the bleaching detergent composition, organic and inorganic builders are mentioned.

(I)-1 Inorganic Builder

Examples of the inorganic builder include alkali metal carbonates such as sodium carbonate, potassium carbonate, sodium bicarbonate and sodium sesquicarbonate; alkali metal sulfites such as sodium sulfite and potassium sulfite; crystalline alkali metal silicates such as crystalline layered sodium silicate (for example, trade name: [Na-SKS-6] ($\delta$-$Na_2O.2SiO_2$) manufactured by Clariant Japan Co.); amorphous alkali metal silicates; sulfates such as sodium sulfate and potassium sulfate; alkali metal chlorides such as sodium chloride and potassium chloride; phosphates such as (orthophosphate, pyrrophosphate, tripolyphosphate, metaphosphate, hexametaphosphate and phytic acid salt; crystalline aluminosilicate, amorphous aluminosilicate (noncrystalline), a composite of sodium carbonate with noncrystalline alkali metal silicate (for example, trade name "NABION 15" manufactured by Rhodia Co.), and the like.

Among the inorganic builders, sodium carbonate, potassium carbonate, sodium silicate, sodium tripolyphosphate and aluminosilicate are preferable.

As the aluminosilicate, either of crystalline aluminosilicate and noncrystalline (amorphous) aluminosilicate can be used, but crystalline aluminosilicate is preferable from the viewpoint of cation exchange ability. As the crystalline aluminosilicate, type A, type X, type Y, type P zeolites and the like can be preferably incorporated and the primary average particle size is preferably 0.1 to 10 μm. The content of crystalline aluminosilicate is preferably 1 to 40% by mass and preferably 2 to 30% by mass in particular from the viewpoint of cleaning power and powder physical properties such as flowability.

When a crystalline alkali metal silicate is incorporated in the bleaching detergent composition, the content is preferably 0.5 to 40% by mass, more preferably 1 to 25% by mass, further preferably 3 to 20% by mass and particularly preferably 5 to 15% by mass from the viewpoint of cleaning power.

(I)-2 Organic Builder

Examples of the organic builder include amino carboxylic acid salts such as nitrilo triacetate, ethylenediaminetetraacetate, β-alanine diacetate, aspartic acid diacetate, methylglycin diacetate and imino disuccinate; hydroxyaminocarboxylic acid salts such as serine diacetate, hydroxyiminodisuccinate, hydroxyethylethylenediaminetriacetate and dihydroxyethyl glycine salt; hydroxycarboxylic acid salts such as hydroxyacetate, tartrate, citrate and gluconate; cyclocarboxylic acid salts such as pyromellitate, benzopolycarboxylate and cyclopentane tetracarboxylate; ether carboxylic acid salts such as carboxymethyl tartronate, carboxymethyloxy succinate, oxy disuccinate and tartaric acid mono or disuccinate; acrylic acid polymers and copolymers such as a polyacrylate, polyacrylic acid, acrylic acid-allyl alcohol copolymer, acrylic acid-maleic acid copolymer, a salt of polyacetal carboxylic acid such as polyglyoxylic acid, hydroxyacrylic acid polymer and polysaccharide-acrylic acid copolymer; polymers or copolymers of maleic acid, itaconic acid, fumaric acid, tetramethylene 1,2-dicarboxylic acid, succinic acid, aspartic acid and the like; polysaccharide oxides such as starch, cellulose, amylose and pectin, and polysaccharides derivatives such as carboxymethyl cellulose.

Among these organic builders, citrate, aminocarboxylate, hydroxyamino carboxylate, a polyacrylate, a acrylic acid-maleic acid copolymer and polyacetal carboxylate are preferable and in particular, hydroxyimino disuccinate, a salt of acrylic acid-maleic acid copolymer having a molecular weight of 1000 to 80000, polyacrylate, a salt of polyacetal carboxylic acid such as polyglyoxylic acid having a molecular weight of 800 to 1000000 and preferably 5000 to 200000 which is described in Japanese Unexamined Patent Publication No. Sho 54-52196 are preferable. The content of the organic builder is preferably 0.5 to 20% by mass in the bleaching detergent composition, more preferably 1 to 10% by mass and further preferably 2 to 5% by mass.

One or 2 or more kinds of the detergent builders can be suitably used in combination. It is preferable to use organic builders such as citrate, amino carboxylate, hydroxyaminocarboxylate, a polyacrylate, an acrylic acid-maleic acid copolymer and polyacetal carboxylate in combination with inorganic builders such as zeolite in order to improve cleaning power and stain dispersibility in cleaning solution. The content of the detergent builder is preferably 10 to 80% by mass in the bleaching detergent composition and more preferably 20 to 75% by mass in order to provide adequate cleaning property.

(II) pH Adjuster

The pH of the bleach composition and the bleaching detergent composition of the present invention is not particularly limited, but is preferably adjusted so that pH in aqueous solution of 1% by mass is 8 or more, in order to enhance the effect of suppressing the damage and discoloration of clothes by water-insoluble or poorly water-soluble textile powder together with high bleaching power, and pH in aqueous solution of 1% by mass is more preferably 9 to 11. When it is less than the range, bleaching effect may not be sufficiently provided.

As technique for controlling pH, pH adjustment is usually carried out by an alkali agent, and alkanolamines such as monoethanolamine, diethanolamine and triethanolamine, sodium hydroxide, potassium hydroxide and the like can be mentioned in addition to the alkali agents described in the aforementioned detergent builder. One or 2 or more of these can be suitably used in combination. It is preferable to use NABION 15 (manufactured by Rhodia Co.), which is a mixture of sodium carbonate, sodium silicate and water at a ratio of 55/29/16 from the viewpoint of solubility to water and the degree of alkali.

Further, pH can also be adjusted within the above-mentioned pH range using acid and the like in order to prevent pH from becoming too high. As the acid, a metal ion sequestering agent described later can also be used. Additionally, alkali metal dihydrogen phosphates such as potassium dihydrogen phosphate, lactic acid, succinic acid, malic acid gluconic acid or polycarboxylic acid thereof, citric acid, sulfuric acid, hydrochloric acid and the like can be used.

Further, a buffer for preventing the lowering of pH caused by an acid component derived from stain of clothes during cleaning can also be used.

Further, a metal ion sequestering agent, a boron compound and a phenol-base radical trapping agent can also be contained in the bleach composition and the bleaching detergent composition of the present invention, if necessary, in order to enhance the bleaching effect and the effect of suppressing the damage and discoloration of clothes.

(III) Metal Ion Sequestering Agent

The metal ion sequestering agent traps a trace of metal ions and exhibits effect of enhancing the stability of hydrogen peroxide during storage and the stability of hydrogen peroxide in a solution in the bleaching process.

The metal ion sequestering agent includes amino polyacetic acids such as ethylenediaminetetraacetic acid, nitrilotriacetic acid and glycolethylenediaminehexaacetic acid; organic phosphonic acid derivatives such as 1-hydroxyethane-1,1-diphosphonic acid (HEDP-H), ethane-1,1-diphosphonic acid, ethane-1,1,2-triphosphonic acid, hydroxyethane-1,1,2-triphosphonic acid, ethane-1,2-dicarboxy-1,2-diphosphonic acid, hydroxymethanephosphonic acid, ethylenediaminetetra(methylenephosphonic acid), nitrilotri(methylenephosphonic acid), 2-hydroxyethyliminodi(methylenephosphonic acid), hexamethylenediaminetetra(methylenephosphonic acid) and diethylenetriaminepenta(methylenephosphonic acid) and a salt thereof; organic acids such as diglycolic acid, citric acid, tartaric acid, oxalic acid and gluconic acid and a salt thereof in addition to those included in the detergent builder. Among these, disodium 1-hydroxyethane-1,1-diphosphonate (HEDP-2Na), trisodium 1-hydroxyethane-1,1-diphosphonate (HEDP-3Na), tetrasodium 1-hydroxyethane-1,1-diphosphonate (HEDP-4Na) and sodium ethylenediaminetetra(methylenephosphonate) are preferable, and tetrasodium 1-hydroxyethane-1,1-diphosphonate (HEDP-4Na) and sodium citrate are more preferable considering the influence on bleaching power and storage stability in the bleach composition and the bleaching detergent composition. These metal ion sequestering agents may be incorporated to be used as granulated substances by mixing a surfactant, polyethylene glycol 1000 to 20000 (average molecular weight is 500 to 19000 which is described in Cosmetics Ingredients Standard (Second Edition: annotation)), polyacrylic acid with a weight average molecular weight of 1000 to 1000000 and its salt, the component (b), the component (c), a film forming polymer and the like in order to suppress deliquescence and the like.

The preferable content of the metal ion sequestering agent in the present invention is preferably 0.1 to 5% by mass in the bleach composition and more preferably 0.3 to 3% by mass. When it is less than 0.1% by mass, the stabilization effect of peroxides may not be sufficient, and even if it exceeds 5% by mass, the stabilization effect may not be enhanced. The preferable content in the bleaching detergent composition is preferably 0.1 to 5% by mass and more preferably 0.5 to 3% by mass. When it is less than 0.1% by mass, the bleaching power and cleaning power may not be sufficient, and even if it is added by exceeding 5% by mass, the effect may not be enhanced any further. One or 2 or more kinds of these metal ion sequestering agents can be suitably used in combination.

(IV) Boron Compound

The bleach composition and the bleaching detergent composition of the present invention enhances the bleaching effect higher by further adding a boron compound and the boron compound acts on hydrogen peroxide and a free metal to further enhance the stability of hydrogen peroxide in a solution in the breaching process. Here, as the boron compound, compounds containing boron in a molecule such as boric acid, sodium borate, potassium borate, ammonium borate, sodium tetraborate, potassium tetraborate and ammonium tetraborate can be used, and among these, sodium tetraborate is preferable in particular and may be contained as a hydrate.

When the boron compound is incorporated in the present invention, the content is preferably 20% by mass or less and more preferably 5% by mass or less in the bleach composition and when it is incorporated in the bleaching detergent composition, it is preferably 15% by mass or less and more preferably 3% by mass or less. Even if it exceeds the above-mentioned range, the improvement of bleaching effect and the stabilization effect of hydrogen peroxide may not be sufficiently obtained. One or 2 or more kinds of these boron compounds can be suitably used in combination.

(V) Phenol-base Radical Trapping Agent

In the present invention, when a phenol-base radical trapping agent is further contained and used in combination with the above-mentioned water-insoluble or poorly water-soluble textile powder of the component (b), it exhibits higher effect for suppressing the damage and discoloration of clothes and coloration of clothes by the oxides of a phenol-base compound does not occur; therefore it is more preferable. Examples of the phenol-base radical trapping agent include a compound having a phenolic hydroxy group or an ester derivative of a phenolic hydroxy group, an ether derivative and the like. The specific examples of such compounds include cresol, thymol, chlorophenol, bromophenol, methoxyphenol, nitrophenol, hydroxybenzoic acid, salicylic acid, hydroxybenzenesulfonic acid, 2,6-di-tert-butyl-p-cresol, naphthol, pyrogallol, phenoxyethanol and the like.

Among these, more preferable compound is a compound with an oxidation reduction potential $(O.P.)_0$(25° C.) of 1.25 V or less which is described in G. E. Penketh, J. Appl. Chem. Vol. 17, pp 512 to 521 (1957), and more preferably a compound with that of 0.75 V or less. Further, the lower limit of the oxidation reduction potential $(O.P.)_0$(25° C.) is not particularly limited, but the lower limit of the oxidation reduction potential $(O.P.)_0$(25° C.) is preferably 0.60 V considering the influence on the bleaching effect. When the oxidation reduction potential exceeds the above-mentioned range, the stabilization effect of hydrogen peroxide may not be sufficient. When it is too low, the bleaching power may be lowered.

Further, the radical trapping agent which rapidly dissolves even by a small mechanical force in a soak bleaching process is effective and those in which a log P value which is a hydrophobic parameter indicating the solubility is 3 or less are preferable in particular. The hydrophobic parameter mentioned here is generally used for a parameter indicating the property of an objective compound. P (distribution coefficient) in the log P value is represented by P=Co/Cw as a ratio of the activity of a substance in equilibrium state between water and octanol (wherein Co is the concentration of octanol and Cw is concentration in water).

The details of the hydrophobic parameter are described in, for example, "Region of Science" (special edition) Vol. 122 (1979) p 73. As the measurement method of the distribution coefficient, Flask Shaking method, Thin Layer Chromatography and a measurement method by HPLC are known, but it can also be calculated by calculation using the parameter of Ghose, Pritcheft and Crippen et al. (J. Comp. Chem. Vol. 9, 80 (1998)).

Among the above-mentioned compounds, 4-methoxyphenol and 4-hydroxybenzoic acid are preferable in particular considering the oxidation reduction potential and solubility and the stability of the radical trapping agent when coexisted with a peroxide. One or 2 or more kinds of these phenol-base radical trapping agents can be suitably used in combination.

In the bleach composition and the bleaching detergent composition of the present invention, any amount of the above-mentioned phenol-base radical trapping agent can be added, but in the case of the bleach composition, a preferable content is in the range of 0.001 to 1% by mass and more preferably 0.01 to 1% by mass. In the case of the bleaching detergent composition, a preferable content is 0.001 to 1% by mass and more preferably 0.001 to 0.5% by mass. When it is less than the above-mentioned range, the concomitant effect with the component (b) may not be sufficiently obtained, and even if it exceeds the above-mentioned range, the effect of the damage and discoloration of clothes may not be enhanced. Further, the coloration of clothes by oxidation of the phenol-base radical trapping agent may occur. Further, it is preferably less than the same % by mass as the component (b). When it is the same % by mass as the component (b) or more, coloration of clothes may occur. Further, since the phenol-base radical trapping agent is preferable because it can more effectively suppress the damage and discoloration of clothes by coexisting in the particles with the above-mentioned components (b) and (c). In that case, it is also preferable that the content of the phenol-base radical agent is the same amount of % by mass as the component (b) for the same reason.

The bleach composition and the bleaching detergent composition of the present invention can further contain the following auxiliary components within a range not inhibiting the effect of the present invention in addition to the above-mentioned components, if necessary.

(1) Perfume

As the perfume, components described in Japanese Unexamined Patent Publication No. 2002-146399 and Japanese Unexamined Patent Publication No. 2003-89800 can be used.

Further, a perfume composition is a mixture comprising perfume ingredients, a solvent, a perfume stabilizer and the like. When the above-mentioned perfume composition is incorporated in the bleach composition and the bleaching detergent composition of the present invention, the content of the perfume composition in the bleach composition and the bleaching detergent composition is preferably 0.001 to 20% by mass and more preferably 0.01 to 10% by mass.

When the above-mentioned perfume components are incorporated in the bleach composition and the bleaching detergent composition of the present invention, it is preferable to add the perfume components by spraying or dropping on particles containing a surfactant in a mixing machine at the time of preparation thereof or the finally obtained bleach composition and bleaching detergent composition and it is more preferable to add them by spraying.

When the above-mentioned perfume components are incorporated in the bleach composition and the bleaching detergent composition of the present invention, these perfume components can be used by being impregnated in the above-mentioned component (b). Since the deterioration of perfumes by a peroxide is suppressed by impregnation and the perfumes impregnated are gradually released, constant aroma can be kept after storage for a long term.

(2) Dye

Various dyes can be used for improving the appearance of the compositions. As the dyes used for the bleach composition and the bleaching detergent composition, dyestuffs and pigments can be mentioned and among these, pigments are preferable from the viewpoint of storage stability. Pigments having anti-oxidation property such as oxides are preferable in particular. The preferable compounds include titanium oxide, iron oxide, copper phthalocyanine, cobalt phthalocyanine, ultramarine blue pigment, iron blue pigment, cyanine blue, cyanine green and the like. Further, these dyes are preferably granulated together with a complex, and in this case, those obtained by dissolving or dispersing dyes in a binder compound such as polyethylene glycol (PEG) and the like are preferably used. Further, as a blue imparting agent, the aqueous solution or aqueous dispersion solution of a blue pigment such as ultramarine blue pigment and a green pigment such as copper phthalocyanine can be sprayed on sodium sulfate, sodium carbonate and the like and then granulated, and can also be used by being sprayed on particles containing a surfactant, the bleach composition and the bleaching detergent composition of the present invention.

Further, an aqueous dispersion of a pigment obtained by adding 0.1 to 5% by mass of a dye based on a resin portion of spherical resin particles obtained by radical emulsion polymerization in aqueous dispersion system, to a polymerization resin suspension and carrying out treatment by heating can also be preferably used as an appearance imparting agent in the same manner as the above-mentioned blue imparting agent.

When the above-mentioned dye component is incorporated in the bleach composition and the bleaching detergent composition of the present invention, an aqueous solution or aqueous dispersion solution of the dye component is preferably used by being sprayed or added dropwise on particles containing a surfactant, the bleach composition and the bleaching detergent composition of the present invention finally obtained, and it is more preferable to be used by spraying.

Alternatively, while transferring particles containing a surfactant, or the bleach composition and the bleaching detergent composition finally obtained, on a belt conveyer, the aqueous solution or aqueous dispersion solution of the dye component is preferably sprayed or added dropwise on their surfaces, and more preferably used by spraying.

(3) Fluorescent Brightening Agent

Examples of fluorescent dyes to be used in the bleach composition and the bleaching detergent composition of the present invention include 4,4'-bis-(2-sulfostyryl)-biphenyl salt, 4,4'-bis-(4-chloro-3-sulfostyryl)-biphenyl salt, 2-(styrylphenyl)naphthothiazole derivative, 4,4'-bis-(triazol-2-yl)stilbene derivative, bis-(triazinylaminostilbene)disufonic acid derivative, and the like.

As trade names, WHITEX SA, WHITEX SKC (manufactured by Sumitomo Chemical Co., Ltd.), CINOPEARL AMS-GX, CINOPEARL DBS-X, CINOPEARL CBS-X (manufactured by Ciba Specialty Chemicals), Lemonite CBUS-3B (Khyati Chemicals Co.) and the like can be mentioned. Among these, CINOPEARL CBS-X and CINOPEARL AMS-GX are more preferable and the content is preferably 0.001 to 1% by mass. These may be used alone or 2 or more may be used in combination.

(4) Enzyme

While enzymes are classified by the reactivity of enzyme, enzyme (enzyme which inherently carries out enzyme action during a cleaning step) into hydrolases, oxidoreductases, lyases, transferases and isomerases and any of them can be applied for the present invention. In particular, protease, esterase, lipase, nuclease, cellulase, amylase, pectinase and the like are preferable. Specific examples of protease include pepsin, trypsin, chymotrypsin, collagenase, keratinase, elastase, subtilisin, BPN, papain, bromelain, carboxypeptitase A and B, aminopeptitase, asparagilopeptidase A and B, and the like. As commercially available products, Savinase, Alkalase, Everlase, Kannase (manufactured by Novozymes A/S), API 21 (manufactured by Showa Denko K.K.), Maxacal, Maxapem (manufactured by Genencor International), protease K-14 or K-16 described in Japanese Unexamined Patent Publication No. Hei 5-25492 and the like can be mentioned. Specific examples of esterase include gastric lipase, pancreatic lipase, plant lipases, phospholipases, cholinesterases, phosphatases and the like. Specific examples of lipase include commercially available lipase such as Lipolase, Lipex (manufactured by Novozymes A/S), Liposam (manufactured by Showa Denko K.K.), and the like. Further, cellulase includes commercially available Cellzyme (manufactured by Novozymes A/S) and cellulase described in claim 4 of Japanese Unexamined Patent Publication No. Sho 63-264699. Examples of amylase include commercially available Termamil, Duramyl (manufactured by Novozymes A/S) and the like. One or 2 or more kinds of enzymes can be used in combination. Further, it is preferable to use enzyme which has been separately granulated as stable particles, in state in which it is dry-blended in detergent dough (particles).

(5) Enzyme Stabilizer

The bleach composition and the bleaching detergent composition of the present invention can incorporate a calcium salt, a magnesium salt, polyol, formic acid, a boron compound and the like as enzyme stabilizers. Among these, sodium tetraborate, calcium chloride and the like are more preferable and the content is preferably 0.05 to 2% by mass in the compositions. These can be used alone or 2 or more kinds can be suitably used in combination.

(6) Other Polymers

As a binder and a powder physicality agent for high densification0, polyethylene glycol with an average molecular weight of 200 to 200000, an acrylic acid and/or maleic acid polymer with a weight average molecular weight of 1000 to 100000, polyvinyl alcohol, cellulose derivative such as carboxymethyl cellulose and the like can be incorporated in order to further impart the effect of preventing re-staining for hydrophobic fine particles. Further, as a stain discharging agent, a copolymer or terpolymer of terephthalic acid with ethylene glycol unit and/or propylene glycol unit can be incorporated. Polyvinylpyrrolidone and the like can be incorporated in order to impart the effect of preventing color transfer. Among these, polyethylene glycol with an average molecular weight of 1500 to 7000 is preferable and the content is preferably 0.05 to 5% by mass. These can be used alone or 2 or more kinds can be suitably used in combination.

(7) Caking Preventive

As the caking preventive, para-toluenesulfonate, xylenesulfonate, acetate, sulfosuccinate, talc, fine powder silica, clay, magnesium oxide or the like can be incorporated.

(8) Antifoaming Agent

As the antifoaming agent, conventionally known antifoaming agents, for example, those of silicone/silica-base can be used. An antifoaming agent granulated substances which was produced according to a method described in the left lower column of page 4 of Japanese Unexamined Patent Publication No. Hei 3-186307 to be explained below, may be used.

Firstly, 20 g of Silicone (PS antifoam Compound type) manufactured by Dow Corning Co. was added to 100 g of MALTDEXTRIN (dextrin modified with enzyme) manufactured by NIPPON STARCH CHEMICAL CO., LTD. as an antifoaming component and mixed to obtain a homogeneous mixture. Then, after 50% by mass of the resultant homogeneous mixture, 25% by mass of polyethylene glycol (PEG-6000, melting point: 58° C.) and 25% by mass of neutral anhydrous mirabilite are mixed at 70 to 80° C., and then the mixture is granulated with an extrusion granulator (EXKS-1 type) manufactured by Fuji Paudal Co, Ltd. to obtain granulated substances.

(9) Reducing Agent

Sodium sulfite, potassium sulfite and others.

In the bleach composition and the bleaching detergent composition of the present invention, components which are generally blended in a detergent for clothing materials and a bleach can be incorporated, if necessary, within a range not inhibiting the effect of the present invention.

Further, the composition of the present invention may contain compounds prepared by oxidation reaction of the phenol-base radical trapping agent in the amount of 0.0001 to 1% by mass. Examples of these compounds include formic acid, acetic acid, glycolic acid, propionic acid, malonic acid, malic acid, oxalic acid and the like.

The method of using the bleach composition and the bleaching detergent composition of the present invention is not particularly limited. In the case of the bleach composition, it is preferable to use it by charging together with a detergent into a washing machine to make a solution of 0.02 to 0.5% by mass and to wash articles to be washed, or immersing them in a solution of 0.02 to 2% by mass, or the like. In particular, it can be used for immersion washing in an immersion time period of about 15 minutes to 12 hours and preferably about 15 to 60 minutes. In the case of the bleaching detergent composition, it is preferable to use it by charging in a washing machine to make a solution of 0.02 to 0.2% by mass and to wash articles to be washed, or by immersing them in a solution of 0.02 to 2% by mass, or the like. In particular, it can be suitably used by charging it in a washing machine for washing for 5 to 20 minutes.

The form of the bleach composition and the bleaching detergent composition of the present invention is a solid such as powder, granules, tablets, briquettes, sheets or bars and more preferably powder. The preparation method of the bleach composition and the bleaching detergent composition of the present invention is not particularly limited, and for example, as described above, they can be prepared by suitably granulating if necessary the above-mentioned components, and according to conventional methods for respective forms other than molding. Containers considering the usability, stability and the like depending on the respective forms are used for commercialization but in particular, containers which impart little influence on the decomposition of a peroxide by moisture and light are preferably selected.

The bleach composition and the bleaching detergent composition of the present invention is not particularly limited in terms of articles to be washed and the use method, and for example, smear, organic stain, yellowing substances, stain, fungi and the like can be bleached by using the bleach composition and the bleaching detergent composition of the present invention to textile products such as clothes, fabrics, sheets and curtains; paper products such as timber pulp; hard surfaces of table wares and glasses, washing machine tubs, etc. in the same manner as ordinary bleach compositions and bleaching detergent compositions.

The component (d) and the component (c) may be incorporated in the same granulated substance or each may be incorporated in separate granulated substances. In particular, in the bleaching detergent composition of the present invention, the surfactant is preferably prepared as particles separate from the component (a) and the component (c) as particles containing a surfactant from the viewpoint of stability, and in particular, it is more preferably prepared as particles separate from the components (a), (b) and (c) except for the surfactant to be used as the substrate for granulation of the components (a) and (b).

The production method of particles containing a surfactant used for the bleach composition of the present invention can be roughly divided into two types, namely, particles containing a surfactant in which an anionic surfactant is the primary surfactant and particles containing a surfactant in which a nonionic surfactant is the primary surfactant.

The production method of particles containing a surfactant used for the bleaching detergent composition of the present invention can be roughly divided into two types, namely, particles containing a surfactant in which an anionic surfactant is the primary surfactant and particles containing a surfactant in which a nonionic surfactant is the primary surfactant.

Particles containing a surfactant in which an anionic surfactant is the primary surfactant The particles containing a surfactant in which an anionic surfactant is the primary surfactant in the present invention mean particles in which an anionic surfactant is an essential component and the content of the anionic surfactant is the highest among surfactants incorporated in particles. Accordingly, other surfactants such as a nonionic surfactant and a cationic surfactant and an amphoteric surfactant other than the anionic surfactant can be suitably incorporated although the content is restricted.

The anionic surfactant, which is used in particles containing a surfactant in which an anionic surfactant, is the primary surfactant is not particularly limited so far as it has been conventionally used as a detergent as mentioned in the aforementioned component (d), and various anionic surfactants can be used.

In the particles containing a surfactant in which an anionic surfactant is the primary surfactant, an anionic surfactant is the primary surfactant as the surfactant and one or 2 or more kinds of anionic surfactants can be usually used in combination.

The content of all the surfactants in the particles containing a surfactant in which an anionic surfactant is the primary surfactant is preferably 10 to 90% by mass in the particles containing a surfactant, more preferably 15 to 70% by mass and further preferably 15 to 50% by mass from the viewpoint of imparting adequate cleaning performance. Further, the mass ratio of the anionic surfactant/other surfactants is 100/0 to 50/50, preferably 100/0 to 55/45 and more preferably 95/5 to 70/30.

The aforementioned various additives and auxiliary components can be used for the particles containing a surfactant in which an anionic surfactant is the primary surfactant, without being particularly limited.

Among these, examples of the inorganic builder include potassium salts such as potassium carbonate and potassium sulfate, alkali metal chlorides such as potassium chloride and sodium chloride as those having an effect of improving solubility. Among these, the alkali metal salts such as potassium carbonate, potassium chloride and sodium chloride are preferable from the viewpoint of the balance of the effect of improving solubility and cost.

When potassium carbonate is incorporated, the content is preferably 1 to 15% by mass in the particles containing a surfactant, more preferably 2 to 12% by mass and further preferably 5 to 10% by mass from the viewpoint of the effect of improving solubility.

When an alkali metal chloride is incorporated, the content is preferably 1 to 10% by mass in the particles containing a surfactant, more preferably 2 to 8% by mass and further preferably 3 to 7% by mass from the viewpoint of the effect of improving solubility.

The physical property value of the particles containing a surfactant in which an anionic surfactant is the primary surfactant is not particularly limited, but bulk density is usually 0.3 g/mL or more, preferably 0.5 to 1.2 g/mL and more preferably 0.6 to 1.1 g/mL. Further, the mean particle size is preferably 200 to 1500 μm and more preferably 300 to 1000 μm. When the mean particle size is less than 200 μm, dust may be easily generated and on the other hand, when it exceeds 1500 μm, solubility may not be sufficient. Further, the flowability of the particles containing a surfactant is 60° or less as the angle of repose and in particular, preferably 50° or less. When the angle of repose exceeds 60°, the processability of particles is occasionally deteriorated. Further, the angle of repose can be measured by the angle of repose measurement method by so-called discharging method by which an angle, which is formed against the horizontal plane of a sliding plane formed when particles filled in a container flow out, is measured.

The particles containing a surfactant, in which an anionic surfactant is the primary surfactant, can be obtained roughly by two types of methods below.

(1) A method of granulating a neutral salt type anionic surfactant.

(2) A method of dry-neutralizing the acid precursor of an anionic surfactant and granulating it.

(1) In the method of granulating a neutral salt type anionic surfactant, the particles can be obtained by granulation methods below.

The granulation method includes (1-1) an extrusion granulation method of mixing and kneading the raw material powder of detergent components and binder compounds (a surfactant, water, a liquid polymer component and the like) and then granulating the mixture by extrusion; (1-2) a mixing and crushing granulation method below of mixing and kneading the detergent materials and then granulating by crushing the solid detergent obtained; (1-3) a stirring granulation method of adding binder compounds to raw material powder and granulating it by stirring with a stirring blade; (1-4) a rolling granulation method of granulating by spraying binder compounds while rolling raw material powder; (1-5) a fluidized layer granulation method of granulating by spraying a liquid binder while rolling raw material powder, and the like.

(2) The method of dry-neutralizing the acid precursor of an anionic surfactant and granulating it requires neutralization and granulation while bringing the acid precursor of an anionic surfactant in contact with alkaline inorganic powder to be mixed, but basically, the granulation methods used in (1) the method of granulating a neutral salt type anionic surfactant are preferably utilized similarly. Specific methods, devices, conditions and the like are as mentioned above.

As the acid precursor of the preferable anionic surfactant, any of the acid precursors can be preferably utilized so far as it is the aforementioned acid precursor of an anionic surfactant which can be preferably utilized. Further, the alkaline powder as a neutralizing agent is not particularly limited, but includes an alkali metal carbonate, an alkali metal silicate, an alkali metal phosphate and the like. The alkali metal carbonate includes sodium carbonate, potassium carbonate, sodium hydrogencarbonate, potassium hydrogencarbonate, sodium potassium carbonate and the like; the alkali metal silicate includes sodium silicate, layered sodium silicate and the like; the alkali metal phosphate includes sodium tripolyphosphate, sodium pyrophosphate and the like. Among these, the alkali metal carbonate is preferable and among these, sodium carbonate, potassium carbonate and sodium potassium carbonate are preferable in particular. One or two or more kinds of these can be used.

The particles containing a surfactant in which an anionic surfactant is a primary surfactant, which were granulated by the above-mentioned method are sieved, as needed, and the particles containing a surfactant only having a desired particle size can also be utilized as a product.

Particles containing a surfactant in which a nonionic surfactant is a primary surfactant The particles containing a surfactant in which a nonionic surfactant is a primary surfactant in the present-invention mean particles in which a nonionic surfactant is an essential component and the content of the nonionic surfactant is the highest among surfactants incorporated in particles. Accordingly, other surfactants such as an anionic surfactant, a cationic surfactant and an amphoteric surfactant other than the nonionic surfactant can be preferably incorporated although the content thereof is restricted.

The nonionic surfactant is not particularly limited so far as it has been conventionally used as a detergent, and various nonionic surfactants can be used. As the nonionic surfactant, those mentioned in the aforementioned component (d) can be utilized.

As the nonionic surfactant in the particles containing a surfactant in which a nonionic surfactant is a primary surfactant, there are preferably a polyoxyethylene alkyl (or alkenyl) ether having a melting point of 40° C. or less and a HLB of 9 to 16, a polyoxyethylenepolyoxypropylene alkyl (or alkenyl) ether, fatty acid methyl ester ethoxylate obtained by adding ethylene oxide with fatty acid methyl ester, and fatty acid methyl ester ethoxypropoxylate obtained by adding ethylene oxide and propylene oxide with fatty acid methyl ester. Additionally, with respect to other surfactants such as an anionic surfactant, a cationic surfactant and an amphoteric surfactant, surfactants similar to those mentioned in the aforementioned component (d) can be preferably utilized. Further, one or two or more of the above-mentioned surfactants can be appropriately used in combination. The nonionic surfactant is used as a primary surfactant, and usually used in combination of one or two or more kinds thereof.

The content of the whole surfactants in the particles containing a surfactant in which a nonionic surfactant is a primary surfactant is preferably 5 to 85% by mass in the particles containing a surfactant and more preferably 10 to 60% by mass from the viewpoint of imparting sufficient cleaning performance. Further, the mass ratio of the nonionic surfactant/other surfactants is 100/0 to 50/50, preferably 100/0 to 60/40 and more preferably 95/5 to 70/30.

As other components contained in the particles containing a surfactant in which a nonionic surfactant is a primary surfactant, an inorganic or organic detergent builder is mentioned. As the detergent builder, those which can be incorporated in the aforementioned particles containing a surfactant in which an anionic surfactant is a primary surfactant can be similarly utilized. The preferable detergent builder and the content of the detergent builder are similar to those described above.

Further, an oil absorbing carrier for carrying the nonionic surfactant, clay minerals as a granulating auxiliary agent and the like are preferably incorporated in the particles containing a surfactant in which a nonionic surfactant is a primary surfactant.

As the oil absorbing carrier, a substance in which the amount of oil absorption represented by the JIS-K5101 test method has an oil absorption property of preferably 80 mL/100 g or more, more preferably 150 to 600 mL/100 g is preferably used. The oil absorbing carrier includes components described, for example, in Japanese Unexamined Patent Publication No. Hei 5-125400 and Japanese Unexamined Patent Publication No. Hei 5-209200. One or two or more kinds of these oil absorbing carriers can be appropriately used in combination. The oil absorbing carrier is contained by preferably 0.1 to 25% by mass, more preferably 0.5 to 20% by mass and further more preferably 1 to 15% by mass in the particles containing a surfactant in which a nonionic surfactant is a primary surfactant.

As the clay mineral, in particular, those, which belong to a smectite group and in which its crystal structure is a dioctahedral three-layered structure or a trioctahedral three-layered structure are preferable.

The clay mineral which can be used as the detergent component of the present invention is those in which the amount of oil absorption is preferably less than 80 mL/100 g, more preferably 30 to 70 mL/100 g and bulk density is preferably 0.1 g/mL or more and further preferably 0.2 to 1.5 g/mL.

The specific example of such clay mineral includes a component described in Japanese Unexamined Patent Publication No. Hei 9-87691.

The clay mineral is contained by preferably 0.1 to 30% by mass, more preferably 0.5 to 20% by mass and further preferably 1 to 10% by mass in the particles containing a surfactant in which a nonionic surfactant is a primary surfactant.

In the particles containing a surfactant in which a nonionic surfactant is a primary surfactant, which are used in the present invention, the aforementioned various additives and those which can be preferably incorporated as auxiliary components in the particles containing a surfactant in which an anionic surfactant is a primary surfactant can be used similarly.

The physical property value of the particles containing a surfactant in which a nonionic surfactant is a primary surfactant is not particularly limited, but bulk density is usually 0.3 g/mL or more, preferably 0.5 to 1.2 g/mL and more preferably 0.6 to 1.1 g/mL. Further, the mean particle size is preferably 200 to 1500 μm, more preferably 300 to 1000 μm. When the mean particle size is less than 200 μm, powder dust may be generated easily, and on the other hand, when it exceeds 1500 μm, solubility may not be sufficient. Further, it is preferable that the flowability of the particles containing a surfactant is 60° or less, in particular 50° or less, as the angle of repose. When the angle of repose exceeds 60°, the processability of particles may be deteriorated.

The particles containing a surfactant in which a nonionic surfactant is a primary surfactant can also be obtained by the above-mentioned granulation method in the same manner as the particles containing a surfactant in which an anionic surfactant is a primary surfactant.

Thus, when the particles containing a surfactant are used, the bleach composition and the bleaching detergent composition of the present invention can be prepared by mixing the particles containing a surfactant in which an anionic surfactant is a primary surfactant and/or the particles containing a surfactant in which a nonionic surfactant is a primary surfactant, with components other than those.

The physical property value of the bleach composition and the bleaching detergent composition which were finally obtained is not particularly limited, but bulk density is usually 0.3 g/mL or more, preferably 0.4 to 1.2 g/mL, more preferably 0.5 to 1.0 g/mL. Further, the mean particle size is preferably 200 to 1500 μm, more preferably 300 to 1000 μm. When the mean particle size is less than 200 μm, powder dust may be generated easily. On the other hand, when it exceeds 1500 μm, solubility may be insufficient. Further, it is preferable that the flowability of the particles containing a surfactant is 60° or less, in particular 50° or less, as the angle of repose. When the angle of repose exceeds 60°, the processability of particles may be deteriorated.

According to the present invention, the oxygen-base bleach composition or the bleaching detergent composition which can suppress the damage and discoloration of clothes and the like more efficiently even under the severe condition of high concentration at an erroneous use and has high bleaching power without causing coloration is obtained, and further, the bleaching detergent composition has also excellent cleaning power.

The present invention is specifically illustrated below according to Examples and Comparative Examples, but the present invention is not limited by these examples at all. Further, in the following examples, unless otherwise specifically described, "%" indicates % by mass in a composition, the amounts of respective components in Tables indicate compounding amounts as a pure content with respect to the composition of detergent particles group of Tables 12 and 13 and compounding amounts as actual condition are indicated for other Tables.

<Bleach Composition>

EXAMPLES 1 TO 35 AND COMPARATIVE EXAMPLES 1 TO 11

The powder bleach compositions of Examples 1 to 35 and Comparative Examples 1 to 11 were prepared in accordance with the compositions shown in Tables 1 to 3 according to the usual method of a powder bleach composition. Bleaching power, the damage of clothes, coloration and the discoloration of clothes were evaluated by methods described below. The result is concomitantly described in Tables 1 to 3. Further, the mean particle size of the powder bleach composition obtained was 300 to 800 μm, and bulk density thereof was 0.7 to 1.0 g/mL.

Evaluation Method (I) Preparation of Cloth Stained with Curry

5 Packs of retort curry (BONCURRY GOLD Medium-Spicy (manufactured by OTSUKAFOODS Co. LTD.), quantity of contents: 200 g/1 pack) which were warmed on hot water for 5 minutes were filtered using a gauze to remove solid substances, and 5 sheets of plain cotton clothes (#100) with a size of 25×30 cm were immersed in the solution and the solution was uniformly adhered to the cloth while warming for 30 minutes. The cloths were taken out, rinsed with tap water until rinsed solution was not colored, dehydrated and dried naturally and test pieces with 5×5 were prepared to be provided for experiments.

(II) Bleaching Power

The test of bleaching power was carried out using 5 sheets of stained clothes which were obtained above.

The powder bleach compositions which were shown in Tables 1 to 3 prepared 200 mL of test solutions with a concentration of 0.5% by mass (hard water with 3° DH was prepared using deionized water at 25° C. and calcium chloride), dipping was carried out for 30 minutes, then rinsing with tap water for 2 minutes and dehydration for 1 minute were carried out and the clothes were dried at 25° C. for 12 hours in air.

The reflection coefficients of original cloth and clothes before and after bleaching wash were measured with NDR-101DP manufactured by NIPPON DENSHOKU using a filter of 460 nm, cleaning and bleaching power was determined by the following formula and the evaluation of bleaching performance was carried out. Bleaching power was evaluated based on the following standard by determining the mean value of bleaching power for 5 sheets of stained clothes.

Bleaching power (%)=(reflection coefficient after bleaching treatment−reflection coefficient before bleaching treatment)/(reflection coefficient of original cloth−reflection coefficient before bleaching treatment)×100

[Evaluation Standard]

×: Bleaching power is low in comparison with a standard composition

Δ: Bleaching power is equal or more in comparison with a standard composition by 0% or more and less than +10%

○: Bleaching power is high in comparison with a standard composition by +10% or more and less than +15%.

◎: Bleaching power is remarkably high in comparison with standard composition by +15% or more.

Standard composition: (25° C., 3° DH, dipping for 30 minutes)

50% of sodium percarbonate, 50% of sodium carbonate (bleaching power is 45%).

(III) Damage and Coloration of Clothes

Damage and coloration tests with respect to the powder bleach compositions shown in Tables 1 to 3 were carried out by the method below.

Rayon white cloth (6×6 cm for JIS color fastness test by Japanese Standards Association) was placed on a petri dish (a diameter of 9 cm and a height of 1.5 cm), 2.5 g of the powder bleach compositions shown in Tables 1 to 3 were placed thereon, and rayon cloth (equivalent to the above) was used to further cover them. Then, 2.5 g of tap water at 40° C. was quietly poured thereon, allowed to stand at room temperature for 24 hours, then calmly rinsed, and the damage and coloration of clothes were observed to be evaluated under the standard below.

[Standard of Damage of Clothes]

1: Crack is generated in cloth and the cloth is broken.

2: Small hole is perforated in cloth.

3: Cloth is thinned and when stretched, the cloth is broken.

4: Cloth is thinned and when stretched, small hole is perforated.

5: Although cloth is thinned, the cloth is not broken and hole is not perforated if stretched.

6: Damage of cloth is not observed.

[Standard of Coloration]

×: Coloration is observed.

○: No coloration is observed.

(IV) Discoloration

Discoloration test with respect to the powder bleach compositions shown in Tables 1 to 3 was carried out by the method below.

Cotton cloth (#100) (6×6 cm) stained with Reactive Red 21 was placed on a petri dish (a diameter of 9 cm and a height of 1.5 cm), 2.5 g of the powder bleach compositions shown in Tables 1 to 3 were placed thereon, and stained cloth (equivalent to the above) was used to further cover them. Then, 2.5 g of tap water at 40° C. was quietly poured thereon, allowed to stand for 2 hours, then calmly rinsed, and the discoloration of cloth was observed to be evaluated under the standard below.

[Standard of Discoloration of Cloth]

1: Color significantly faded locally.

2: Color faded locally.

3: Color faded slightly in whole.

4: Color faded extremely slightly in whole.

5: No discoloration is observed.

TABLE 1

| | Examples | | | | | | | | | | | | | | | |
|---|---|---|---|---|---|---|---|---|---|---|---|---|---|---|---|---|
| Composition (%) | 1 | 2 | 3 | 4 | 5 | 6 | 7 | 8 | 9 | 10 | 11 | 12 | 13 | 14 | 15 | 16 |
| Sodium percarbonate | 50.0 | 50.0 | 50.0 | 50.0 | 50.0 | 50.0 | 50.0 | 50.0 | 50.0 | 50.0 | 50.0 | 50.0 | 50.0 | 50.0 | 50.0 | 50.0 |
| Coated sodium percarbonate | | | | | | | | | | | | | | | | |
| Powder | | | | | | | | | | | | | | | | |
| Powder-1 | 20.0 | | 20.0 | 20.0 | 10.0 | | | | | | | | | | | |
| Powder-2 | | 20.0 | | | | 20.0 | | | | | | | | | | |
| Bleaching activating catalyst (not granulated) | | | | | | | | | | | | | | | | |
| Catalyst 1 | | | | | 0.4 | | | | | | | | | | | |
| Catalyst 2 | | | | 0.2 | | | | | | | | | | | | |
| Catalyst 3 | | | | | | | | | | | | | | | | |
| Catalyst 4 | | | | | | 0.2 | | | | | | | | | | |
| Bleaching activator granulated substance | | | | | | | | | | | | | | | | |
| Bleaching activator granulated substance A | | | | | | | | | | | | | | | | |
| Bleaching activator granulated substance B | | | 4.0 | | | | | | | | | | | | | |
| Bleaching activator granulated substance C | | | | | | 2.0 | | | | | | | | | | |
| Bleaching activator granulated substance D | | | | 2.0 | | | | | | | | | | | | |
| Granulated substance | | | | | | | | | | | | | | | | |
| Granulated substance 1 | | | | | | | | | | | | | | | | |
| Granulated substance 2 | 4.0 | 4.0 | | | | | | | | | | | | | | |
| Granulated substance 3 | | | | | | | 4.0 | | | | | | | | | |
| Granulated substance 4 | | | | | | | | 4.0 | | | | | | | | |
| Granulated substance 5 | | | | | | | | | 4.0 | | | | | | | |
| Granulated substance 6 | | | | | | | | | | 4.0 | | | | | | |
| Granulated substance 7 | | | | | | | | | | | 4.0 | | | | | |
| Granulated substance 8 | | | | | | | | | | | | | | | | |
| Granulated substance 9 | | | | | | | | | | | | | | | | |
| Granulated substance 10 | | | | | | | | | | | | 6.0 | | | | |
| Granulated substance 11 | | | | | | | | | | | | | 6.0 | | | |
| Granulated substance 12 | | | | | | | | | | | | | | 4.0 | | |
| Granulated substance 13 | | | | | | | | | | | | | | | | |

TABLE 1-continued

| Composition (%) | Examples 1 | 2 | 3 | 4 | 5 | 6 | 7 | 8 | 9 | 10 | 11 | 12 | 13 | 14 | 15 | 16 |
|---|---|---|---|---|---|---|---|---|---|---|---|---|---|---|---|---|
| Granulated substance 14 | | | | | | | | | | | | | | | 4.0 | |
| Granulated substance 15 | | | | | | | | | | | | | | | | 4.0 |
| Granulated substance 16 | | | | | | | | | | | | | | | | |
| Granulated substance 17 | | | | | | | | | | | | | | | | |
| Granulated substance 18 | | | | | | | | | | | | | | | | |
| Granulated substance 19 | | | | | | | | | | | | | | | | |
| Granulated substance 20 | | | | | | | | | | | | | | | | |
| Granulated substance 21 | | | | | | | | | | | | | | | | |
| Sodium carbonate | 24.4 | 24.4 | 23.0 | 25.0 | 38.0 | 25.0 | 42.0 | 42.0 | 42.0 | 42.0 | 42.0 | 40.0 | 40.0 | 42.0 | 42.0 | 42.0 |
| NABION15 | | | | | | | | | | | | | | | | |
| Sodium tetraborate | | | | | | | | | | | | | | | | |
| Metal ion sequestering agent | | | | | | | | | | | | | | | | |
| HEDP-4Na | | | | | | | | | | 2.0 | | | | | | |
| Ethylenediaminetetra-(methylenephosphonate)-Na | | | | | | | | | | | | 1.0 | 1.0 | | | |
| Surfactant | | | | | | | | | | | | | | | | |
| POE-AE(1) | 0.5 | 0.5 | 0.5 | 0.5 | 0.5 | 1.5 | 2.0 | | 2.0 | | 2.0 | | | 2.0 | | |
| POE-AE(2) | | | | | | | | 2.0 | | 0.4 | | 1.3 | 1.3 | | 2.0 | 2.0 |
| LAS-Na | | | | | | | | | | | | | | | | |
| α-SF-Na | | | | | | | | | | | | | | | | |
| AOS-K | | | 1.4 | 1.2 | | 0.2 | 0.9 | 0.9 | 0.9 | 0.5 | 0.9 | 0.6 | 0.6 | 0.9 | 0.9 | 0.9 |
| Enzyme (1) | 1.0 | 1.0 | 1.0 | | 1.0 | 1.0 | 1.0 | 1.0 | 1.0 | 1.0 | 1.0 | 1.0 | | 1.0 | 1.0 | 1.0 |
| Enzyme (2) | | | | 1.0 | | | | | | | | | 1.0 | | | |
| Flavor A | 0.1 | | | 0.1 | | | | 0.1 | | 0.1 | | | 0.1 | | 0.1 | 0.1 |
| Flavor B | | | | | 0.1 | | | | 0.1 | | 0.1 | | | | | |
| Flavor C | | 0.1 | 0.1 | | | 0.1 | | | | | | | | 0.1 | | |
| Flavor D | | | | | | | 0.1 | | | | | 0.1 | | | | |
| Total | 100.0 | 100.0 | 100.0 | 100.0 | 100.0 | 100.0 | 100.0 | 100.0 | 100.0 | 100.0 | 100.0 | 100.0 | 100.0 | 100.0 | 100.0 | 100.0 |
| Bleaching power | ◎ | ◎ | ○ | ◎ | ◎ | ○ | ◎ | ◎ | ◎ | ○ | ◎ | ○ | ◎ | ◎ | ◎ | ◎ |
| Damage of clothes | 6 | 5 | 6 | 6 | 5 | 5 | 5 | 6 | 5 | 5 | 6 | 6 | 6 | 6 | 6 | 6 |
| Coloration | ○ | ○ | ○ | ○ | ○ | ○ | ○ | ○ | ○ | ○ | ○ | ○ | ○ | ○ | ○ | ○ |
| Discoloration of clothes | 4 | 4 | 5 | 3 | 3 | 4 | 4 | 5 | 4 | 5 | 4 | 4 | 4 | 5 | 5 | 4 |

TABLE 2

| Composition (%) | Examples 17 | 18 | 19 | 20 | 21 | 22 | 23 | 24 | 25 | 26 |
|---|---|---|---|---|---|---|---|---|---|---|
| Sodium percarbonate | | | 20.0 | 30.0 | 50.0 | 30.0 | 30.0 | 30.0 | | |
| Coated sodium percarbonate | 35.0 | 50.0 | | | | | | | 50.0 | 50.0 |
| Powder | | | | | | | | | | |
| Powder-1 | | | | | | | 10.0 | 10.0 | | 5.0 |
| Powder-2 | | | | | | | | | | |
| Bleaching activating catalyst (not granulated) | | | | | | | | | | |
| Catalyst 1 | | | | | | | | | | |
| Catalyst 2 | | | | | | | | | | |
| Catalyst 3 | | | | | | | | | | |
| Catalyst 4 | | | | | | | | | | |
| Bleaching activator granulated substance | | | | | | | | | | |
| Bleaching activator granulated substance A | | | | | | | | | | |
| Bleaching activator granulated substance B | | | | | | | 2.0 | | | |
| Bleaching activator granulated substance C | | | | | | | | | | |
| Bleaching activator granulated substance D | | | | | | | | 2.0 | | |
| Granulated substance | | | | | | | | | | |
| Granulated substance 1 | | | | | | | | | | |
| Granulated substance 2 | | | | | | | | | | |

TABLE 2-continued

| | | | | | | | | | | |
|---|---|---|---|---|---|---|---|---|---|---|
| Granulated substance 3 | | | | | | | | | | |
| Granulated substance 4 | 2.0 | 2.0 | 2.0 | | | 2.0 | 2.0 | 2.0 | 2.0 | 2.0 |
| Granulated substance 5 | | | | | | | | | | |
| Granulated substance 6 | | | | | | | | | | |
| Granulated substance 7 | | | | | | | | | | |
| Granulated substance 8 | | | | | | | | | | |
| Granulated substance 9 | | | | | | | | | | |
| Granulated substance 10 | | | | | | | | | | |
| Granulated substance 11 | | | | | | | | | 2.0 | 2.0 |
| Granulated substance 12 | | | | | | | | | | |
| Granulated substance 13 | | | | | | | | | | |
| Granulated substance 14 | | | | | | | | | | |
| Granulated substance 15 | | | | 4.0 | | | | | | |
| Granulated substance 16 | | | | | 6.5 | | | | | |
| Granulated substance 17 | | | | | | | | | | |
| Granulated substance 18 | | | | | | | | | | |
| Granulated substance 19 | | | | | | | | | | |
| Granulated substance 20 | | | | | | | | | | |
| Granulated substance 21 | | | | | | | | | | |
| Sodium carbonate | 56.9 | 33.4 | 64.0 | 60.0 | 39.5 | 52.0 | 49.0 | 49.0 | 33.9 | 28.9 |
| NABION15 | | | | | | 10.0 | | | | |
| Sodium tetraborate | | 3.0 | | | | | | | | |
| Metal ion sequestering agent | | | | | | | | | | |
| HEDP-4Na | | | | 2.0 | | | 1.0 | 1.0 | 1.0 | 1.0 |
| Ethylenediaminetetra-(methylenephosphonate)-Na | | | | | 1.0 | | | | | |
| Surfactant | | | | | | | | | | |
| POE-AE(1) | 3.0 | 2.0 | 2.0 | 1.0 | | 3.0 | 3.0 | 3.0 | 10.0 | 10.0 |
| POE-AE(2) | | | 10.0 | | 1.3 | | | | | |
| LAS-Na | | 3.0 | | | | | | | | |
| α-SF-Na | | 5.0 | | | | | | | | |
| AOS-K | 1.0 | 0.5 | 0.9 | 1.9 | 0.6 | 1.9 | 1.9 | 1.9 | | |
| Enzyme (1) | 1.0 | 1.0 | 1.0 | 1.0 | 1.0 | 1.0 | 1.0 | 1.0 | 1.0 | 1.0 |
| Enzyme (2) | 1.0 | | | | | | | | | |
| Flavor A | | 0.1 | 0.1 | 0.1 | | | | | | 0.1 |
| Flavor B | | | | | | | | | 0.1 | |
| Flavor C | 0.1 | | | | 0.1 | 0.1 | 0.1 | 0.1 | | |
| Flavor D | | | | | | | | | | |
| Total | 100.0 | 100.0 | 100.0 | 100.0 | 100.0 | 100.0 | 100.0 | 100.0 | 100.0 | 100.0 |
| Bleaching power | ◎ | ◎ | ○ | ◎ | ◎ | ◎ | ◎ | ◎ | ◎ | ◎ |
| Damage of clothes | 6 | 6 | 6 | 6 | 6 | 6 | 6 | 6 | 6 | 6 |
| Coloration | ○ | ○ | ○ | ○ | ○ | ○ | ○ | ○ | ○ | ○ |
| Discoloration of clothes | 5 | 5 | 5 | 4 | 5 | 5 | 5 | 4 | 4 | 5 |

| | Examples | | | | | | | | |
|---|---|---|---|---|---|---|---|---|---|
| Composition (%) | 27 | 28 | 29 | 30 | 31 | 32 | 33 | 34 | 35 |
| Sodium percarbonate | | 50.0 | 50.0 | | | | 50.0 | | |
| Coated sodium percarbonate | 50.0 | | | 50.0 | 30.0 | 50.0 | | 50.0 | 70.0 |
| Powder | | | | | | | | | |
| Powder-1 | 10.0 | 10.0 | 10.0 | 20.0 | | 10.0 | 10.0 | 10.0 | 10.0 |
| Powder-2 | | | | | | | | | |
| Bleaching activating catalyst (not granulated) | | | | | | | | | |
| Catalyst 1 | | | | | | | | | |
| Catalyst 2 | | | | | | | | | |
| Catalyst 3 | | | | | | | | | |
| Catalyst 4 | | | | | | | | | |
| Bleaching activator granulated substance | | | | | | | | | |
| Bleaching activator granulated substance A | | | | | | | | | |
| Bleaching activator granulated substance B | 2.0 | 2.0 | 2.0 | 2.0 | | 1.0 | | | 1.0 |
| Bleaching activator granulated substance C | | | | | | | 1.0 | 1.0 | |
| Bleaching activator granulated substance D | | | | | | | | | |

TABLE 2-continued

| | | | | | | | | | |
|---|---|---|---|---|---|---|---|---|---|
| Granulated substance | | | | | | | | | |
| Granulated substance 1 | | | | | | | | | |
| Granulated substance 2 | | | | | | | | | |
| Granulated substance 3 | | | | | | | | | |
| Granulated substance 4 | | | | | | | | | |
| Granulated substance 5 | | | | | | | | | |
| Granulated substance 6 | | | | | | | | | |
| Granulated substance 7 | | | | | | | | | |
| Granulated substance 8 | | | | | | | | | |
| Granulated substance 9 | | | | | | | | | |
| Granulated substance 10 | | | | | | | | | |
| Granulated substance 11 | | | | | | | | | |
| Granulated substance 12 | | | | | | | | | |
| Granulated substance 13 | | | | | | | | | |
| Granulated substance 14 | | | | | | | | | |
| Granulated substance 15 | | | | | | | | | |
| Granulated substance 16 | | | | | | | | | |
| Granulated substance 17 | 1.0 | | | | | | | | |
| Granulated substance 18 | | 2.0 | | | 2.0 | | | | 3.0 |
| Granulated substance 19 | | | 4.0 | | | 4.0 | | | |
| Granulated substance 20 | | | | 2.0 | | | | | |
| Granulated substance 21 | | | | | | | 2.0 | 2.0 | |
| Sodium carbonate | 24.9 | 23.9 | 21.9 | 13.9 | 56.9 | 22.9 | 33.9 | 23.9 | 3.9 |
| NABION15 | | | | | | | | | |
| Sodium tetraborate | | | | | | | | | |
| Metal ion sequestering agent | | | | | | | | | |
| HEDP-4Na | 1.0 | 1.0 | 1.0 | 1.0 | | 1.0 | | | 1.0 |
| Ethylenediaminetetra-(methylenephosphonate)-Na | | | | | | | | | |
| Surfactant | | | | | | | | | |
| POE-AE(1) | 10.0 | | 10.0 | | 10.0 | | | | 10.0 |
| POE-AE(2) | | 10.0 | | | | 10.0 | 2.0 | 6.0 | |
| LAS-Na | | | | 3.0 | | | | 6.0 | |
| α-SF-Na | | | | 5.0 | | | | | |
| AOS-K | | | | 1.0 | | | | | |
| Enzyme (1) | 1.0 | | 1.0 | 1.0 | 1.0 | 1.0 | 1.0 | 1.0 | 1.0 |
| Enzyme (2) | | 1.0 | | 1.0 | | | | | |
| Flavor A | 0.1 | | | | | | 0.1 | | |
| Flavor B | | 0.1 | | | | 0.1 | | | |
| Flavor C | | | 0.1 | | 0.1 | | | 0.1 | 0.1 |
| Flavor D | | | | 0.1 | | | | | |
| Total | 100.0 | 100.0 | 100.0 | 100.0 | 100.0 | 100.0 | 100.0 | 100.0 | 100.0 |
| Bleaching power | ◎ | ◎ | ◎ | ◎ | ◎ | ◎ | ○ | ○ | ◎ |
| Damage of clothes | 6 | 6 | 6 | 6 | 6 | 6 | 6 | 6 | 6 |
| Coloration | ○ | ○ | ○ | ○ | ○ | ○ | ○ | ○ | ○ |
| Discoloration of clothes | 5 | 5 | 5 | 5 | 5 | 5 | 5 | 5 | 5 |

TABLE 3

| | Comparative Examples | | | | | | | | | | |
|---|---|---|---|---|---|---|---|---|---|---|---|
| Composition (%) | 1 | 2 | 3 | 4 | 5 | 6 | 7 | 8 | 9 | 10 | 11 |
| Sodium percarbonate | 50.0 | 50.0 | 50.0 | 50.0 | 50.0 | 50.0 | 50.0 | | 50.0 | 50.0 | 50.0 |
| Coated sodium percarbonate | | | | | | | | 50.0 | | | |
| Powder | | | | | | | | | | | |
| Powder-1 | | 20.0 | | | | | | | | | |
| Powder-2 | | | | | | | | | | | |
| Bleaching activating catalyst (not granulated) | | | | | | | | | | | |
| Catalyst 1 | | | 0.4 | | | | | | | | |
| Catalyst 2 | | | | | | | | | | | |
| Catalyst 3 | | | | | | | | | | | |
| Catalyst 4 | | | | | | | | | | | |
| Bleaching activator granulated substance | | | | | | | | | | | |
| Bleaching activator granulated substance A | | | | | 4.0 | | | 4.0 | | | |

TABLE 3-continued

| Composition (%) | Comparative Examples 1 | 2 | 3 | 4 | 5 | 6 | 7 | 8 | 9 | 10 | 11 |
|---|---|---|---|---|---|---|---|---|---|---|---|
| Bleaching activator granulated substance B | | | | | | | | | | | |
| Bleaching activator granulated substance C | | | | | | | | | | | |
| Bleaching activator granulated substance D | | | | | | 4.0 | | | | | |
| Granulated substance | | | | | | | | | | | |
| Granulated substance 1 | | | | | | | 4.0 | | | | |
| Granulated substance 2 | | | | 4.0 | | | | | | | |
| Granulated substance 3 | | | | | | | | | | | |
| Granulated substance 4 | | | | | | | | | | | |
| Granulated substance 5 | | | | | | | | | | | |
| Granulated substance 6 | | | | | | | | | | | |
| Granulated substance 7 | | | | | | | | | | | |
| Granulated substance 8 | | | | | | | | | | 4.0 | |
| Granulated substance 9 | | | | | | | | | | | 4.0 |
| Granulated substance 10 | | | | | | | | | | | |
| Granulated substance 11 | | | | | | | | | | | |
| Granulated substance 12 | | | | | | | | | | | |
| Granulated substance 13 | | | | | | | | | 4.0 | | |
| Granulated substance 14 | | | | | | | | | | | |
| Granulated substance 15 | | | | | | | | | | | |
| Granulated substance 16 | | | | | | | | | | | |
| Granulated substance 17 | | | | | | | | | | | |
| Granulated substance 18 | | | | | | | | | | | |
| Granulated substance 19 | | | | | | | | | | | |
| Granulated substance 20 | | | | | | | | | | | |
| Granulated substance 21 | | | | | | | | | | | |
| Sodium carbonate | 45.0 | 25.4 | 45.0 | 41.4 | 41.4 | 41.4 | 41.4 | 42.0 | 41.4 | 41.4 | 41.4 |
| NABION15 | | | | | | | | | | | |
| Sodium tetraborate | | | | | | | | | | | |
| Metal ion sequestering agent | | | | | | | | | | | |
| HEDP-4Na | | | | | | | | | | | |
| Ethylenediaminetetra-(methylenephosphonate)-Na | | | | | | | | | | | |
| Surfactant | | | | | | | | | | | |
| POE-AE(1) | 2.0 | 2.0 | 2.0 | 2.0 | 2.0 | 2.0 | 2.0 | 1.7 | 2.0 | 2.0 | 2.0 |
| POE-AE(2) | | | | | | | | | | | |
| LAS-Na | | | | | | | | | | | |
| α-SF-Na | | | | | | | | | | | |
| AOS-K | 1.9 | 1.5 | 1.5 | 1.5 | 1.5 | 1.5 | 1.5 | 1.2 | 1.5 | 1.5 | 1.5 |
| Enzyme (1) | 1.0 | 1.0 | 1.0 | 1.0 | 1.0 | 1.0 | 1.0 | 1.0 | 1.0 | 1.0 | 1.0 |
| Enzyme (2) | | | | | | | | | | | |
| Flavor A | 0.1 | | | 0.1 | | 0.1 | | | | 0.1 | |
| Flavor B | | 0.1 | | | | | 0.1 | | | | |
| Flavor C | | | | | 0.1 | | | | | | 0.1 |
| Flavor D | | | 0.1 | | | | | 0.1 | 0.1 | | |
| Total | 100.0 | 100.0 | 100.0 | 100.0 | 100.0 | 100.0 | 100.0 | 100.0 | 100.0 | 100.0 | 100.0 |
| Bleaching power | Δ | Δ | ◎ | ◎ | ○ | ○ | ◎ | ○ | ◎ | ◎ | ◎ |
| Damage of clothes | 6 | 6 | 1 | 2 | 5 | 5 | 2 | 5 | 5 | 3 | 2 |
| Coloration | ○ | ○ | ○ | ○ | ○ | ○ | ○ | ○ | X | ○ | ○ |
| Discoloration of clothes | 5 | 5 | 2 | 2 | 1 | 2 | 2 | 2 | Colored | 3 | 3 |

Further, the granulated substances or molded substances in Tables 1 to 3 were prepared by the following method.

Preparation of Granulated Substances or Molded Substances

The granulated substances or molded substances of the compositions (refer to below with respect to the bleaching activating catalyst and bleaching activator, while the powder is shown in Table 4) shown in Table 5 were prepared as described below.

With respect to the granulated substances 1 to 17, polyethylene glycol (PEG 6000) melted and other components were homogeneously mixed at 70° C. using a kneader and the mixture was cooled to room temperature (20° C.) while cooling it to obtain a solid product with a size of 1 mm to 5 cm. Then, the solid product was pulverized and granulated with a pulverizer to prepare the granulated substances with an average particle size shown in Table 5.

With respect to the granulated substances 18 to 21, all the components of compositions shown in Table 5 were homogeneously powder-mixed, and the mixture was charged in Extrude O-Mix EM-6 type manufactured by HOSOKAWA MICRON CORPORATION to be kneaded, extruded and further cut by a cutter, so that a pellet type molded substance (1) with a diameter of 0.8 mmϕ and a length of 0.5 to 3 mm was obtained (a kneading temperature of 60° C. and the temperature after extrusion and cutting was 20° C.).

Then, the molded substance (1) was introduced in FITZMILL DKA-3 manufactured by HOSOKAWA MICRON CORPORATION and pulverized to obtain the molded substance (2) with an average particle size shown in Table 5.

Further, the same raw materials as the name-abbreviated components of the bleach composition, which is described after Table 5, were used for raw materials used in Table 5.

Molded Substance Containing Bleach Composition

Further, the bleach compositions were prepared in the same manner as Examples 28 to 35 using the above-mentioned molded substance (1) in place of molded substance (2) and the above-mentioned evaluation was carried out to obtain similar evaluation result to Examples 28 to 35.

TABLE 4

| Fiber or/and powder derived from chemical fiber | | Solubility (g) | Average fiber length or average particle size (μm) |
|---|---|---|---|
| Powder 1 | Powder cellulose | Less than 0.1 | 45 (Average fiber length) |
| Powder 2 | Silk powder | Less than 0.1 | 5 to 6 (Average particle size) |
| Powder 3 | Crystalline cellulose | Less than 0.1 | 80 (Average particle size) |
| Powder 4 | Carboxymethylcellulose sodium | 0.1 or more | — |

Further, as components in Table, those described below were used.

Sodium percarbonate: manufactured by MITSUBISHI GAS CHEMICAL COMPANY, INC. (trade name: SPC-Z, effective oxygen quantity: 10.9%, those blended with sodium percarbonate/sodium carbonate/sodium bicarbonate at the ratio of 77:3:20 for preventing dangerousness)

Coated sodium percarbonate: sodium percarbonate coated with silicic acid and sodium borate (manufactured by MITSUBISHI GAS CHEMICAL COMPANY, INC. (trade name: SPC-D, effective oxygen quantity: 13.2%)

(Powder)

Powder 1: powder cellulose (trade name: Arbocel FD600/30, manufactured by Rettenmaier).

Powder 2: silk powder (trade name: Idemitsu Silk Powder K-50, manufactured by Idemitsu Petrochemical Co., Ltd.).

Powder 3: crystalline cellulose (trade name: Avicel PH-302 manufactured by Asahi Kasei Corporation).

Powder 4: carboxymethylcellulose sodium (trade name: Daicel 1130, manufactured by Daicel Chemical Industries, Ltd.)

The solubility, average fiber length or average particle size of Powders 1 to 4 are shown in Table 4. Further, the solubility is solubility (g) for 100 g of deionized water at

TABLE 5

| | | Mixing proportion (%) | | | | | | | | | |
|---|---|---|---|---|---|---|---|---|---|---|---|
| | | | Bleaching activating catalyst | Binder | Surfactant | | Radical | | | | Average particle |
| Granulated substance | Granulated substance (Name-abbreviated) | Powder component | Bleaching activator | PEG 6000 | AS-Na | AOS-Na | trapping agent | Sodium sulfate | Sodium citrate | Total | size [μm] |
| 1 | Catalyst 1/PEG | — | 10 | 90 | — | — | — | — | — | 100 | 900 |
| 2 | Catalyst 2/PEG/surfactant | — | 10 | 85 | 5 | — | — | — | — | 100 | 800 |
| 3 | Powder 1/catalyst 1/PEG/surfactant | 10 | 10 | 75 | 5 | — | — | — | — | 100 | 830 |
| 4 | Powder 1/catalyst 2/PEG/surfactant | 10 | 10 | 75 | 5 | — | — | — | — | 100 | 520 |
| 5 | Powder 1/catalyst 2/PEG/surfactant | 45 | 10 | 40 | 5 | — | — | — | — | 100 | 720 |
| 6 | Powder 1/catalyst 3/PEG/surfactant | 10 | 10 | 75 | 5 | — | — | — | — | 100 | 800 |
| 7 | Powder 2/catalyst 2/PEG/surfactant | 10 | 10 | 75 | 5 | — | — | — | — | 100 | 820 |
| 8 | Powder 3/catalyst 2/PEG/surfactant | 10 | 10 | 75 | 5 | — | — | — | — | 100 | 900 |
| 9 | Powder 4/catalyst 2/PEG/surfactant | 10 | 10 | 75 | 5 | — | — | — | — | 100 | 880 |
| 10 | Powder 1/bleaching activator 1/PEG/surfactant | 10 | 65 | 20 | 5 | — | — | — | — | 100 | 800 |
| 11 | Powder 1/bleaching activator 4/PEG/surfactant | 10 | 65 | 20 | 5 | — | — | — | — | 100 | 800 |
| 12 | Powder 1/powder 2/catalyst 2/PEG | 5/5 | 10 | 80 | — | — | — | — | — | 100 | 900 |
| 13 | Catalyst 2/PEG/BHT | — | 10 | 80 | — | — | 10 | — | — | 100 | 850 |
| 14 | Powder 1/catalyst 2/PEG/4-methoxyphenol | 5 | 10 | 80 | — | — | 5 | — | — | 100 | 600 |
| 15 | Powder 1/catalyst 2/bleaching activator 4/surfactant/PEG | 10 | 10/35 | 40 | 5 | — | — | — | — | 100 | 770 |
| 16 | Powder 1/bleaching activator 2/PEG/surfactant/4-methoxyphenol | 10 | 60 | 20 | 5 | — | 5 | — | — | 100 | 720 |
| 17 | Powder 1/Catalyst 2/PEG/surfactant/sodium sulfate | 20 | 20 | 40 | — | 10 | — | 10 | — | 100 | 800 |
| 18 | Powder 1/Catalyst 2/PEG/surfactant | 20 | 10 | 65 | 5 | — | — | — | — | 100 | 570 |
| 19 | Powder 1/Catalyst 2/PEG/surfactant/sodium citrate | 10 | 5 | 40 | 5 | — | — | — | 40 | 100 | 780 |
| 20 | Powder 1/Catalyst 2/PEG/surfactant/sodium citrate | 10 | 10 | 65 | 5 | — | — | — | 10 | 100 | 590 |
| 21 | Powder 1/Catalyst 5/PEG/surfactant/sodium sulfate | 10 | 10 | 60 | — | 10 | — | 10 | — | 100 | 500 |

25° C., and the measurement method of the average particle size and average fiber length was measured according to the granularity test of Japanese Pharmacopoeia.

(Bleaching Activating Catalyst)

Catalyst 1:

Tris-μ-oxo-bis-[(1,4,7-trimethyl-1,4,7-triazacyclononane) manganese(IV)]pentafluorophosphate. It is shown in the following formula. Synthesis was carried out in accordance with Journal of the American Chemical Society 1998, Vol. 110, pp 7398-7411.

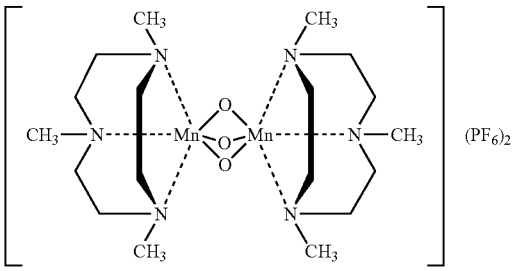

Catalyst 2:

(Tris(salicylideneiminoethyl)amine)-manganese complex.

It is shown in the following formula. Synthesis method is shown below.

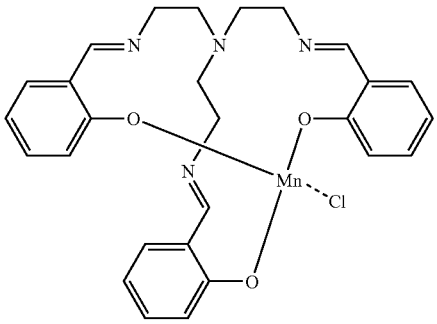

Catalyst 3:

(N,N'-Ethylenebis(4-hydroxysalicylideneiminate))-manganese complex.

It is shown in the following formula. Synthesis method is shown below.

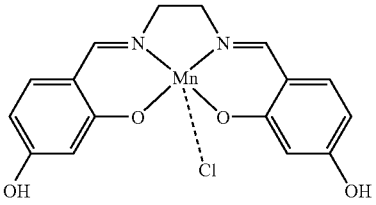

Catalyst 4:

(Tris(2-pyridyl)methyl)amine)-manganese complex.

It is shown in the following formula. Synthesis method is shown below.

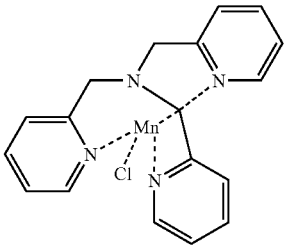

Catalyst 5:

[13,14-Dichloro-6,6-diethyl-3,4,8,9-tetrahydro-3,3,9,9-tetramethyl-1H-1,4,8,11-benzotetraazacyclotridecine]-iron complex.

It is shown in the following formula. Synthesis was carried out in accordance with Example described in International patent application published in Japan No. 2000-515194.

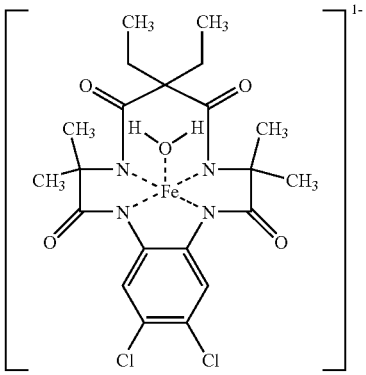

(Bleaching Activator)

Bleaching activator 1: tetraacetylethylenediamine (reagent manufactured by KANTO CHEMICAL CO., INC.).

Bleaching activator 2: 4-decanoyloxybenzoic acid (reagent manufactured by Mitsui Chemicals, Inc.).

Bleaching activator 3: sodium 4-dodecanoyloxybenzenesulfonate. Synthesis method is shown below.

Bleaching activator 4: sodium 4-nonanoyloxybenzenesulfonate. Synthesis method is shown below.

(Bleaching Activator Granulated Substance)

Bleaching activator A: granulated substance of tetraacetylethylenediamine (trade name: TAED4049, manufactured by Clariant (Japan) K.K., pure content: 86%). The preparation method of bleaching activators B to D is shown below.

Sodium carbonate: manufactured by TOKUYAMA Corp. (trade name: Soda ash DENSE).

Sodium tetraborate: sodium tetraborate pentahydrate (trade name: Neobor, manufactured by Borax Inc.).

NABION 15: alkali agent comprising a mixture of sodium carbonate, sodium silicate and water at a mass ratio of 55:29:16 (manufactured by Rhodia Japan, Ltd.)

HEDP-4Na: tetrasodium 1-hydroxyethane-1,1-diphosphonate (manufactured by Solutia Japan Ltd., trade name: DEQUEST 2016D)

Ethylenediaminetetra(methylenephosphonic acid)-Na: manufactured by ALBRIGHT & WILSON Ltd., (trade name: BRIQUEST (registered trademark) 422).

(Surfactant)

POE-AE (1): a nonionic surfactant (an alkyl chain length is 12 to 14, average addition molar number of ethylene oxide is 5, and an adduct of 3 to 7 mol of ethylene oxide is 90% or more of the whole, (pure content: 90%), manufactured by LION Corporation).

POE-AE (2): a nonionic surfactant (an alkyl chain length is 12 to 15 and average addition molar number of ethylene oxide is 15, (pure content: 90%), manufactured by LION Corporation).

LAS-Na: a surfactant obtained by neutralizing linear alkyl (10 to 14 carbons) benzenesulfonic acid (LIPON LH-200 (LAS-H, pure content of 96%) manufactured by LION Corporation) with sodium carbonate.

α-SF-Na: α-sulfofatty acid alkyl ester (methyl ester (a mixture of PASTELL M-14 and PASTELL M-16 (manufactured by LION Oleochemical Co. Ltd.) at 2:8) was sulfonated according to a method disclosed in Example 1 of Japanese Unexamined Patent Publication No. 2001-64248) and extracted after an esterification step to prepare α-sulfofatty acid alkyl ester, and then it was neutralized with sodium carbonate).

AOS-K: Potassium α-olefinsulfonate having an alkyl group of 14 to 18 carbon atoms (manufactured by LION Corporation).

AOS-Na: Sodium α-olefinsulfonate having 14 carbon atoms (LIPOLAN PJ-400 manufactured by LION Corporation).

AS-Na: Sodium laurylsulfate (SLS manufactured by Nikko Chemicals Co., Ltd., the pure content of AS-Na: 95.7%).

(Enzyme)

Enzyme (1): manufactured by Novozymes A/S (trade name: Everlase 8.0T).

Enzyme (2): manufactured by Novozymes A/S (trade name: Lipex).

(Perfume)

Perfume composition: for perfume compositions A to D, those described in Tables 1 to 7 in Japanese Unexamined Patent Publication No. 2003-89800 are used.

(Radical Trapping Agent)

4-Methoxyphenol: manufactured by Kawaguchi Chemical Industry Co., Ltd. (trade name: MQ-F).

BHT: di-tert-butyl-hydroxytoluene manufactured by Nikki-Universal Co., Ltd. (trade name: BHT-C).

(Others)

Sodium sulfate: manufactured by Shikoku Corp. (trade name: Neutral Anhydrous Mirabilite).

Sodium citrate: manufactured by FUSO CHEMICAL CO., LTD. (trade name: Purified Sodium Citrate L).

PEG: polyethylene glycol (trade name: PEG#6000M manufactured by LION Corporation).

Synthesis of Catalyst 2: tris(salicylideneiminoethyl)amine)-manganese Complex

Tris(2-aminoethyl)amine (reagent, manufactured by TOKYO KASEI KOGYO Co., Ltd.), salicylaldehyde (reagent, manufactured by TOKYO KASEI KOGYO Co., Ltd.), manganese chloride tetrahydrate (reagent, manufactured by KANTO CHEMICAL CO., INC.), methanol (reagent, manufactured by KANTO CHEMICAL CO., INC.) and ethanol (reagent, manufactured by Amakasu Chemical Industries) were used as materials and synthesis was carried out by the method below.

48.7 g (0.333 mol) of tris(2-aminoethyl)amine was charged in a reaction container and dissolved with 300 mL of methanol to be cooled to 0° C. A solution in which 121.9 g (0.998 mol) of salicylaldehyde was dissolved with 100 mL of methanol was added dropwise thereto over one hour. After completion of dropwise addition, the solution was further stirred at 0° C. for one hour. After completion of stirring, it was allowed to stand at 0° C. for 3 hours and then, yellow crystals precipitated were filtered using a Kiriyama funnel. The crystals obtained were recrystallized with 500 mL of ethanol and purified to obtain 143 g of the crystals of tris (salicylideneiminoethyl)amine.

1.0 g (0.002 mol) of the crystals of tris(salicylideneiminoethyl)amine obtained above was dissolved in 100 mL of ethanol and 0.43 g (0.002 mol) of manganese chloride tetrahydrate was added to the solution at room temperature. After concentrating ethanol under reduced pressure until about 50 mL remains, it was allowed to stand at 5° C. for 24 hours. Dark green crystals precipitated were separated by filtration to obtain 1.1 g of the crystals of (tris(salicylideneiminoethyl) amine)-manganese complex (catalyst 2).

Synthesis of Catalyst 3: (N,N'-ethylenebis(4-hydroxysalicylideneiminate))-manganese Complex Ethylenediamine (reagent, manufactured by TOKYO KASEI KOGYO Co., Ltd.), 2,4-dihydroxybenzaldehyde (reagent, manufactured by KANTO CHEMICAL CO., INC.), manganese chloride tetrahydrate (reagent, manufactured by KANTO CHEMICAL CO., INC.), methanol (reagent, manufactured by KANTO CHEMICAL CO., INC.) and ethanol (reagent, manufactured by Amakasu Chemical Industries) were used as materials and synthesis was carried out by the method indicated below. 30.1 g (0.501 mol) of ethylenediamine was charged in a reaction container and dissolved with 300 mL of methanol to be cooled to 0° C. A solution in which 138.1 g (1.000 mol) of 2,4-dihydroxybenzaldehyde was dissolved with 100 mL of methanol was added dropwise thereto over one hour. After completion of dropwise addition, the solution was further stirred at 0° C. for one hour. After completion of stirring, it was allowed to stand at 0° C. for 3 hours and then, yellow crystals precipitated were filtered using a Kiriyama funnel. The crystals obtained were recrystallized with 500 mL of ethanol and purified to obtain 135 g of the crystals of N,N'-ethylenebis(4-hydroxysalicylideneiminate). 1.0 g (0.003 mol) of the crystals of N,N'-ethylenebis (4-hydroxysalicylideneiminate) obtained above was dissolved in 100 mL of ethanol and 0.66 g (0.003 mol) of manganese chloride tetrahydrate was added to the solution at room temperature. After concentrating ethanol under reduced pressure until about 50 mL remains, it was allowed to stand at 50° C. for 24 hours. Brown crystals precipitated were separated by filtration to obtain 1.0 g of the crystals of (N,N'-ethylenebis(4-hydroxysalicylideneiminate))-manganese complex (catalyst 3).

Synthesis of Catalyst 4: (tris(2-pyridyl)methyl)amine)-manganese Complex 2-(Chloromethyl)pyridine hydrochloride (reagent, manufactured by SIGMA-ALDRICH Corp.), 2,2'-dipicolylamine (reagent, manufactured by TOKYO KASEI KOGYO Co., Ltd.), manganese chloride tetrahydrate (reagent, manufactured by KANTO CHEMICAL CO., INC.), 5.4 N sodium hydroxide (prepared by using sodium hydroxide (reagent, manufactured by KANTO CHEMICAL CO., INC.)), diethyl ether (reagent, manufactured by KANTO CHEMICAL CO., INC.) and ethanol (reagent, manufactured by Amakasu Chemical Industries) were used as materials to synthesize a ligand (tris((2-pyridyl)methyl)amine) according to Example of Japanese Unexamined Patent Publication No. Hei 10-140193. 1.0 g (0.003 mol) of the crystals of the ligand obtained was dissolved in 100 mL of ethanol and 0.68 g (0.003 mol) of manganese chloride tetrahydrate was added to the solution at room temperature. After concentrating ethanol under reduced pressure until about 50 mL remains, it was allowed to stand at 5° C. for 24 hours. Crystals precipitated were separated by filtration to obtain 1.1 g of the crystals of (tris(2-pyridyl)methyl)amine)-manganese complex (catalyst 4).

Synthesis of Bleaching Activator 3: sodium 4-dodecanoyloxybenzenesulfonate

Sodium p-phenolsulfonate (a reagent, manufactured by KANTO CHEMICAL CO., INC.), N,N-dimethylformamide (reagent, manufactured by KANTO CHEMICAL CO., INC.), lauric acid chloride (a reagent, manufactured by TOKYO KASEI KOGYO Co., Ltd.) and acetone (reagent, manufactured by KANTO CHEMICAL CO., INC.) were used as raw materials and synthesis was carried out by the method below.

100 g (0.46 mol) of sodium p-phenolsulfonate which was preliminarily dehydrated was dispersed in 300 g of dimethylformamide, and lauric acid chloride was added dropwise thereto at 50° C. over 30 minutes while stirring with a magnetic stirrer. After completion of dropwise addition, reaction was carried out for 3 hours, and dimethylformamide was distilled off at 100° C. under reduced pressure (0.5 to 1 mmHg). After washing with acetone, it was recrystallized in water/acetone=1/1 (molar ratio) solvent. Yield was 90%.

Synthesis of Bleaching Activator 4: sodium 4-nonanoyloxybenzenesulfonate

Sodium p-phenolsulfonate (reagent, manufactured by KANTO CHEMICAL CO., INC.), N,N-dimethylformamide (reagent, manufactured by KANTO CHEMICAL CO., INC.), pelargonic acid chloride (a reagent, manufactured by TOKYO KASEI KOGYO Co., Ltd.) and acetone (reagent, manufactured by KANTO CHEMICAL CO., INC.) were used as raw materials and synthesis was carried out by the method below.

100 g (0.51 mol) of sodium p-phenolsulfonate which Was preliminarily dehydrated was dispersed in 300 g of N,N-dimethylformamide, and 90 g (0.51 mol) of pelargonic acid chloride was added dropwise thereto at 50° C. over 30 minutes while stirring with a magnetic stirrer. After completion of dropwise addition, reaction was carried out for 3 hours, and N,N-dimethylformamide was distilled off at 100° C. under reduced pressure (0.5 to 1 mmHg). After rinsing with acetone, it was recrystallized in water/acetone=1/1 (molar ratio) solvent to be purified to obtain 146 g of the crystals of nonanoyloxybenzenesulfonate.

Preparation Method of Bleaching Activator Granulated Substance B

Materials were fed to Extrude O-Mix EM-6 type manufactured by HOSOKA MICRON CORPORATION so as to have a proportion of 70 parts by mass of 4-decanoyloxybenzoic acid (manufactured by Mitsui Chemicals, Inc.) of the bleaching activator 2 as a bleaching activator, 20 parts by mass of PEG [polyethylene glycol #6000M (manufactured by LION Corporation)] and 5 parts by mass of the powder product of sodium α-olefinsulfonate having 14 carbons (LIPOLAN PJ-400 (manufactured by LION Corporation)) and extruded by kneading (at a kneading temperature of 60° C.) to obtain a noodle-shaped extruded product with a diameter of 0.8 mmϕ. The extruded product (which was cooled to 20° C. by cool wind) was introduced in FITZMILL DKA-3 type manufactured by HOSOKAWA MICRON CORPORATION, and 5 parts by mass of type A zeolite powder was similarly fed as an auxiliary agent. The mixture was pulverized to obtain the bleaching activator granulated substance B with an average particle size of about 700 μm.

Preparation Method of Bleaching Activator Granulated Substance C

The granulated substance of the bleaching activator C was prepared in the same manner as the bleaching activator granulated substance B except that sodium 4-dodecanoyloxybenzenesulfonate of the bleaching activator 3 was used as a bleaching activator.

Preparation Method of Bleaching Activator Granulated Substance D

The granulated substance of the bleaching activator D was prepared in the same manner as the bleaching activator granulated substance B except that sodium 4-nonanoyloxybenzenesulfonate of the bleaching activator 4 was used as a bleaching activator.

EXAMPLES 36 TO 113 AND COMPARATIVE EXAMPLES 12 TO 35

In accordance with the compositions shown in the following Tables 6 to 11, one or two selected from the groups A to L of the particles containing surfactants which were prepared by the following methods, percarbonate, a powder, the bleaching activating catalysts, the granulated substances shown in Table 5, the aforementioned granulated substances A to D of the bleaching activator and other components were mixed by tumbling in a horizontal cylindrical tumbling mixer (a mixer having two baffles of 45 mm high and its clearance of 20 mm to an internal wall of a drum, and having a cylindrical diameter of 585 mm, a cylindrical length of 490 mm and a drum container of 131.7 L), for 1 minute under the conditions of a filling ratio of 30% by volume, a revolution of 22 rpm and 25° C., to obtain the bleaching detergent compositions of Examples 36 to 113 and Comparative Examples 12 to 35. Bleaching power, the damage of clothes, coloration, the discoloration of clothes and cleaning power for the respective bleaching detergent compositions were evaluated by methods described below. The results are summarized in Tables 6 to 11.

Evaluation Method (I) Preparation of Cloth Stained with Curry

It is similar to that described in the column of "(I) Preparation of cloth stained with curry" of the bleach composition.

(II) Preparation of Cloth Stained with Bilirubin 0.06 g of bilirubin (reagent manufactured by TOKYO KASEI KOGYO Co., Ltd.) was dispersed in 100 mL of chloroform to be dissolved. 0.14 mL of the solution was added dropwise to one sheet of cotton cloth (the whole width of #20) with a size of 6×6 cm and it was naturally dried and then left alone at room temperature over day and night by shielding light to obtain a cloth stained with bilirubin.

(III) Bleaching Power (1) Bleaching Power for a Cloth Stained with Curry (Bleaching Power 1)

A Terg-O-Tometer of U.S. Testing Co. was used, 5 sheets of clothes (5×5 cm) stained with curry which were obtained by the above-mentioned (I) preparation of cloth stained with curry and knitted cloth were charged thereto, and a bath ratio was adjusted to 30-fold. After 900 ml of water with a predetermined hardness and temperature (Germany 3° DH (prepared by dissolving calcium chloride in ion-exchanged water) and 25° C.) was charged thereto, 1.35 g of the bleaching detergent compositions shown in Tables 6 to 11 was added, followed by washing for 15 minutes at 120 rpm, rinsing with running water for 1 minute and drying by dehydration.

The reflection coefficients of original cloth and clothes before and after rinse were measured with NDR-101DP manufactured by NIPPON DENSHOKU Industries Co., Ltd. using a filter of 460 nm, bleaching power was determined by the following formula and the evaluation of bleaching performance was carried out. Bleaching power was evaluated based on the following basis by determining the average value of bleaching power for 5 sheets of stained clothes.

Bleaching power (%)=(reflection coefficient after bleaching treatment−reflection coefficient before bleaching treatment)/(reflection coefficient of original cloth−reflection coefficient before bleaching treatment)×100

[Evaluation Standards]

×: Bleaching power is lower in comparison with a standard composition.

Δ: Bleaching power is equal or higher in comparison with a standard composition by 0% or more to less than 10%.

○: Bleaching power is higher in comparison with a standard composition by 10% or more to less than 15%.

◎: Bleaching power is remarkably higher in comparison with a standard composition by 15% or more.

Standard Composition:

4% of sodium percarbonate, 94% of the group A of particles containing surfactants and 2% of enzyme A (bleaching power is 35%).

(2) Bleaching Power for a Cloth Stained with Bilirubin (Bleaching Power 2)

A Terg-O-Tometer of U.S. Testing Co. was used, 5 sheets of clothes (6×6 cm) stained with bilirubin which were obtained by the above-mentioned (II) preparation of cloth stained with bilirubin and knitted cloth were charged thereto, and a bath ratio was adjusted to 30-fold. After 900 ml of water with a predetermined hardness and temperature (Germany 3° DH (prepared by dissolving calcium chloride in ion-exchanged water) and 25° C.) was charged thereto, 0.6 g of the bleaching detergent compositions shown in Tables 6 to 11 was added, followed by washing for 10 minutes at 120 rpm, rinsing with running water for 1 minute and drying by dehydration.

The reflection coefficients of original cloth and clothes before and after rinse were measured with NDR-101DP manufactured by NIPPON DENSHOKU Industries Co., Ltd., using a filter of 460 nm, bleaching power was determined by the following formula and the evaluation of bleaching performance was carried out. Bleaching power was evaluated based on the following basis by determining the average value of bleaching power for 5 sheets of stained clothes.

Bleaching power (%)=(reflection coefficient after bleaching treatment−reflection coefficient before bleaching treatment)/(reflection coefficient of original cloth−reflection coefficient before bleaching treatment)×100

[Evaluation Standards]

×: Bleaching power is lower in comparison with a standard composition.

Δ: Bleaching power is equal or higher in comparison with a standard composition by 0% or more to less than 10%.

○: Bleaching power is higher in comparison with a standard composition by 10% or more to less than 15%.

◎: Bleaching power is remarkably higher in comparison with a standard composition by 15% or more.

Standard composition (25° C., 3° DH, washing for 10 minutes):

4% of sodium percarbonate, 94% of the group A of particles containing surfactants and 2% of enzyme A (bleaching power is 45%).

(IV) Damage and Coloration of Clothes

Damage and coloration tests with respect to the bleaching detergent compositions shown in Tables 6 to 11 were carried out similarly to the aforementioned <Bleach composition>, (III) Damage and coloration of clothes except that "the bleaching detergent compositions" were used in place of "the powder bleach composition".

(V) Discoloration

Discoloration tests with respect to the bleaching detergent compositions shown in Tables 6 to 11 were carried out similarly to the aforementioned <Bleach composition>, (IV) Discoloration except that "the bleaching detergent compositions" were used in place of "the powder bleach composition".

(VI) Cleaning Power

A Terg-O-Tometer of U.S. Testing Co. was used, 10 sheets of artificially stained clothes (Hirano Oil and Fats Co.) and a knitted cloth were charged thereto, and a bath ratio was adjusted to 30-fold. After 900 ml of water with a predetermined hardness and temperature (Germany 3° DH (prepared by dissolving calcium chloride in ion-exchanged water) and 25° C.) was charged thereto, 0.6 g of the bleaching detergent compositions shown in Tables 6 to 11 was added, followed by washing for 10 minutes at 120 rpm, then rinsing with running water for 1 minute and drying by dehydration to obtain cleaned clothes.

Cleaning power was determined by Kubelka Munk formula shown below represented by the under-description.

Kubelka Munk Formula:

Cleaning power (%)=(*K/S* before cleaning)−(*K/S* after cleaning)/(*K/S* before cleaning)−(*K/S* of original cloth)×100

Wherein $K/S=(1-R)^2/2R$ and R is a reflection coefficient measured by using a calorimeter Σ-90 manufactured by NIPPON DENSHOKU. Further, the evaluation of cleaning power was carried out by the average value of 10 sheets of test clothes. Further, evaluation basis was set below.

[Basis of Cleaning Power]

◎: 75% or more

○: 50% or more to less than 75%

×: Less than 50%

Further, the properties and the like of respective particles and the detergent compositions were measured as described below. The results of Examples and Comparative Examples are summarized in Tables 6 to 11.

(VII) Measurement of Average Particle Size

A classification operation for each sample and mixture was carried out using sieves piled up in nine layers, that is, sieves with 1680 μm, 1410 μm, 1190 μm, 1000 μm, 710 μm, 500 μm, 350 μm, 250 μm, 149 μm and a receiving pan. The operation was conducted with the receiving pan on bottom, piling up from the smallest-mesh sieve to the largest-mesh sieve on top and the base sample of 100 g/time was placed in the 1608 μm mesh sieve on top with its cover on, which was attached to Ro-Tap Sieve Shaker (manufactured by IIDA SEISAKUSYO, tapping: 156 times/min, rolling: 290 times/min). It was shaken for 10 minutes, and then the sample remaining in the sieves and the receiving pan was collected from each sieve and the mass of the sample was measured.

When the mass-frequency of the sample remaining on the receiving pan and the sieves was added up, and the add-up mass-frequency reached 50% or more, the mesh size of that sieve was referred to as "a μm", the mesh size one size larger than "a μm" was referred to as "b μm", the mass-frequency added from sample remaining on the receiving pan to sample remaining in a sieve with a mesh size of "a μm" was referred to as "d %", and the average particle size (50% by mass) was determined by the following formula.

$$\text{Average particle size (50\% by mass)}=10^{(50-(c-d/(\log b-\log a)\times\log b))/(d/(\log b-\log a))}$$

(VIII) Measurement of Bulk Density

The bulk density of respective samples and a mixture thereof was measured according to JIS K3362.

TABLE 6

| Composition(%) | | | Examples 36 | 37 | 38 | 39 | 40 | 41 | 42 | 43 | 44 |
|---|---|---|---|---|---|---|---|---|---|---|---|
| Sodium percarbonate | | | 4 | 4 | 4 | 4 | 4 | 4 | 4 | 10 | 13 |
| Powder | | Type | 1 | 1 | 1 | 1 | 1 | 1 | 2 | 1 | 1 |
| | | Amount | 5 | 5 | 5 | 5 | 5 | 5 | 5 | 5 | 5 |
| Bleaching activating catalyst (not granulated) | | Type | 1 | 2 | 3 | 4 | 5 | 6 | 2 | 2 | 2 |
| | | Amount | 0.1 | 0.1 | 0.1 | 0.1 | 0.1 | 0.1 | 0.1 | 0.1 | 0.1 |
| Granulated substance | | Type | — | — | — | — | — | — | — | — | — |
| | | Amount | — | — | — | — | — | — | — | — | — |
| Granulated substance of bleaching activator | | Type | — | — | — | — | — | — | — | — | — |
| | | Amount | — | — | — | — | — | — | — | — | — |
| Other components | HEDP-4Na | | — | — | — | — | — | — | — | — | — |
| | EDTMP | | — | — | — | — | — | — | — | — | — |
| | Sodium tetraborate | | — | — | — | — | — | — | — | — | — |
| | Sodium citrate | | — | — | — | — | — | — | — | — | — |
| | Cationic surfactant | | — | — | — | — | — | — | — | — | — |
| | Bentonite | | — | — | — | — | — | — | — | — | — |
| | Enzyme | Type | A | A | A | A | A | A | B | B | B |
| | | Amount | 2 | 2 | 2 | 2 | 2 | 2 | 2 | 2 | 2 |
| | Amorphous silicate | Type | — | — | — | — | — | — | — | — | — |
| | | Amount | — | — | — | — | — | — | — | — | — |
| Particle group containing surfactant | | Type | A | A | A | A | A | A | A | A | A |
| | | Amount | | | | | Residue | | | | |
| Total | | | | | | | 100 | | | | |
| Bleaching power 1 [curry] | | | ◎ | ◎ | ◎ | ◎ | ◎ | ◎ | ◎ | ◎ | ◎ |
| Bleaching power 2 [pilirubin] | | | ○ | ○ | ○ | ○ | ○ | ○ | ○ | ○ | ○ |
| Damage of clothes | | | 6 | 6 | 6 | 6 | 6 | 6 | 6 | 6 | 6 |
| Coloration | | | ○ | ○ | ○ | ○ | ○ | ○ | ○ | ○ | ○ |
| Discoloration of clothes | | | 4 | 4 | 4 | 4 | 4 | 4 | 4 | 4 | 4 |
| Cleaning power | | | ◎ | ◎ | ◎ | ◎ | ◎ | ◎ | ◎ | ◎ | ○ |
| Surfactant (%) | | | 29 | 29 | 29 | 29 | 29 | 29 | 29 | 27 | 26 |
| Average particle size (μm) | | | 519 | 519 | 519 | 519 | 519 | 519 | 519 | 531 | 537 |
| Bulk density (g/mL) | | | 0.82 | 0.82 | 0.82 | 0.82 | 0.82 | 0.82 | 0.82 | 0.82 | 0.82 |

| Composition(%) | | | Examples 45 | 46 | 47 | 48 | Comparative Examples 12 | 13 | 14 | 15 |
|---|---|---|---|---|---|---|---|---|---|---|
| Sodium percarbonate | | | 18 | 3 | 4 | 4 | 4 | 10 | 18 | 4 |
| Powder | | Type | 1 | 1 | 1 | 1 | — | 1 | — | — |
| | | Amount | 5 | 5 | 5 | 5 | — | 5 | — | — |
| Bleaching activating catalyst (not granulated) | | Type | 2 | 2 | 2 | 2 | — | — | 1 | 2 |
| | | Amount | 0.1 | 0.05 | 0.3 | 0.01 | — | — | 0.1 | 0.1 |
| Granulated | | Type | — | — | — | — | — | — | — | — |

TABLE 6-continued

| | | | | | | | | | | |
|---|---|---|---|---|---|---|---|---|---|---|
| substance | | Amount | — | — | — | — | — | — | — | — |
| Granulated substance of bleaching activator | | Type | — | — | — | — | — | — | — | — |
| | | Amount | — | — | — | — | — | — | — | — |
| Other components | HEDP-4Na | | — | — | — | — | — | — | — | — |
| | EDTMP | | — | — | — | — | — | — | — | — |
| | Sodium tetraborate | | — | — | — | — | — | — | — | — |
| | Sodium citrate | | — | — | — | — | — | — | — | — |
| | Cationic surfactant | | — | — | — | — | — | — | — | — |
| | Bentonite | | — | — | — | — | — | — | — | — |
| | Enzyme | Type | B | B | B | B | A | A | A | A |
| | | Amount | 2 | 2 | 2 | 2 | 3 | 2 | 2 | 2 |
| | Amorphous silicate | Type | — | — | — | — | — | — | — | A |
| | | Amount | — | — | — | — | — | — | — | 30 |
| Particle group containing surfactant | | Type | A | A | A | A | A | A | A | A |
| | | Amount | Residue | | | | | | | |
| Total | | | 100 | | | | | | | |
| Bleaching power 1 [curry] | | | ◎ | ◎ | ◎ | ○ | Δ | Δ | ◎ | ◎ |
| Bleaching power 2 [pilirubin] | | | ○ | ○ | ○ | ○ | Δ | Δ | ○ | ○ |
| Damage of clothes | | | 6 | 6 | 6 | 6 | 6 | 6 | 1 | 1 |
| Coloration | | | ○ | ○ | ○ | ○ | ○ | ○ | ○ | ○ |
| Discoloration of clothes | | | 4 | 4 | 4 | 4 | 5 | 5 | 2 | 2 |
| Cleaning power | | | ○ | ◎ | ◎ | ◎ | ◎ | ◎ | ○ | ○ |
| Surfactant (%) | | | 25 | 30 | 29 | 29 | 31 | 27 | 26 | 21 |
| Average particle size (μm) | | | 547 | 517 | 518 | 519 | 542 | 532 | 574 | 381 |
| Bulk density (g/mL) | | | 0.82 | 0.82 | 0.82 | 0.82 | 0.84 | 0.82 | 0.84 | 0.89 |

TABLE 7

| | | | Examples | | | | | | | | |
|---|---|---|---|---|---|---|---|---|---|---|---|
| Composition(%) | | | 49 | 50 | 51 | 52 | 53 | 54 | 55 | 56 | 57 |
| Sodium percarbonate | | | 4 | 4 | 4 | 4 | 4 | 4 | 4 | 4 | 10 |
| Powder | | Type | — | — | — | — | — | — | — | — | — |
| | | Amount | — | — | — | — | — | — | — | — | — |
| Bleaching activating catalyst (not granulated) | | Type | — | — | — | — | — | — | — | — | — |
| | | Amount | — | — | — | — | — | — | — | — | — |
| Granulated substance | | Type | 3 | 4 | 5 | 6 | 7 | 12 | 14 | 15 | 4 |
| | | Amount | 1 | 1 | 1 | 1 | 1 | 1 | 1 | 1 | 1 |
| Granulated substance of bleaching activator | | Type | — | — | — | — | — | — | — | — | — |
| | | Amount | — | — | — | — | — | — | — | — | — |
| Other components | HEDP-4Na | | — | — | — | — | — | — | — | — | — |
| | EDTMP | | — | — | — | — | — | — | — | — | — |
| | Sodium tetraborate | | — | — | — | — | — | — | — | — | — |
| | Sodium citrate | | — | — | — | — | — | — | — | — | — |
| | Cationic surfactant | | — | — | — | — | — | — | — | — | — |
| | Bentonite | | — | — | — | — | — | — | — | — | — |
| | Enzyme | Type | A | A | A | A | A | A | A | A | A |
| | | Amount | 2 | 2 | 2 | 2 | 2 | 2 | 2 | 2 | 2 |
| | Amorphous silicate | Type | — | — | — | — | — | — | — | — | — |
| | | Amount | — | — | — | — | — | — | — | — | — |
| Particle group containing surfactant | | Type | A | A | A | A | A | A | A | A | A |
| | | Amount | Reside | | | | | | | | |
| Total | | | 100 | | | | | | | | |
| Bleaching power 1 [curry] | | | ◎ | ◎ | ◎ | ◎ | ◎ | ◎ | ◎ | ◎ | ◎ |
| Bleaching power 2 [pilirubin] | | | ○ | ○ | ○ | ○ | ○ | ○ | ○ | ○ | ○ |
| Damage of clothes | | | 6 | 6 | 6 | 6 | 6 | 6 | 6 | 6 | 6 |
| Coloration | | | ○ | ○ | ○ | ○ | ○ | ○ | ○ | ○ | ○ |

TABLE 7-continued

| | | | | | | | | | | |
|---|---|---|---|---|---|---|---|---|---|---|
| Discoloration of clothes | | 5 | 5 | 5 | 5 | 5 | 5 | 5 | 5 | 5 |
| Cleaning power | | ◎ | ◎ | ◎ | ◎ | ◎ | ◎ | ◎ | ◎ | ◎ |
| Surfactant (%) | | 31 | 31 | 31 | 31 | 31 | 31 | 31 | 31 | 29 |
| Average particle size (μm) | | 542 | 542 | 542 | 542 | 542 | 542 | 542 | 542 | 554 |
| Bulk density (g/mL) | | 0.84 | 0.84 | 0.84 | 0.84 | 0.84 | 0.84 | 0.84 | 0.84 | 0.84 |
| | | | Examples | | | | Comparative Examples | | | |
| Composition(%) | | | 58 | 59 | 60 | 61 | 16 | 17 | 18 | 19 |
| Sodium percarbonate | | | 16 | 3 | 4 | 4 | 4 | 4 | 10 | 4 |
| Powder | | Type | — | — | — | — | — | — | — | — |
| | | Amount | — | — | — | — | — | — | — | — |
| Bleaching activating catalyst (not granulated) | | Type | — | — | — | — | — | — | — | — |
| | | Amount | — | — | — | — | — | — | — | — |
| Granulated substance | | Type | 4 | 5 | 4 | 4 | 1 | 8 | 9 | 13 |
| | | Amount | 1 | 1 | 0.5 | 0.1 | 1 | 1 | 1 | 1 |
| Granulated substance of bleaching activator | | Type | — | — | — | — | — | — | — | — |
| | | Amount | — | — | — | — | — | — | — | — |
| Other components | HEDP-4Na | | — | — | — | — | — | — | — | — |
| | EDTMP | | — | — | — | — | — | — | — | — |
| | Sodium tetraborate | | — | — | — | — | — | — | — | — |
| | Sodium citrate | | — | — | — | — | — | — | — | — |
| | Cationic surfactant | | — | — | — | — | — | — | — | — |
| | Bentonite | | — | — | — | — | — | — | — | — |
| | Enzyme | Type | A | A | A | A | A | A | A | A |
| | | Amount | 2 | 2 | 2 | 2 | 2 | 2 | 2 | 2 |
| | Amorphous silicate | Type | — | — | — | — | — | A | A | — |
| | | Amount | — | — | — | — | — | 30 | 10 | — |
| Particle group containing surfactant | | Type | A | A | A | A | A | A | A | A |
| | | Amount | | | | Reside | | | | |
| Total | | | | | | 100 | | | | |
| Bleaching power 1 [curry] | | | ◎ | ◎ | ◎ | ○ | ◎ | ◎ | ◎ | ◎ |
| Bleaching power 2 [pilirubin] | | | ○ | ○ | ○ | ○ | ○ | ○ | ○ | ○ |
| Damage of clothes | | | 6 | 6 | 6 | 6 | 2 | 3 | 2 | 1 |
| Coloration | | | ○ | ○ | ○ | ○ | ○ | ○ | ○ | X |
| Discoloration of clothes | | | 5 | 5 | 5 | 5 | 2 | 3 | 3 | 1 |
| Cleaning power | | | ○ | ◎ | ◎ | ◎ | ◎ | ○ | ◎ | ◎ |
| Surfactant (%) | | | 27 | 31 | 31 | 31 | 31 | 21 | 25 | 31 |
| Average particle size (μm) | | | 566 | 540 | 544 | 546 | 542 | 377 | 499 | 542 |
| Bulk density (g/mL) | | | 0.83 | 0.84 | 0.84 | 0.84 | 0.84 | 0.89 | 0.85 | 0.84 |

TABLE 8

| | | | Examples | | | | | | | | |
|---|---|---|---|---|---|---|---|---|---|---|---|
| Composition(%) | | | 62 | 63 | 64 | 65 | 66 | 67 | 68 | 69 | 70 |
| Sodium percarbonate | | | 5 | 5 | 5 | 5 | 5 | 5 | 5 | 5 | 5 |
| Powder | | Type | — | — | — | — | 1 | 1 | 1 | 1 | 1 |
| | | Amount | — | — | — | — | 5 | 5 | 5 | 3 | 3 |
| Bleaching activating catalyst (not granulated) | | Type | — | — | — | — | — | — | — | — | — |
| | | Amount | — | — | — | — | — | — | — | — | — |
| Granulated substance | | Type | 4 | 4 | 4 | 4 | 4/11 | 4 | 4 | 4 | 4 |
| | | Amount | 1 | 1 | 1 | 1 | 0.5/0.3 | 0.5 | 1 | 0.5 | 0.5 |
| Granulated substance of bleaching activator | | Type | — | — | — | — | — | D | D | B | B |
| | | Amount | — | — | — | — | — | 0.3 | 0.2 | 0.5 | 0.5 |
| Other | HEDP-4Na | | — | — | — | — | — | — | — | — | — |

TABLE 8-continued

| | | | | | | | | | | | |
|---|---|---|---|---|---|---|---|---|---|---|---|
| components | EDTMP | | — | — | — | — | — | — | — | — | — |
| | Sodium tetraborate | | — | — | — | — | — | — | — | — | — |
| | Sodium citrate | | — | — | — | — | — | — | — | — | — |
| | Cationic surfactant | | — | — | — | 1 | — | — | — | — | — |
| | Bentonite | | — | — | — | — | — | — | — | — | — |
| | Enzyme | Type | A | A | A | A | A | A | A | A | B |
| | | Amount | 2 | 2 | 2 | 2 | 1 | 1 | 2 | 2 | 2 |
| | Amorphous silicate | Type | — | — | — | — | — | — | — | — | — |
| | | Amount | — | — | — | — | — | — | — | — | — |
| Particle group containing surfactant | | Type | B | C | D | E | F | G | H | B | C |
| | | Amount | | | | | Residue | | | | |
| Total | | | | | | | 100 | | | | |
| Bleaching power 1 [curry] | | | ◎ | ◎ | ◎ | ◎ | ◎ | ◎ | ◎ | ◎ | ◎ |
| Bleaching power 2 [pilirubin] | | | ○ | ○ | ○ | ○ | ◎ | ◎ | ◎ | ◎ | ◎ |
| Damage of clothes | | | 6 | 6 | 6 | 6 | 6 | 6 | 6 | 6 | 6 |
| Coloration | | | ○ | ○ | ○ | ○ | ○ | ○ | ○ | ○ | ○ |
| Discoloration of clothes | | | 5 | 5 | 5 | 5 | 5 | 5 | 5 | 5 | 5 |
| Cleaning power | | | ○ | ◎ | ○ | ○ | ○ | ○ | ○ | ○ | ◎ |
| Surfactant (%) | | | 24 | 29 | 22 | 22 | 17 | 18 | 21 | 23 | 28 |
| Average particle size (μm) | | | 544 | 534 | 314 | 402 | 367 | 346 | 385 | 527 | 518 |
| Bulk density (g/mL) | | | 0.86 | 0.77 | 0.76 | 0.78 | 0.50 | 0.52 | 0.79 | 0.85 | 0.77 |

| | | | Examples | | | | Comparative Examples | | | |
|---|---|---|---|---|---|---|---|---|---|---|
| Composition(%) | | | 71 | 72 | 73 | 74 | 20 | 21 | 22 | 23 |
| Sodium percarbonate | | | 5 | 5 | 5 | 5 | 5 | 5 | 5 | 5 |
| Powder | | Type | 1 | 1 | 1 | 1 | — | — | — | — |
| | | Amount | 3 | 5 | 4 | 4 | — | — | — | — |
| Bleaching activating catalyst (not granulated) | | Type | — | — | — | — | — | — | — | — |
| | | Amount | — | — | — | — | — | — | — | — |
| Granulated substance | | Type | 4 | 4 | 4 | 4 | — | — | — | — |
| | | Amount | 0.5 | 0.5 | 0.5 | 0.1 | — | — | — | — |
| Granulated substance of bleaching activator | | Type | C | D | E | F | A | C | — | — |
| | | Amount | 0.3 | 0.5 | 0.5 | 0.5 | 0.5 | 0.3 | — | — |
| Other components | HEDP-4Na | | — | — | — | — | — | — | — | — |
| | EDTMP | | — | — | — | — | — | — | — | — |
| | Sodium tetraborate | | — | — | — | — | — | — | — | — |
| | Sodium citrate | | — | — | — | — | — | — | — | — |
| | Cationic surfactant | | — | 3 | — | — | — | — | — | — |
| | Bentonite | | — | — | — | — | — | — | — | — |
| | Enzyme | Type | A | A | A | A | A | A | A | A |
| | | Amount | 2 | 2 | 2 | 2 | 2 | 2 | 2 | 2 |
| | Amorphous silicate | Type | — | — | — | — | — | — | — | A |
| | | Amount | — | — | — | — | — | — | — | 40 |
| Particle group containing surfactant | | Type | D | E | D | D | B | D | F | H |
| | | Amount | | | | Residue | | | | |
| Total | | | | | | 100 | | | | |
| Bleaching power 1 [curry] | | | ◎ | ◎ | ◎ | ○ | Δ | Δ | Δ | Δ |
| Bleaching power 2 [pilirubin] | | | ◎ | ◎ | ◎ | ◎ | ○ | ○ | Δ | Δ |
| Damage of clothes | | | 6 | 6 | 6 | 6 | 6 | 6 | 6 | 6 |
| Coloration | | | ○ | ○ | ○ | ○ | ○ | ○ | ○ | ○ |
| Discoloration of clothes | | | 5 | 5 | 5 | 5 | 2 | 5 | 5 | 5 |
| Cleaning power | | | ○ | ○ | ○ | ○ | ○ | ○ | ○ | X |
| Surfactant (%) | | | 21 | 22 | 21 | 21 | 24 | 22 | 17 | 13 |
| Average particle size (μm) | | | 305 | 374 | 302 | 303 | 546 | 316 | 363 | 250 |
| Bulk density (g/mL) | | | 0.75 | 0.76 | 0.75 | 0.75 | 0.86 | 0.79 | 0.51 | 0.88 |

TABLE 9

| Composition(%) | | | Examples 75 | 76 | 77 | 78 | 79 | 80 | 81 | 82 | 83 |
|---|---|---|---|---|---|---|---|---|---|---|---|
| Percarbonate | | | 15 | 15 | 15 | 15 | 15 | 15 | 15 | 15 | 15 |
| Powder | | Type | — | — | — | — | 1 | 1 | 1 | 1 | 1 |
| | | Amount | — | — | — | — | 5 | 5 | 5 | 3 | 3 |
| Bleaching activating catalyst (not granulated) | | Type | — | — | — | — | — | — | — | — | — |
| | | Amount | — | — | — | — | — | — | — | — | — |
| Granulated substance | | Type | 4 | 4 | 4 | 4 | 4/11 | 4 | 4 | 4 | 4 |
| | | Amount | 1 | 1 | 1 | 1 | 0.5/0.3 | 0.5 | 1 | 0.5 | 0.5 |
| Granulated substance of bleaching activator | | Type | — | — | — | — | — | D | D | B | B |
| | | Amount | — | — | — | — | — | 0.3 | 0.2 | 0.5 | 0.5 |
| Other components | HEDP-4Na | | — | — | — | — | — | — | — | 1 | — |
| | EDTMP | | — | — | — | — | — | — | — | — | 1 |
| | Sodium tetraborate | | — | — | — | — | — | — | — | — | 2 |
| | Sodium citrate | | 3 | 3 | 3 | 3 | 3 | 3 | 3 | 3 | 3 |
| | Cationic surfactant | | — | — | — | — | — | — | — | 1 | 1 |
| | Bentonite | | — | — | 3 | — | — | — | — | — | — |
| | Enzyme | Type | A | A | A | A | A | A | A | A | A |
| | | Amount | 3 | 3 | 3 | 3 | 3 | 3 | 3 | 3 | 3 |
| | Amorphous silicate | Type | A | B | C | D | E | E | E | A | A |
| | | Amount | 5 | 5 | 5 | 5 | 5 | 5 | 5 | 3 | 3 |
| Particle group containing surfactant | | Type | A | A | A | B | B | C | D | E | E |
| | | Amount | | | | | Residue | | | | |
| Total | | | | | | | 100 | | | | |
| Bleaching power 1 [curry] | | | ◎ | ◎ | ◎ | ◎ | ◎ | ◎ | ◎ | ◎ | ◎ |
| Bleaching power 2 [pilirubin] | | | ○ | ○ | ○ | ○ | ◎ | ◎ | ◎ | ◎ | ◎ |
| Damage of clothes | | | 6 | 6 | 6 | 6 | 6 | 6 | 6 | 6 | 6 |
| Coloration | | | ○ | ○ | ○ | ○ | ○ | ○ | ○ | ○ | ○ |
| Discoloration of clothes | | | 5 | 5 | 5 | 5 | 5 | 5 | 5 | 5 | 5 |
| Cleaning power | | | ◎ | ◎ | ◎ | ○ | ○ | ◎ | ○ | ○ | ○ |
| Surfactant (%) | | | 24 | 24 | 23 | 19 | 18 | 21 | 16 | 17 | 17 |
| Average particle size (μm) | | | 514 | 514 | 498 | 514 | 488 | 481 | 316 | 393 | 385 |
| Bulk density (g/mL) | | | 0.83 | 0.83 | 0.82 | 0.85 | 0.83 | 0.77 | 0.75 | 0.77 | 0.77 |

| Composition(%) | | | Examples 84 | 85 | 86 | 87 | Comparative Examples 24 | 25 | 26 | 27 |
|---|---|---|---|---|---|---|---|---|---|---|
| Percarbonate | | | 12 | 15 | 15 | 15 | 15 | 15 | 15 | 15 |
| Powder | | Type | 1 | 1 | 1 | 1 | — | — | — | — |
| | | Amount | 3 | 5 | 4 | 4 | — | — | — | — |
| Bleaching activating catalyst (not granulated) | | Type | — | — | — | — | — | — | — | — |
| | | Amount | — | — | — | — | — | — | — | — |
| Granulated substance | | Type | 4 | 4 | 4 | 4 | — | — | 8 | 9 |
| | | Amount | 0.5 | 0.5 | 0.5 | 0.1 | — | — | 0.5 | 0.5 |
| Granulated substance of bleaching activator | | Type | B | D | E | F | — | D | — | — |
| | | Amount | 0.3 | 0.5 | 0.5 | 0.5 | — | 0.2 | — | — |
| Other components | HEDP-4Na | | — | — | 1 | 1 | — | — | — | — |
| | EDTMP | | — | — | — | — | — | — | — | — |
| | Sodium tetraborate | | — | — | 2 | — | — | — | — | — |
| | Sodium citrate | | — | — | 3 | 3 | 3 | 3 | 3 | 3 |
| | Cationic surfactant | | — | — | — | — | — | — | — | — |
| | Bentonite | | — | — | — | — | — | — | — | — |
| | Enzyme | Type | A | A | A | A | A | A | A | A |
| | | Amount | 3 | 3 | 3 | 3 | 3 | 3 | 3 | 3 |
| | Amorphous silicate | Type | A | A | A | E | — | E | A | A |
| | | Amount | 1 | 1 | 3 | 3 | — | 5 | 1 | 50 |

TABLE 9-continued

| | | | | | | | | | |
|---|---|---|---|---|---|---|---|---|---|
| Particle group containing surfactant | Type | F | G | H | H | B | D | F | H |
| | Amount | | | | Residue | | | | |
| Total | | | | | 100 | | | | |
| Bleaching power 1 [curry] | | ◎ | ◎ | ◎ | ○ | Δ | Δ | Δ | Δ |
| Bleaching power 2 [pilirubin] | | ◎ | ◎ | ◎ | ○ | Δ | ○ | ○ | ○ |
| Damage of clothes | | 6 | 6 | 6 | 6 | 5 | 6 | 3 | 2 |
| Coloration | | ○ | ○ | ○ | ○ | ○ | ○ | ○ | ○ |
| Discoloration of clothes | | 5 | 5 | 5 | 5 | 2 | 5 | 3 | 3 |
| Cleaning power | | ○ | ○ | ○ | ○ | ○ | ○ | X | X |
| Surfactant (%) | | 14 | 15 | 16 | 17 | 21 | 18 | 14 | 7 |
| Average particle size (μm) | | 371 | 375 | 385 | 394 | 547 | 334 | 384 | 227 |
| Bulk density (g/mL) | | 0.54 | 0.57 | 0.78 | 0.79 | 0.84 | 0.77 | 0.55 | 0.90 |

TABLE 10

| | | | Examples | | | | | | | | |
|---|---|---|---|---|---|---|---|---|---|---|---|
| Composition(%) | | | 88 | 89 | 90 | 91 | 92 | 93 | 94 | 95 | 96 |
| Percarbonate | | | 5 | 5 | 5 | 5 | 5 | 5 | 5 | 5 | 5 |
| Powder | | Type | — | — | — | — | 1 | 1 | 1 | 1 | 1 |
| | | Amount | — | — | — | — | 5 | 5 | 5 | 3 | 3 |
| Bleaching activating catalyst (no granulated) | | Type | — | — | — | — | — | — | — | — | — |
| | | Amount | — | — | — | — | — | — | — | — | — |
| Granulated substance | | Type | 17 | 18 | 19 | 20 | 17 | 18 | 19 | 20 | 17 |
| | | Amount | 1 | 1 | 2 | 1 | 1 | 1 | 2 | 1 | 1 |
| Granulated substance of bleaching activator | | Type | — | — | — | — | D | D | D | D | B |
| | | Amount | — | — | — | — | 0.3 | 0.3 | 0.2 | 0.5 | 0.5 |
| Other components | HEDP-4Na | | — | — | — | — | — | — | — | — | — |
| | EDTMP | | — | — | — | — | — | — | — | — | — |
| | Sodium tetraborate | | — | — | — | — | — | — | — | — | — |
| | Sodium citrate | | — | — | — | — | — | — | — | — | — |
| | Cationic surfactant | | — | — | — | 1 | — | — | — | — | — |
| | Bentonite | | — | — | — | — | — | — | — | — | — |
| | Enzyme | Type | A | A | A | A | A | A | A | A | A |
| | | Amount | 2 | 2 | 2 | 2 | 1 | 1 | 2 | 2 | 2 |
| | Amorphous silicate | Type | — | — | — | — | — | — | — | — | — |
| | | Amount | — | — | — | — | — | — | — | — | — |
| Particle group containing surfactant | | Type | A | A | A | A | B | B | B | B | C |
| | | Amount | | | | | Residue | | | | |
| Total | | | | | | | 100 | | | | |
| Bleaching power 1 [curry] | | | ◎ | ◎ | ◎ | ◎ | ◎ | ◎ | ◎ | ◎ | ◎ |
| Bleaching power 2 [pilirubin] | | | ○ | ○ | ○ | ○ | ◎ | ◎ | ◎ | ◎ | ◎ |
| Damage of clothes | | | 6 | 6 | 6 | 6 | 6 | 6 | 6 | 6 | 6 |
| Coloration | | | ○ | ○ | ○ | ○ | ○ | ○ | ○ | ○ | ○ |
| Discoloration of clothes | | | 5 | 5 | 5 | 5 | 5 | 5 | 5 | 5 | 5 |
| Cleaning power | | | ◎ | ◎ | ◎ | ◎ | ○ | ○ | ○ | ○ | ◎ |
| Surfactant (%) | | | 30 | 30 | 30 | 31 | 23 | 23 | 22 | 23 | 27 |
| Average particle size (μm) | | | 544 | 544 | 538 | 538 | 520 | 520 | 509 | 524 | 515 |
| Bulk density (g/mL) | | | 0.84 | 0.84 | 0.83 | 0.83 | 0.84 | 0.84 | 0.83 | 0.84 | 0.76 |

| | | | Examples | | | | Comparative Examples | | | |
|---|---|---|---|---|---|---|---|---|---|---|
| Composition(%) | | | 97 | 98 | 99 | 100 | 28 | 29 | 30 | 31 |
| Percarbonate | | | 5 | 5 | 5 | 5 | 5 | 5 | 5 | 5 |
| Powder | | Type | 1 | 1 | 1 | 1 | 1 | — | — | — |
| | | Amount | 3 | 5 | 4 | 4 | 20 | — | — | — |
| Bleaching activating catalyst (no | | Type | — | — | — | — | — | — | — | — |
| | | Amount | — | — | — | — | — | — | — | — |

TABLE 10-continued

| | | | | | | | | | | |
|---|---|---|---|---|---|---|---|---|---|---|
| granulated) | | | | | | | | | | |
| Granulated substance | | Type | 18 | 19 | 21 | 20 | — | — | — | — |
| | | Amount | 1 | 2 | 1 | 1 | — | — | — | — |
| Granulated substance of bleaching activator | | Type | B | B | D | F | A | — | A | — |
| | | Amount | 0.3 | 0.5 | 0.5 | 0.5 | 0.5 | — | 0.5 | — |
| Other components | HEDP-4Na | | — | — | — | — | — | — | — | — |
| | EDTMP | | — | — | — | — | — | — | — | — |
| | Sodium tetraborate | | — | — | — | — | — | — | — | — |
| | Sodium citrate | | — | — | — | — | — | — | — | — |
| | Cationic surfactant | | — | 3 | — | — | — | — | — | — |
| | Bentonite | | — | — | — | — | — | — | — | — |
| | Enzyme | Type | A | A | A | A | A | A | A | A |
| | | Amount | 2 | 2 | 2 | 2 | 2 | 2 | 2 | 2 |
| | Amorphous silicate | Type | — | — | — | — | — | — | — | — |
| | | Amount | — | — | — | — | — | — | — | — |
| Particle group containing surfactant | | Type | C | C | D | H | C | C | H | H |
| | | Amount | | | | Residue | | | | |
| Total | | | | | | 100 | | | | |
| Bleaching power 1 [curry] | | | ◎ | ◎ | ○ | ○ | Δ | Δ | Δ | Δ |
| Bleaching power 2 [pilirubin] | | | ◎ | ◎ | ○ | ◎ | ○ | Δ | ○ | Δ |
| Damage of clothes | | | 6 | 6 | 6 | 6 | 6 | 6 | 6 | 6 |
| Coloration | | | ○ | ○ | ○ | ○ | ○ | ○ | ○ | ○ |
| Discoloration of clothes | | | 5 | 5 | 5 | 5 | 5 | 5 | 3 | 5 |
| Cleaning power | | | ◎ | ◎ | ○ | ○ | ○ | ◎ | ○ | ○ |
| Surfactant (%) | | | 27 | 29 | 21 | 21 | 22 | 29 | 22 | 22 |
| Average particle size (μm) | | | 516 | 483 | 300 | 388 | 429 | 540 | 408 | 410 |
| Bulk density (g/mL) | | | 0.76 | 0.75 | 0.74 | 0.79 | 0.72 | 0.78 | 0.80 | 0.80 |

TABLE 11

| | | | Examples | | | | | | | | |
|---|---|---|---|---|---|---|---|---|---|---|---|
| Composition(%) | | | 101 | 102 | 103 | 104 | 105 | 106 | 107 | 108 | 109 |
| Percarbonate | | | 5 | 5 | 5 | 5 | 5 | 5 | 5 | 5 | 5 |
| Powder | | Type | — | — | — | — | 1 | 1 | 1 | 1 | 1 |
| | | Amount | — | — | — | — | 5 | 5 | 5 | 5 | 3 |
| Bleaching activating catalyst (no granulated) | | Type | — | — | — | — | — | — | — | — | — |
| | | Amount | — | — | — | — | — | — | — | — | — |
| Granulated substance | | Type | 17 | 18 | 19 | 20 | 17 | 18 | 19 | 20 | 17 |
| | | Amount | 1 | 1 | 2 | 1 | 1 | 1 | 2 | 1 | 1 |
| Granulated substance of bleaching activator | | Type | — | — | — | — | D | D | D | D | B |
| | | Amount | — | — | — | — | 0.3 | 0.3 | 0.2 | 0.5 | 0.5 |
| Other components | HEDP-4Na | | — | — | — | — | — | — | — | — | — |
| | EDTMP | | — | — | — | — | — | — | — | — | — |
| | Sodium tetraborate | | — | — | — | — | — | — | — | — | — |
| | Sodium citrate | | — | — | — | — | — | — | — | — | — |
| | Cationic surfactant | | — | — | — | 1 | — | — | — | — | — |
| | Bentonite | | — | — | — | — | — | — | — | — | — |
| | Enzyme | Type | A | A | A | A | B | A | A | A | A |
| | | Amount | 2 | 2 | 2 | 2 | 1 | 1 | 2 | 2 | 2 |
| | Amorphous silicate | Type | — | — | — | — | — | — | — | — | — |
| | | Amount | — | — | — | — | — | — | — | — | — |
| Particle group containing surfactant | | Type | A | A | A | A | B | B | B | B | C |
| | | Amount | 50 | 50 | 70 | 70 | 80 | 80 | 50 | 50 | 50 |
| Particle group containing surfactant | | Type | I | J | K | L | L | K | J | I | J |
| | | Amount | | | | | Residue | | | | |
| Total | | | | | | | 100 | | | | |
| Bleaching power 1 [curry] | | | ◎ | ◎ | ◎ | ◎ | ◎ | ◎ | ◎ | ◎ | ◎ |

TABLE 11-continued

| | | | | | | | | | |
|---|---|---|---|---|---|---|---|---|---|
| Bleaching power 2 [pilirubin] | ○ | ○ | ○ | ○ | ◎ | ◎ | ◎ | ◎ | ◎ |
| Damage of clothes | 6 | 6 | 6 | 6 | 6 | 6 | 6 | 6 | 6 |
| Coloration | ○ | ○ | ○ | ○ | ○ | ○ | ○ | ○ | ○ |
| Discoloration of clothes | 5 | 5 | 5 | 5 | 5 | 5 | 5 | 5 | 5 |
| Cleaning power | ◎ | ◎ | ◎ | ◎ | ○ | ○ | ○ | ◎ | ◎ |
| Surfactant (%) | 31 | 27 | 28 | 30 | 23 | 23 | 22 | 26 | 25 |
| Average particle size (μm) | 472 | 548 | 502 | 500 | 506 | 507 | 513 | 451 | 523 |
| Bulk density (g/mL) | 0.67 | 0.80 | 0.80 | 0.81 | 0.79 | 0.79 | 0.76 | 0.65 | 0.73 |

| | | | Examples | | | | Comparative Examples | | | |
|---|---|---|---|---|---|---|---|---|---|---|
| Composition(%) | | | 110 | 111 | 112 | 113 | 32 | 33 | 34 | 35 |
| Percarbonate | | | 5 | 5 | 5 | 5 | 5 | 5 | 5 | 5 |
| Powder | | Type | 1 | 1 | 1 | 1 | 1 | — | — | — |
| | | Amount | 3 | 3 | 3 | 4 | 10 | — | — | — |
| Bleaching activating catalyst (no granulated) | | Type | — | — | — | — | — | — | — | — |
| | | Amount | — | — | — | — | — | — | — | — |
| Granulated substance | | Type | 18 | 19 | 20 | 21 | — | — | — | — |
| | | Amount | 1 | 2 | 1 | 1 | — | — | — | — |
| Granulated substance of bleaching activator | | Type | B | B | B | E | A | — | A | — |
| | | Amount | 0.3 | 0.5 | 0.5 | 0.5 | 0.5 | — | 0.5 | — |
| Other components | HEDP-4Na | | — | — | — | — | — | — | — | — |
| | EDTMP | | — | — | — | — | — | — | — | — |
| | Sodium tetraborate | | — | — | — | — | — | — | — | — |
| | Sodium citrate | | — | — | — | — | — | — | — | — |
| | Cationic surfactant | | — | 3 | — | — | — | — | — | — |
| | Bentonite | | — | — | — | — | — | — | — | — |
| | Enzyme | Type | A | A | A | B | A | A | A | B |
| | | Amount | 2 | 2 | 2 | 2 | 2 | 2 | 2 | 2 |
| | Amorphous silicate | Type | — | — | — | — | — | — | — | — |
| | | Amount | — | — | — | — | — | — | — | — |
| Particle group containing surfactant | | Type | D | E | D | D | B | A | B | C |
| | | Amount | 50 | 50 | 50 | 50 | 45 | 35 | 60 | 15 |
| Particle group containing surfactant | | Type | J | J | I | I | I | I | I | I |
| | | Amount | Residue | | | | | | | |
| Total | | | 100 | | | | | | | |
| Bleaching power 1 [curry] | | | ◎ | ◎ | ◎ | ○ | Δ | Δ | Δ | Δ |
| Bleaching power 2 [pilirubin] | | | ◎ | ◎ | ◎ | ○ | ○ | Δ | ○ | Δ |
| Damage of clothes | | | 6 | 6 | 6 | 6 | 6 | 6 | 6 | 6 |
| Coloration | | | ○ | ○ | ○ | ○ | ○ | ○ | ○ | ○ |
| Discoloration of clothes | | | 5 | 5 | 5 | 5 | 5 | 5 | 3 | 5 |
| Cleaning power | | | ◎ | ◎ | ◎ | ◎ | ○ | ◎ | ◎ | ◎ |
| Surfactant (%) | | | 22 | 23 | 26 | 25 | 25 | 32 | 27 | 32 |
| Average particle size (μm) | | | 404 | 431 | 334 | 330 | 428 | 450 | 491 | 415 |
| Bulk density (g/mL) | | | 0.72 | 0.71 | 0.61 | 0.60 | 0.61 | 0.62 | 0.72 | 0.55 |

Bleaching Detergent Composition Containing Molded Substances

The bleaching detergent compositions were prepared in the same manner as Examples 89, 93, 97, 99, 100, 106 and 113 except that the aforementioned molded substance (1) was used in place of the granulated substance (2) described in the preparation of the granulated substances or molded substances, evaluation similar to the above was carried out, and as a result, each of them obtained evaluation result similar to Examples 89, 93, 97, 99, 100, 106 and 113.

EXAMPLES 114 TO 158

Tablet Bleaching Detergent Composition 0.1 Part by mass of propylene glycol was sprayed to 91.4 parts by mass of each of the bleaching detergent compositions of the above-mentioned Examples 69 to 113, and successively 1.5 parts by mass of fine powder type A zeolite was added to be mixed for 30 seconds. Further, 7 parts by mass of ARBOCEL TF30HG (RettenMaiyer Co.) as a disintegrating agent was added to be mixed for 30 seconds, and a pre-compression molding mixture was obtained. The pre-compression molding mixture was tableted under conditions in which the packing amount of the pre-compression molding mixture was 20.0 g±0.1 g, preload was 1 kN, real pressure was 4 to 6 kN, the revolution of a rotor was 22 rpm, tableting capacity was 600 tablets/min and tableting temperature was 25° C., by a rotary tablet machine which was equipped with 27 pieces of tableting molds (planar shape: round type, and shape at side face: planar rim angle) with a diameter of 34 mm, to obtain the tablet bleaching detergent compositions with a mass of 20 g, a diameter of 34 mm and a thickness of 16 to 18 mm (Examples 114 to 158).

Further, the real pressure was adjusted between 4 to 6 kN so that tablet strength (which is the maximum stress obtained by measuring as follows: tablets are applied to a tablet strength meter (TD-75N manufactured by OKADA SEIKO CO., LTD.), a pressuring arm is moved at a speed of 20 mm per minute, power is applied in the diameter direction of a tablet and the power until collapse) just after molding became 45 N.

Bleaching power, the damage of clothes, coloration, discoloration of clothes and cleaning power for the respective tablet bleaching detergent compositions were evaluated and consequently, evaluation results similar to Examples 69 to 113 were obtained.

The production methods of groups A to L of particles containing a surfactant in Tables are shown below and their compositions are shown in Tables 12 and 13.

Production Method of Group A of Particles Containing Surfactants

The group A of particles containing surfactants was prepared by a procedure described below in accordance with a composition shown in the following Table 12.

Firstly, water was charged in a mixing vessel equipped with a jacket provided with a stirring device and temperature was adjusted to 60° C. Thereto, surfactants excluding α-SF (sodium α-sulfofatty acid methyl ester) and a nonionic surfactant and polyethylene glycol (PEG 6000) were added to be stirred for 10 minutes. Successively, a polymer and a fluorescent brightening agent were added and stirred further for 10 minutes, and a portion of powder type A zeolite (zeolite A) (excluding 2.0% of the corresponding amount (for respective particle groups, hereinafter the same shall apply) of type A zeolite for addition at mixing, 3.2% of the corresponding amount of type A zeolite for a auxiliary pulverization agent and 1.5% of the corresponding amount of type A zeolite for surface coating), sodium carbonate and potassium carbonate were added. Further, they were stirred for 20 minutes to prepare a slurry for spray drying with a moisture of 38%, and then it was spray-dried at the condition of a hot wind temperature of 280° C. using a countercurrent spray dry tower to obtain spray-dried particles with an average particle size of 320 μm, a bulk density of 0.30 g/ml and a moisture content (reduced amount at 105° C. for 2 hours, hereinafter the same) of 5%.

On the other hand, the fatty acid ester of a raw material was sulfonated, and one portion of a nonionic surfactant (25% for sodium α-sulfofatty acid methyl ester) was added to the aqueous slurry (a water content of 25%) of sodium α-sulfofatty acid methyl ester which was obtained by neutralization and condensed to a moisture of 11% under reduced pressure with a thin film type dryer to obtain a mixed concentrate of sodium α-sulfofatty acid methyl ester and a nonionic surfactant.

The above-mentioned dried particles, 2.0% of the corresponding amount of the type A zeolite, the residual nonionic surfactant excluding 0.5% of the corresponding amount of that for spray addition and water were charged in a continuous kneader (KRC-S4 model manufactured by KURIMOTO LTD.) and mixed at the conditions of a mixing capacity of 120 kg/h and a temperature of 60° C. to obtain a kneaded substance containing surfactants. The kneaded substance containing surfactants was cut with a cutter (a cutter rounding rate of 5 m/s) while being extruded using a pelleter double (EXDFJS-100 model manufactured by Fuji Paudal Co, Ltd.) equipped with a dice having a hole diameter of 10 mm to obtain a pellet type molded substance containing surfactants with a length of about 5 to 30 mm.

Then, 3.2% of the corresponding amount of particle, type A zeolite (an average particle size of 180 μm) was added to the pellet type molded substance containing surfactants obtained, as an auxiliary pulverization agent and pulverized (screen hole diameter: the first stage/the second stage/the third stage=12 mm/6 mm/3 mm, revolution: 4700 rpm for each of the first stage/the second stage/the third stage) using a FITZMILL (DKA-3 manufactured by HOSOKAWA MICRON Corporation) which were arranged at 3 stages in series, in the presence of cool wind (10° C., 15 m/s). Finally, 1.5% of the corresponding amount of fine powder type A zeolite was added at the conditions of a packing ratio of 30% by volume, a revolution of 22 rpm and 25° C. in a horizontal cylindrical tumbling mixer (a mixer having two baffles of 45 mm high and its clearance of 20 mm to an internal wall of a drum, and having a cylindrical diameter of 585 mm, a cylindrical length of 490 mm and a drum container of 131.7 L) and the surface was modified by tumbling for 1 minute while being sprayed 0.5% of the corresponding amount of a nonionic surfactant and a perfume, to obtain particles containing surfactants.

In order to color the portion of the particles containing surfactants obtained, the 20% aqueous dispersion of a dye was sprayed on their surface while transferring the particles containing surfactants on a belt conveyer at a speed of 0.5 m/sec (the layer height of the particles containing surfactants on the belt conveyer was 30 mm and the layer width was 300 mm) to obtain a group A of the particles containing surfactants (an average particle size of 550 μm and a bulk density of 0.84 g/mL).

Production Method of Group B of Particles Containing Surfactants

The group B of particles containing surfactants was prepared by a procedure below in accordance with a composition shown in the following Table 12.

Firstly, water was charged in a mixing vessel equipped with a jacket provided with a stirring device and temperature was adjusted to 60° C. Thereto, surfactants excluding α-SF (sodium α-sulfofatty acid methyl ester) and a nonionic surfactant and polyethylene glycol were added and the mixture was stirred for 10 minutes. Successively, the sodium salt of an acrylic acid/maleic acid copolymer (polymer A), HIDS and a fluorescent brightening agent were added and stirred further for 10 minutes, and then, a portion of powder type A zeolite (zeolite A) (excluding 7.0% of the corresponding amount of type A zeolite for addition at mixing, 3.2% of the corresponding amount of type A zeolite for a auxiliary pulverization agent and 1.5% of the corresponding amount of type A zeolite for surface coating), sodium carbonate and potassium carbonate were added. Further, they were stirred for 20 minutes to prepare a slurry for spray drying with a moisture of 38%, and then it was spray-dried at the condition of a hot wind at the temperature of 280° C. using a countercurrent spray dry tower to obtain spray-dried particles with an average particle size of 290 μm, a bulk density of 0.32 g/ml and a moisture content of 5%.

On the other hand, the fatty acid ester of a raw material was sulfonated, and one portion of a nonionic surfactant (25% for sodium α-sulfofatty acid methyl ester) was added to the aqueous slurry (a water content of 25%) of sodium α-sulfofatty acid methyl ester which was obtained by neutralization and condensed to a moisture of 11% under reduced pressure with a thin film type dryer to obtain a mixed concentrate of sodium (X-sulfofatty acid methyl ester and a nonionic surfactant.

The above-mentioned dried particles, 7.0% of the corresponding amount of the type A zeolite, the residual nonionic surfactant excluding 0.5% of the corresponding amount of that for spray addition and water were charged in a continuous kneader (KRC-S4 model manufactured by KURIMOTO LTD.) and mixed at the conditions of a mixing capacity of 120 kg/hour and a temperature of 60° C. to obtain a kneaded substance containing surfactants.

The kneaded substance containing surfactants was cut with a cutter (a cutter rounding rate of 5 m/s) while being extruded using a pelleter double (EXDFJS-100 model manufactured by Fuji Paudal Co, Ltd.) equipped with a dice having a hole diameter of 10 mm to obtain a pellet type molded substance containing surfactants with a length of about 5 to 30 mm.

Then, 3.2% of the corresponding amount of particle type A zeolite (an average particle size of 180 μm) was added to the pellet type molded substance containing surfactants obtained, as an auxiliary pulverization agent and pulverized (screen hole diameter: the first stage/the second stage/the third stage=12 mm/6 mm/3 mm, revolution: 4700 rpm for either of the first stage/the second stage/the third stage) using a FITZMILL (DKA-3 manufactured by HOSOKAWA MICRON Corporation) which were arranged at 3 stages in series, in the presence of cool wind (10° C., 15 m/s). Finally, 1.5% of the corresponding amount of fine powder type A zeolite was added at the conditions of a packing ratio of 30% by volume, a revolution of 22 rpm and 25° C. in a horizontal cylindrical tumbling mixer (a mixer having two baffles of 45 mm high and its clearance of 20 mm to an internal wall of a drum, and having a cylindrical diameter of 585 mm, a cylindrical length of 490 mm and a drum container of 131.7 L), and the surface was modified by tumbling for 1 minute while being sprayed 0.5% of the corresponding amount of a nonionic surfactant and a perfume, to obtain particles containing surfactants.

In order to color the portion of the particles containing surfactants obtained, the 20% aqueous dispersion of a dye was sprayed by a similar method to the group A of the particles containing surfactants to obtain the group B of the particles containing surfactants (an average particle size of 550 μm and a bulk density of 0.86 g/mL).

Production Method of Group C of Particles Containing Surfactants

After a slurry with a moisture of 38% in which components excluding a nonionic surfactant, 2.0% of the corresponding amount of type A zeolite for addition at mixing, 3.2% of the corresponding amount of type A zeolite for a auxiliary pulverization agent, 1.5% of the corresponding amount of type A zeolite for surface coating, a dye and a perfume among the composition shown in the following Table 12 were dissolved or dispersed in water was prepared, it was spray-dried at the condition of a hot wind temperature of 300° C. using a countercurrent spray dry tower to obtain spray-dried particles with an average particle size of 330 μm, a bulk density of 0.30 g/ml and a moisture of 3%. The dried particles, 2.0% of the corresponding amount of the type A zeolite, a nonionic surfactant excluding 0.5% of the corresponding amount of that for spray addition and water were charged in a continuous kneader (KRC-S4 model manufactured by KURIMOTO LTD.) and mixed under the conditions of a mixing capacity of 120 kg/h and a temperature of 60° C. to obtain a kneaded substance containing surfactants.

The kneaded substance containing surfactants was cut with a cutter (a cutter rounding rate of 5 m/s) while being extruded using a pelleter double (EXDFJS-100 model manufactured by Fuji Paudal Co, Ltd.) equipped with a dice having a hole diameter of 10 mm to obtain a pellet type molded substance containing surfactants with a length of about 5 to 30 mm.

Then, 3.2% of the corresponding amount of particle type type A zeolite (an average particle size of 180 μm) was added to the pellet type molded substance containing surfactants obtained, as an auxiliary pulverization agent and pulverized (screen hole diameter: the first stage/the second stage/the third stage=12 mm/6 mm/3 mm, revolution: 4700 rpm for either of the first stage/the second stage/the third stage) using a FITZMILL (DKA-3 manufactured by HOSOKAWA MICRON Corporation) which were arranged at 3 stages in series, in the presence of cool wind (10° C., 15 m/s). Finally, 1.5% of the corresponding amount of fine powder type A zeolite was added at the conditions of a packing ratio of 30% by volume, a revolution of 22 rpm and 25° C. in a horizontal cylindrical tumbling mixer (a mixer having two baffles of 45 mm high and its clearance of 20 mm to an internal wall of a drum, and having a cylindrical diameter of 585 mm, a cylindrical length of 490 mm and a drum container of 131.7 L), and the surface was modified by tumbling for 1 minute while being sprayed 0.5% of the corresponding amount of nonionic surfactant and a perfume, to obtain particles containing surfactants.

In order to color the portion of the particles containing surfactants obtained, the 20% aqueous dispersion of a dye was sprayed by a similar method to the group A of the particles containing surfactants to obtain the group C of the particles containing surfactants (an average particle size of 540 μm and a bulk density of 0.77 g/mL).

Production Method of Group D of Particles Containing Surfactants

The group D of particles containing surfactants was prepared by a procedure below in accordance with a composition shown in the following Table 12.

Firstly, water was charged in a mixing vessel equipped with a jacket provided with a stirring device and temperature was adjusted to 50° C. Thereto, sodium sulfate and a fluorescent brightening agent were added and the mixture was stirred for 10 minutes. Successively, after sodium carbonate was added, the sodium salt of an acrylic acid/maleic acid copolymer and ASDA were added and stirred further for 10 minutes, and sodium chloride and a portion of powder type A zeolite were added. Further, they were stirred for 30 minutes to prepare slurry for spray drying.

The temperature of the slurry obtained for spray drying was 50° C. The slurry was spray-dried using a countercurrent spray dry tower equipped with a pressure spray nozzle to obtain spray-dried particles with moisture of 3%, a bulk density of 0.50 g/ml and an average particle size of 250 μm.

Separately, a nonionic surfactant, polyethylene glycol and anionic surfactants (LAS-Na, As-Na, α-SF-Na and a soap) were mixed at the condition of 80° C. to prepare a surfactant composition with moisture of 10% by mass. LAS-Na was used in solution condition, which was neutralized with sodium hydroxide aqueous solution.

Further, the spray-dried particles obtained was charged (a packing ratio of 50% by volume) in a Lodige mixer equipped with a fork shape shovel (M20 model manufactured by MATSUBO CORPORATION) in which clearance between the wall faces of the shovel was 5 mm, and the stirring of a main axis (150 rpm) and a chopper (4000 rpm) was started while flowing warm water of 80° C. at a flow rate of 10 L/min in a jacket. Thereto, the surfactant composition prepared in the above-description was charged over 2 minutes, and after stirring for 5 minutes thereafter, layered silicate (SKS-6, an average particle size of 5 μm) and the portion (10% of the corresponding amount) of the powder type A zeolite were charged and stirred for 2 minutes to obtain particles containing surfactants.

The particles containing surfactants obtained and the portion (2% of the corresponding amount) of the powder type A zeolite were mixed with a V blender, a perfume was sprayed, and then in order to color the portion of particles containing surfactants, the 20% aqueous dispersion of a dye was sprayed by the similar method to the group A of the particles containing surfactants to obtain a group D of the particles containing surfactants (an average particle size of 300 μm and a bulk density of 0.75 g/mL).

Production Method of Group E of Particles Containing Surfactants

After a slurry with a moisture of 38% in which components excluding 5.0% of the corresponding amount of type A zeolite for surface coating, polyethylene glycol, layered silicate, a dye and a perfume among the composition shown in the following Table 12 were dissolved or dispersed in water was prepared, it was spray-dried at the condition of a hot wind temperature of 300° C. using a countercurrent spray dry tower to obtain spray-dried particles with an average particle size of 320 μm, a bulk density of 0.36 g/ml and a moisture of 3%. Further, the spray-dried particles were charged (a packing ratio of 50% by volume) in a Lodige mixer equipped with a fork shape shovel (M20 model manufactured by MATSUBO CORPORATION)) in which clearance between the wall faces of the shovel was 5 mm, and the stirring of a main axis (200 rpm) and a chopper (200 rpm) was started. Thirty seconds after starting the stirring, polyethylene glycol and water which were heated at 60° C. were added the stirring and granulation were continued under the condition of a jacket temperature of 30° C. until an average particle size became 400 μm.

Finally, layered silicate (SKS-6, an average particle size of 5 μm) and 5.0% of the corresponding amount of the fine powder type A zeolite were added and stirred for 1 minute to carry out surface modification, and particles containing surfactants were obtained by spraying a perfume.

In order to color the portion of particles containing surfactants, the 20% aqueous dispersion of a dye was sprayed on their surface while transferring the particles containing surfactants on a belt conveyer at a speed of 0.5 m/s (the layer height of the particles containing surfactants on the belt conveyer was 30 mm and the layer width was 300 mm), to obtain the group E of the particles containing surfactants (an average particle size of 400 μm and a bulk density of 0.78 g/mL).

Production Method of Group F of Particles Containing Surfactants

The group F of particles containing surfactants was prepared by a procedure below in accordance with the composition shown in the following Table 12. Firstly, water was charged in a mixing vessel equipped with a jacket provided with a stirring device and temperature was adjusted to 60° C. After a slurry with a moisture of 38% in which components excluding type A zeolite, sodium carbonate, a dye and a perfume were dissolved or dispersed in water was prepared, it was spray-dried at the condition of a hot wind temperature of 300° C. using a countercurrent spray dry tower to obtain spray-dried particles with an average particle size of 280 μm, a bulk density of 0.32 g/ml and a moisture of 6%.

Thereto, fine powder type A zeolite and sodium carbonate were added at the conditions of a packing ratio of 30% by volume, a revolution of 22 rpm and 25° C. in a horizontal cylindrical tumbling mixer (a mixer having two baffles of 45 mm high and its clearance of 20 mm to an internal wall of a drum, and having a cylindrical diameter of 585 mm, a cylindrical length of 490 mm and a drum container of 131.7 L), and the surface was modified by tumbling for 1 minute while being sprayed a perfume, to obtain particles containing surfactants.

In order to color the portion of the particles containing surfactants obtained, the 20% aqueous dispersion of a dye was sprayed by a similar method to the group A of the particles containing surfactants to obtain the group F of the particles containing surfactants (an average particle size of 350 μm and a bulk density of 0.48 g/mL).

Production Method of Group G of Particles Containing Surfactants

The group G of particles containing surfactants was prepared by a similar procedure to a method of producing the group F of the particles containing surfactants in accordance with the composition shown in the following Table 12, and the group G of the particles containing surfactants (an average particle size of 350 μm and a bulk density of 0.50 g/mL) was obtained.

Production Method of Group H of Particles Containing Surfactants

Surfactants, all raw materials (25° C.) excluding 5.0% of the corresponding amount of P type zeolite (Zeolite B) used for surface coating, a dye and a perfume among a composition shown in the following Table 12 were charged (a packing ratio of 50% by volume) in a Lodige mixer equipped with a fork shape shovel (M20 model manufactured by MATSUBO CORPORATION)) in which clearance between the wall faces of the shovel was 5 mm, and the stirring of a main axis (200 rpm) and a chopper (200 rpm) was started. After 30 seconds of stirring, thereto, a surfactant mixture (which was obtained by preliminarily heating a nonionic surfactant and an anionic surfactant at 60° C. to be homogeneously mixed) and water (60° C.) were charged over 2 minutes and granulation by stirring was continued under the condition of a jacket temperature of 30° C. until an average particle size became 400 μm. Finally, 5.0% of the corresponding amount of type P zeolite (Zeolite B) was added, the mixture was stirred for 30 seconds, surface was modified and a perfume was sprayed to obtain particles containing surfactants.

In order to color the portion of the particles containing surfactants obtained, the 20% aqueous dispersion of a dye was sprayed by a similar method to the group A of the particles containing surfactants to obtain the group H of the particles containing surfactants (an average particle size of 400 μm and a bulk density of 0.80 g/mL).

Production Method of Group I of Particles Containing Surfactants

Powder raw materials (excluding a coating agent) containing a fluorescent brightening agent, potassium carbonate and a pulverized product of sodium carbonate (a product obtained by pulverizing sodium carbonate with a desktop type fine pulverizer (STUDMILL 63C model manufactured by Alpine Industries AG)) were added to a fluidized bed (Glaft-POWREX, model No. FD-WRT-20 manufactured by Powlex Co.) by a mass so that the thickness of a powder layer at stand still to be 200 mm. Then, wind (air) at 20° C. was fed to the fluidized bed and α-SF-H (α-sulfofatty acid alkyl ester) was sprayed for the fluidized powder layer from upward after confirming that the powder was fluidized. Granulation operation was carried out while adjusting wind velocity in the fluidized bed in a range of 0.2 to 2.0 m/s while confirming fluidized condition.

α-SF-H was sprayed at 60° C. and a two fluids hollow cone nozzle with an angle of spray of 70° was used as a nozzle for spray. The spray was carried out at a spray velocity of about 400 g/min. After completion of the spray of α-SF-H, wind (air) at 20° C. was further fed into the fluidized bed and aging was carried out for 240 seconds. Further, the granulated substance was discharged from the fluidized bed, 4.5% of the corresponding amount of type A zeolite was coated in a rolling drum (equipped with four baffle plates with a diameter of 0.6 m, a length of 0.48 m and thickness of 1 mm×width of 12 cm×length of 48 cm, a revolution of 20 rpm).

Then, a 35% hydrogen peroxide aqueous solution (4.7% for particles) was sprayed in a rolling drum (equipped with four baffle plates with a diameter of 0.6 m, a length of 0.48 m and thickness of 1 mm×width of 12 cm×length of 48 cm, a revolution of 20 rpm) to carry out bleaching treatment, 5.0% of the corresponding amount of type A zeolite was further coated in order to improve flowability and a perfume was sprayed.

In order to color the portion of the particles containing surfactants obtained, the 20% aqueous dispersion of a dye was sprayed by a similar method to the group A of the particles containing surfactants to obtain a group I of the particles containing surfactants (an average particle size of 380 μm and a bulk density of 0.50 g/mL).

Production Method of Group J of Particles Containing Surfactants

After a slurry with a moisture of 40% in which components excluding a nonionic surfactant, 4.2% of the corresponding amount of type A zeolite for a auxiliary pulverization agent, 2.0% of the corresponding amount of type A zeolite for surface coating, montmorillonite, white carbon, a dye and a perfume among the composition shown in the following Table 13 were dissolved or dispersed in water was prepared, it was spray-dried at the condition of a hot wind temperature of 300° C. using a countercurrent spray dry tower to obtain spray-dried particles with an average particle size of 300 μm, a bulk density of 0.45 g/ml and a moisture of 3%. The dried particles, montmorillonite, white carbon, a nonionic surfactant and water were charged in a continuous kneader (KRC-S4 model manufactured by KURIMOTO LTD.) and mixed at the conditions of a mixing capacity of 120 kg/h and a temperature of 60° C. to obtain a kneaded substance containing surfactants.

The kneaded substance containing surfactants was cut with a cutter (a cutter rounding rate of 5 m/s) while being extruded using a pelleter double (EXDFJS-100 model manufactured by Fuji Paudal Co, Ltd.) equipped with a dice having a hole diameter of 10 mm to obtain a pellet type molded substance containing surfactants with a length of about 5 to 30 mm.

Then, 4.2% of the corresponding amount of particle type A zeolite (an average particle size of 180 μm) was added to the pellet type molded substance containing surfactants obtained, as an auxiliary pulverization agent and pulverized (screen hole diameter: the first stage/the second stage/the third stage=8 mm/6 mm/3 mm, revolution: 3760 rpm for all stages) using a FITZMILL (DKA-3 manufactured by HOSOKAWA MICRON Corporation) which were arranged at 3 stages in series, in the presence of cool wind (10° C., 15 m/s). Finally, 2.0% of the corresponding amount of fine powder type A zeolite was added at the conditions of a packing ratio of 30% by volume, a revolution of 22 rpm and 25° C. in a horizontal cylindrical tumbling mixer (a mixer having two baffles of 45 mm high and its clearance of 20 mm to an internal wall of a drum, and having a cylindrical diameter of 585 mm, a cylindrical length of 490 mm and a drum container of 131.7 L), the surface was modified by tumbling for 2 minutes and a perfume was sprayed, to obtain particles containing surfactants.

In order to color the portion of the particles containing surfactants obtained, the 20% aqueous dispersion of a dye was sprayed by a similar method to the group A of the particles containing surfactants to obtain a group J of the particles containing surfactants (an average particle size of 560 μm and a bulk density of 0.80 g/mL).

Production Method of Group K of Particles Containing Surfactants

Powder raw materials containing sodium carbonate, type A zeolite excluding that for later addition, STPP and the like among the composition shown in the following Table 13 were charged in a mixer, then, after stirring blades and chopper were driven, a mix solution of a fluorescent brightening agent and the acid precursor (LAS-H) of an anionic surfactant was added in the mixer (Lodige FKM50D) over 6 to 7 minutes to carry out neutralization reaction (the revolution of an main axis: 150 rpm (Fr number: 2.24), the revolution of chopper: 2880 rpm). Further, cooling water was flowed in the jacket of the mixer to control the temperature of the neutralized granulated substance (a jacket temperature of 12° C., temperature of the neutralized granulated substance at 56° C.), particles were prepared, finally, 2% of the corresponding amount of type A zeolite was added to be stirred for 30 seconds, the surface was modified and a perfume was sprayed to obtain particles containing surfactants.

In order to color the portion of the particles containing surfactants obtained, the 20% aqueous dispersion of a dye was sprayed by a similar method to the group A of the particles containing surfactants to obtain a group K of the particles containing surfactants (an average particle size of 380 μm and a bulk density of 0.80 g/mL).

Production Method of Group L of Particles Containing Surfactants

Powder detergents with high bulk density of the compositions shown in the following Table 13 were prepared by 750 kg unit according to the following operation using a FS-1200 high speed mixer/granulator manufactured by Fukae Kogyo Co., Ltd.

The portion of type A zeolite, sodium carbonate, sodium sulfate, CMC-Na, layered silicate, the sodium salt of acrylic acid/maleic acid copolymer, a fluorescent brightening agent and a soap were dry-blended for 60 seconds at a stirrer speed of 100 rpm and a shearing machine speed of 2000 rpm. Water (0.375% of the corresponding amount) was added and the mixer was driven for 90 seconds at the same stirrer speed and shearing machine speed. LAS-H was added for 300 seconds while driving the mixer at a stirrer speed of 80 rpm and a shearing machine speed of 2000 rpm. Temperature was kept at 50° C. or less with a cooling jacket to which water was flowed. At completion of neutralization, water (1.4% of the corresponding amount) as a binder and a nonionic surfactant were added to the mixer and granulation treatment was carried out for 180 seconds at a stirrer speed of 100 rpm and a shearing machine speed of 2000 rpm. Temperature was kept at 50° C. or less with a cooling jacket to which water was flowed. The product obtained at this step was granular solid.

The shearing machine of the mixer was stopped, the surface was modified by adding 11% of the corresponding amount of type A zeolite while stirring the stirrer at a speed of 90 rpm for 120 seconds, and a perfume was sprayed to obtain particles containing surfactants.

In order to color the portion of the particles containing surfactants obtained, the 20% aqueous dispersion of a dye was sprayed by a similar method to the group A of the particles containing surfactants to obtain a group L of the particles containing surfactants (an average particle size of 370 μm and a bulk density of 0.85 g/mL).

TABLE 12

| Composition (%) | Group of particles containing surfactants | | | | | | | |
|---|---|---|---|---|---|---|---|---|
| | A | B | C | D | E | F | G | H |
| α-SF-Na | 11 | 12 | — | 1 | — | 13 | — | 3 |
| LAS-K | 8 | — | 15 | — | — | — | — | — |
| LAS-Na | — | — | — | 10 | 20 | 5 | 17 | — |
| AOS-K | 1 | — | 10 | — | — | — | — | — |
| AOS-Na | — | — | — | — | — | — | 3 | |
| AS-Na | — | — | — | 1 | 3 | — | — | — |
| Soap | 8 | 7 | 3 | 2 | — | — | — | 1 |
| Nonionic surfactant 1 | 5 | 7 | 3 | — | — | — | — | — |
| Nonionic surfactant 2 | — | — | — | 10 | — | — | — | 20 |
| PEG6000 | 1 | 1 | 1 | 1 | 1 | — | — | 1 |
| Fluorescent brightening agent A | 0.1 | 0.0001 | 0.001 | 0.05 | 0.1 | 0.005 | 0.005 | 0.20 |
| Fluorescent brightening agent B | — | — | — | 0.06 | — | 0.005 | 0.08 | — |
| Sodium silicate No. 1 | — | — | 5 | — | 5 | — | 8 | — |
| Sodium sulfate | — | — | — | 11 | 10 | 30 | 30 | — |
| Sodium chloride | — | — | — | 4 | — | — | — | 3 |
| Potassium carbonate | 10 | 9 | 13 | — | — | — | — | 2 |
| STPP | — | — | — | — | — | 14 | 17 | — |
| Zeolite A | 22 | 30 | 25 | 25 | 27 | 3 | 3 | — |
| Zeolite B | — | — | — | — | — | — | — | 25 |
| Layered silicate | — | — | — | 8 | 10 | — | — | 8 |
| Polymer A | 3 | 1 | — | 6 | — | — | — | 3 |
| Polymer B | — | — | — | — | 2 | 1 | 1 | — |
| HIDS | — | 3 | — | — | — | — | — | 3 |
| ASDA | — | — | — | 3 | — | — | — | — |
| MGDA | — | — | 3 | — | — | — | — | — |
| Perfume A | 0.15 | 0.15 | — | — | — | — | — | 0.2 |
| Perfume B | — | — | 0.15 | — | — | — | — | — |
| Perfume C | — | — | — | 0.15 | 0.2 | — | — | — |
| Perfume D | — | — | — | — | — | 0.4 | 0.3 | — |
| Dye A | 0.02 | 0.02 | 0.02 | — | 0.02 | — | 0.02 | 0.02 |
| Dye B | — | — | — | 0.02 | — | 0.02 | — | — |
| Moisture | 8 | 8 | 7 | 6 | 7 | 5 | 5 | 8 |
| Sodium carbonate | | | | Residue | | | | |
| Total | | | | 100 | | | | |

TABLE 13

| Composition (%) | Group of particles containing surfactants | | | |
|---|---|---|---|---|
| | I | J | K | L |
| α-SF-Na | 35.5 | — | — | — |
| LAS-Na | — | — | 25 | 25 |
| Soap | — | — | — | 1 |
| Nonionic surfactant 3 | — | 25 | — | 2 |
| Fluorescent brightening agent A | 0.05 | 0.05 | 0.05 | 0.1 |
| Fluorescent brightening agent B | — | — | — | — |
| White carbon | — | 4 | — | — |
| Montmorillonite | — | 7 | — | — |
| Layered silicate | — | — | — | 4 |
| Potassium carbonate | 5.5 | — | — | — |
| STPP | — | — | 7 | — |
| Zeolite A | 9.5 | 25 | 23 | 35 |
| Polymer A | — | — | — | 1 |
| CMC-Na | — | — | — | 1 |
| Sodium sulfate | — | — | — | 2 |

TABLE 13-continued

| Composition (%) | Group of particles containing surfactants | | | |
|---|---|---|---|---|
| | I | J | K | L |
| Dye A | 0.15 | 0.15 | 0.15 | 0.15 |
| Dye C | 0.02 | 0.02 | 0.02 | 0.02 |
| Moisture | 6 | 7 | 5 | 10 |
| Sodium carbonate | | Residue | | |
| Total | | 100 | | |

Preparation of Granulated Substance of Bleaching Activator

Preparation Method of Granulated Substance of Bleaching Activator E

Granulated substance of bleaching activator E was prepared in like manner as the granulated substance of bleaching activator B except that a compound represented by the following formula was used as a bleaching activator.

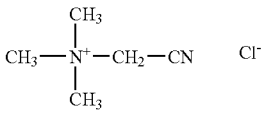

Preparation Method of Granulated Substance of Bleaching Activator F

Granulated substance of bleaching activator F was prepared in like manner as the granulated substance of bleaching activator B except that a compound represented by the following formula was used as a bleaching activator.

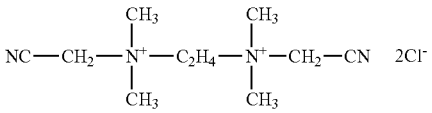

Name-abbreviated components in Table used the following.

(Surfactant)

α-SF-Na: sodium salt of α-sulfofatty acid methyl ester having 14 carbons: 16 carbons=18:82 (manufactured by LION Corporation, AI=70%, residue is unreacted fatty acid methyl ester, sodium sulfate, methyl sulfate, hydrogen peroxide, water and the like).

α-SF-H: α-sulfofatty acid alkyl ester (a mixture of PASTEL M-14 and PASTEL M-16 of its methyl ester (manufactured by LION Oleochemical Co. Ltd.) at 2:8 was sulfonated according to a method disclosed in Example 1 of Japanese Unexamined Patent Publication No. 2001-64248) and extracted after an esterification step to prepare α-sulfofatty acid alkyl ester). A compounding amount in Table 13 indicates % by mass as α-SF-Na, which was neutralized with sodium carbonate at preparation of particles containing surfactants.

LAS-K: a linear alkyl (10 to 14 carbons) benzenesulfonic acid (LYPON LH-200 (LAS-H, pure content: 96%) manufactured by LION Corporation) was neutralized with a 48% potassium hydroxide aqueous solution at preparation of a composition containing surfactants). A compounding amount in Table 12 indicates % by mass as LAS-K.

LAS-Na: a linear alkyl (10 to 14 carbons) benzenesulfonic acid (LYPON LH-200 (LAS-H, pure content: 96%) manufactured by LION Corporation) was neutralized with a 48% sodium hydroxide aqueous solution at preparation of a composition containing surfactants). A compounding amount in Table 12 indicates % by mass as LAS-Na.

LAS-H: a linear alkyl (10 to 14 carbons) benzenesulfonic acid (LYPON LH-200 (LAS-H, pure content: 96%) manufactured by LION Corporation. A compounding amount in Table 13 indicates % by mass as LAS-Na, which was neutralized with sodium carbonate at preparation of particles containing surfactants.

AOS-K: potassium α-olefinsulfonate having an alkyl group of 14 to 18 carbons (manufactured by LION Corporation).

AOS-Na: sodium α-olefinsulfonate having an alkyl group of 14 to 18 carbons (manufactured by LION Corporation).

Soap: sodium fatty acid having an alkyl group of 12 to 18 carbons (manufactured by LION Corporation, pure content: 67%, titer: 40 to 45° C., fatty acid composition; C12: 11.7%, C14: 0.4%, C16: 29.2%, C18F0 (stearic acid): 0.7%, C18F1 (oleic acid): 56.8%, C18F2 (linolic acid): 1.2%, molecular weight: 289).

AS-Na: Sodium alkylsulfonate having 10 to 18 carbons (SANDET LNM manufactured by Sanyo Chemical Industries, Ltd.).

Nonionic surfactant 1: the adduct of average 15 mol of ethylene oxide with ECOROL 26 (an alcohol having an alkyl group of 12 to 16 carbons, manufactured by ECOGREEN Co.).

Nonionic surfactant 2: the adduct of average 6 mol of ethylene oxide with ECOROL 26 (an alcohol having an alkyl group of 12 to 16 carbons, manufactured by ECOGREEN Co.).

Nonionic surfactant 3: the adduct of average 15 mol of ethylene oxide with PASTEL M-181 (methyl oleate, manufactured by Lion Oleochemical Co.).

PEG 6000: polyethylene glycol manufactured by LION Corporation, a trade name: PEG # 6000 M (average molecular weight: 7300 to 9300).

Cationic surfactant: Praepagen HY ($C_{12}/C_{14}$-Alkyl dihydroxyethyl methyl ammonium chloride, manufactured by Clariant Japan Co.).

(Fluorescent Brightening Agent)

Fluorescent brightening agent A: CHINOPEARL CBS-X (manufactured by Ciba Specialty Chemicals).

Fluorescent brightening agent B: CHINOPEARL AMS-GX (manufactured by Ciba Specialty Chemicals).

(Builder)

Sodium silicate No. 1: sodium silicate JIS No. 1 (manufactured by Nippon Chemical Industrial CO., LTD.).

Sodium sulfate: neutral sodium sulfate (manufactured by Shikoku Corp.).

Sodium chloride: Heated salt C of NISSEI (Nihon Seien Co.)

Sodium carbonate: heavy sodium carbonate (Soda ash: manufactured by ASAHI GLASS CO., LTD.).

Potassium carbonate: potassium carbonate (manufactured by ASAHI GLASS CO., LTD.).

STPP: sodium tripolyphosphate.

Zeolite A: Type A zeolite (manufactured by MIZUSAWA INDUSTRIAL CHEMICALS, LTD.).

Zeolite B: P type zeolite (DOUCIL A24 manufactured by Crossfield Co.).

Layered silicate: crystalline layered silicate (SKS-6 manufactured by Clariant Japan Co.).

Polymer A: the sodium salt of acrylic acid/maleic acid copolymer (a trade name: Socalan CP7 manufactured by BASF AG.).

Polymer B: sodium polyacrylate (a trade name: Socalan PA30 manufactured by BASF AG.).

HIDS: tetrasodium hydroxyiminodisuccinate

ASDA: aspartic acid and diacetic acid tetrasodium (Crewat Bi-ADS/ASDA-4Na, manufactured by Mitsubishi Rayon Co., Ltd.).

MGDA: trisodium methylglycin diacetate (Trilon, manufactured by BASF AG).

Sodium citrate: purified sodium citrate L (manufactured by FUSO CHEMICAL CO., LTD.)

(Perfume)

Perfume A: a perfume composition A indicated in [Table 11] to [Table 18] of Japanese Unexamined Patent Publication No. 2002-146399.

Perfume B: a perfume composition B indicated in [Table 11] to [Table 18] of Japanese Unexamined Patent Publication No. 2002-146399.

Perfume C: a perfume composition C indicated in [Table 11] to [Table 18] of Japanese Unexamined Patent Publication No. 2002-146399.

Perfume D: a perfume composition D indicated in [Table 11] to [Table 18] of Japanese Unexamined Patent Publication No. 2002-146399.

(Dye)

Dye A: ultramarine blue pigment (Ultramarine Blue, manufactured by Dainichiseika Color & Chemicals Mfg. Co., Ltd.).

Dye B: Pigment Green 7 (manufactured by Dainichiseika Color & Chemicals Mfg. Co., Ltd.).

Dye C: a pink fluorescent pigment aqueous dispersion which was obtained, after heat treatment, by adding about 1% based on a resin content of I.BASIC RED-1 to the polymerized resin dispersion of spherical resin particles with an average particle size of 0.35 μm obtained by radical emulsion polymerization in aqueous dispersion using acrylonitrile/styrene/acrylic acid as composition monomers.

(Percarbonate)

Percarbonate: Coated sodium percarbonate coated with silicic acid and sodium borate (a trade name: SPC-D, manufactured by MITSUBISHI GAS CHEMICAL COMPANY, INC., an effective oxygen amount of 13.2%, an average particle size of 760 μm)

(Granulated Substance of Bleaching Activator)

Granulated substance of bleaching activator A: the granulated substance of tetraacetylethylenediamine (a trade name: Peractive AN, manufactured by Clariant Japan Co.).

Granulated substance of bleaching activator B: the granulated substance of the bleaching activator obtained by the preparation method of the aforementioned granulated substance of bleaching activator B.

Granulated substance of bleaching activator C: the granulated substance of the bleaching activator obtained by the preparation method of the aforementioned granulated substance of bleaching activator C.

Granulated substance of bleaching activator D: the granulated substance of the bleaching activator obtained by the preparation method of the aforementioned granulated substance of bleaching activator D.

Granulated substance of bleaching activator E: the granulated substance of the bleaching activator obtained by the preparation method of the aforementioned granulated substance of bleaching activator E.

Granulated substance of bleaching activator F: the granulated substance of the bleaching activator obtained by the preparation method of the aforementioned granulated substance of bleaching activator F.

(Amorphous Silicate)

Amorphous silicate A: Britesil H24 (manufactured by PQ Corporation).

Amorphous silicate B: Britesil C24 (manufactured by PQ Corporation).

Amorphous silicate C: Britesil H20 (manufactured by PQ Corporation).

Amorphous silicate D: Britesil C20 (manufactured by PQ Corporation).

Amorphous silicate E: a complex, NABION 15 of sodium carbonate with amorphous alkali metal silicate (manufactured by Rhodia Co.).

(Enzyme)

Enzyme A: a mixture of Everlase 8T (manufactured by Novozymes A/S)/LIPEX 50T (manufactured by Novozymes A/S)/Termamil 60T (manufactured by Novozymes A/S)/Cellzyme 0.7T (manufactured by Novozymes A/S)=5:2:1:2 (mass ratio).

Enzyme B: a mixture of Kannase 12T (manufactured by Novozymes A/S)/LIPEX 50T (manufactured by Novozymes A/S)/Termamil 60T (manufactured by Novozymes A/S)/Cellzyme 0.7T (manufactured by Novozymes A/S)=5:2:1:2 (mass ratio).

(Others)

Bentonite: Laundrosil PR414 (manufactured by SUD-CHEMIE Co.)

4-Methoxyphenol: manufactured by Kawaguchi Chemical Industry Co., Ltd. (trade name: MQ-F).

BHT: di-tert-butyl-hydroxytoluene manufactured by Nikki-Universal Co., Ltd. (trade name: BHT-C).

Sodium tetraborate: sodium tetraborate pentahydrate (trade name: Neobor, manufactured by Borax Co.).

HEDP-4Na: tetrasodium 1-hydroxyethane-1,1-diphosphonate (a trade name: DAYQUEST 2016D manufactured by Solutia Japan Ltd.,)

EDTMP: sodium ethylenediaminetetra(methylenephosphonic acid) (a trade name: BRIQUEST, (registered trademark) 422; manufactured by ALBRIGHT & WILSON Co.).

Montmorillonite: montmorillonite (ROUNDROSIL powder manufactured by SUD-CHEMI Co.).

White carbon: silica fine powder (TOKUSEAL N manufactured by TOKUYAMA Corp.)

CMC-Na: the same as Powder 4 of Table 4.

(Powder)

Powders 1 to 4 are shown in Table 4.

(Bleaching Activating Catalyst)

Catalysts 1 to 5 are same as described above.

(Bleaching Activator)

Bleaching activators 1 to 4 are same as described above.

What is claimed is:

1. A bleach composition containing (a) 20% to 90% by mass of a peroxide which generates hydrogen peroxide by being dissolved in water, (b) 5% to 40% by mass of silk powder which is water-insoluble or has a solubility of less than 0.1 gram for 100 grams of deionized water at 25 degrees Celsius, (c) (c-1) 0.001% to 1% by mass of a bleaching activating catalyst and (c) (c-2) 0.1% to 5% of a bleaching activator wherein the bleaching activating catalyst of the component (c-1) contains manganese.

2. A bleach detergent composition containing (a) 1% to less than 20% by mass of a peroxide which generates hydrogen peroxide by being dissolved in water, (b) 1% to 10% by mass of silk powder which is water-insoluble or has a solubility of less than 0.1 gram for 100 grams of deionized water at 25 degrees Celsius, (c) (c-1) 0.001% to 1% by mass of a bleaching activating catalyst (c) (c-2) 0.05% to 3% by mass of a bleaching activator, and (d) 10% to 50% by mass of a surfactant wherein the bleaching activating catalyst of the component (c-1) contains manganese.

3. The bleaching detergent composition according to claim 2, wherein the content of the component (d) is 15% to 40% by mass.

4. The composition according to claim 1, wherein the component (a) is sodium percarbonate.

5. The composition according to claim 4, wherein the component (a) is coated sodium percarbonate.

6. The composition according to claim 1, wherein the bleaching activating catalyst of the component (c-1) is a (tris (salicylideneiminoethyl)amine)-manganese complex.

7. The composition according to claim 1, containing 0.01% to 0.5% by mass of the component (c-1) in the composition.

8. The composition according to claim 1, wherein the bleaching activator of the component (c-2) is 4-decanoyloxybenzoic acid or sodium 4-nonanoyloxybenzenesulfonate.

9. The composition according to claim 2, wherein the bleaching activating catalyst of the component (c-1) is a (tris (salicylideneiminoethyl)amine)-manganese complex and the bleaching activator of the component (c-2) is 4-decanoyloxybenzoic acid or sodium 4-nonanoyloxybenzenesulfonate.

10. The composition according to claim 1, containing a granulated substance or a molded substance comprising the components (b), (c-1), and (c-2).

11. The composition according to claim 10, containing a binder compound in the granulated substance or the molded substance.

12. The composition according to claim 11, wherein the binder compound is polyethylene glycol with an average molecular weight of 2600 to 9300.

13. The composition according to claim 10, further comprising a surfactant in the granulated substance or the molded substance.

14. The composition according to claim 2, wherein the bleaching activating catalyst of the component (c-1) is a (tris (salicylideneiminoethyl)amine)-manganese complex.

* * * * *